US005178993A

United States Patent [19]

Fujita et al.

[11] Patent Number: 5,178,993

[45] Date of Patent: Jan. 12, 1993

[54] METHOD FOR PROCESSING SILVER HALIDE COLOR PHOTOGRAPHIC MATERIAL

[75] Inventors: Yoshihiro Fujita; Keiji Mihayashi, both of Kanagawa, Japan

[73] Assignee: Fuji Photo Film Co., Ltd., Kanagawa, Japan

[21] Appl. No.: 662,071

[22] Filed: Feb. 28, 1991

[30] Foreign Application Priority Data

Mar. 1, 1990 [JP] Japan ..... 2-50137

[51] Int. Cl.[5] ..... G03C 7/32

[52] U.S. Cl. ..... 430/389; 430/393; 430/430; 430/460; 430/461; 430/553; 430/555; 430/607; 430/613

[58] Field of Search ..... 430/376, 383, 384, 385, 430/388, 389, 393, 400, 430, 460, 461, 477, 553, 555, 558, 607, 613

[56] References Cited

U.S. PATENT DOCUMENTS

| | | | |
|---|---|---|---|
| 2,521,908 | 9/1950 | Glass et al. | 430/389 |
| 4,294,900 | 10/1981 | Aono | 430/389 |
| 4,833,069 | 5/1989 | Hamada et al. | 430/496 |
| 5,064,750 | 11/1991 | Naito | 430/430 |

FOREIGN PATENT DOCUMENTS

| | | |
|---|---|---|
| 3815469 | 11/1989 | Fed. Rep. of Germany . |
| 221748 | 10/1986 | Japan . |

*Primary Examiner*—Hoa Van Le

*Attorney, Agent, or Firm*—Sughrue, Mion, Zinn, Macpeak & Seas

[57] ABSTRACT

A method for rapidly processing a silver halide color photographic material is disclosed, comprising a support having at least one red-sensitive silver halide emulsion layer containing a cyan coupler, at least one green-sensitive silver halide emulsion layer containing a magenta coupler and at least one blue-sensitive silver halide emulsion layer containing a yellow coupler, wherein the photographic material contains a yellow colored cyan coupler, the total processing time for the photographic material is 8 minutes or less, and the processing solution having a bleaching ability for the photographic material contains an oxidizing agent having a redox potential of 150 mV or more. The rapid processing method yields excellent color reproducibility and the photographic material processed by the method has excellent resistance to fading.

17 Claims, No Drawings

METHOD FOR PROCESSING SILVER HALIDE COLOR PHOTOGRAPHIC MATERIAL

FIELD OF THE INVENTION

The present invention relates to a method for processing a silver halide color photographic material; and, in particular, to a method having a high color reproducibility, and which may be rapidly processed.

BACKGROUND OF THE INVENTION

In general, a silver halide color photographic material (hereinafter referred to as a "color photographic material") is, after imagewise exposed, processed by the processing steps such as color development, desilvering, rinsing and stabilization. In the color development step, a color developer is used; in the desilvering step, a bleaching solution, a bleach-fixing solution and/or a fixing solution are used; in the rinsing step, city water or ion-exchanged water is used; and, in the stabilization step, a stabilizing solution is used. The temperature of the processing solutions is generally adjusted to approximately from 30° to 40° C. A color photographic material to be processed is brought into contact with the processing solutions; generally, it is dipped in the processing solutions.

The basic processing steps are the color development step and the desilvering step.

In the color development step, the exposed silver halide in the photographic material to be processed is reduced by the color developing agent in the color developer to give silver, whereupon the oxidized color developing agent reacts with color formers (couplers) to give a color image.

In the desilvering step, which follows the color development step, the silver formed in the previous color development step is oxidized by the action of the bleaching agent which is an oxidizing agent, in the bleaching solution; and thereafter, the oxidized silver is dissolved by the fixing agent which is a silver complex-forming agent. After completion of these steps, only the color image formed remains on the processed photographic material.

In the desilvering step, may be effected by a method where the bleaching step and the fixing step may be carried out in the same bath; or, the bleaching step and the bleach-fixing step may be carried out in different baths. In either case, each bath may be composed of plural tanks.

In addition to the above mentioned basic steps, the processing method may include various other auxiliary steps to maintain the photographic and physical qualities of the color images formed and to improve the storage stability of the images. Such auxiliary steps may include, for example, the use of a hardening bath, a stopping bath, a stabilizing bath and a rinsing bath.

In general, the processing described above is carried out with an automatic developing machine. Recently, a small shop processing service system, called a "minilaboratory", has become popular; and, accordingly, rapid processing of photographic materials has become important.

For conducting rapid processing, first the development step is accelerated. Various means for accelerating the development step are known, including: a method of high temperature treatment as described in JP-A-1-140149 (the term "JP-A" as used herein refers to a "published unexamined Japanese patent application"); a method of jetting a stream of a processing solution to the photographic material being processed; a reinforced stirring method of rubbing the material being processed with a brush or roller; a method of increasing the amount of the developing agent in the processing solution; a method of elevating the pH value of the processing solution; a method of imparting a strong pH buffering ability to the processing solution; and a method of incorporating various development accelerators into the processing solution. For example, the method of increasing the concentration of the developing agent in the processing solution is described in JP-A-62-170955 and JP-A-63-149647. Examples of usable development accelerators include thioether compounds described in JP-B-45-9019 (the term "JP-B" as used herein refers to an "examined Japanese patent publication"), U.S. Pat. No. 3,818,247, and West German Patent 2,360,878; p-phenylenediamine compounds described in JP-A-52-49829 and JP-A-50-15554; quaternary ammoniilm salts described in JP-A-56-156826 and JP-A-52-43429; amine compounds described in JP-B-41-11431, and U.S. Pat. Nos. 2,482,546 and 3,582,346; polyalkylene oxides described JP-B-41-11431 and JP-B-42-23883, and U.S. Pat. No. 3,532,501; and silane compounds described in European Patent 229,720.

To conduct rapid processing, next, the desilvering step is accelerated. To accelerate this step, known methods may include accelerating the bleaching step or acclerating the fixing step. Alternatively, the number of desilvering steps may be reduced by employing a bleach-fixing step, in which bleaching and fixation are carried out simultaneously. Using such a bleach-fixing step shortens the desilvering time.

The desilvering step may be accelerated by elevating the processing temperature, selecting the optimum pH value, or reinforced stirring.

For accelerating the bleaching step, a high potential oxidizing agent, such as red prussiate of potash, bichromates, ferric chloride, persulfates and bromates, may be used. Examples of bleaching accelerators include mercapto compounds and disulfide compounds described in British Patent 1,138,842 and JP-A-53-95630; and thiazolidine derivatives described in JP-A-50-140129.

In addition to the above mentioned steps, other rinsing and stabilization steps may also be accelerated by elevating the processing temperature or by enhancing stirring.

Color photographic materials are classified into two groups: one contains couplers (coupler-in-emulsion type photographic material), while the other receives couplers from processing solutions (coupler-in-developer type photographic material). Generally, the former coupler-in-emulsion type photographic material is most popular.

Almost all color negative films are of the coupler-in-emulsion type, and generally contain yellow dye-forming, magenta dye-forming and cyan dye-forming color couplers. To correct the unnecessary absorption of the dyes formed from such dye-forming couplers and to improve their color-reproducibility, colored couplers may be used. Colored couplers are described, for example, in *Research Disclosure,* No. 17643, U.S. Pat. No. 4,163,670, 4,004,929 and 4,138,258, British Patent 1,146,368 and JP-B-57-39413. Such colored couplers are used to mask the yellow second absorption of magenta dyes and the magenta second absorption of cyan dyes.

As described in JP-A-61-221748 and West German Patent (OLS) 3,815,469, yellow colored cyan couplers which mask the yellow second absorption of cyan dyes may also be used to obtain color photographs having improved color reproducibility.

However, it has been found that when a yellow colored cyan coupler-containing photographic material is processed by the rapid processing techniques described above, the cyan-colored area has an unnecessary yellow absorption which noticeably lowers the essential masking effect.

In such cases, therefore, it is extremely difficult to obtain both the excellent color reproducibility and rapid processability.

SUMMARY OF THE INVENTION

The object of the present invention is to provide a method of rapid processing of a silver halide color photographic material containing a yellow colored cyan coupler, without altering the color reproducibility and photographic properties of the material.

This object has been attained by a method of processing a silver halide color photographic material comprising a support having thereon at least one red-sensitive silver halide emulsion layer containing a cyan coupler, at least one green-sensitive silver halide emulsion layer containing a magenta coupler and at least one blue-sensitive silver halide emulsion layer containing a yellow coupler wherein the photographic material contains a yellow colored cyan coupler, the total processing time for the photographic material is 8 minutes or less and the processing solution having a bleaching ability for the photographic material contains an oxidizing agent having a redox potential of 150 mV or more.

DETAILED DESCRIPTION OF THE INVENTION

The silver halide color photographic material to be processed by the method of the present invention contains a yellow colored cyan coupler, which will be explained in detail below.

The yellow colored cyan coupler in the photographic material of the present invention has an absorption maximum between 400 nm and 500 nm in the visible absorption range and couples with the oxidation product of an aromatic primary amine developing agent to form a cyan dye having an absorption maximum between 630 nm and 750 nm in the visible absorption range.

Yellow colored cyan couplers which react with the oxidation product of an aromatic primary amine developing agent by coupling reaction to release a compound residue containing a water-soluble 6-hydroxy-2-pyridon-5-ylazo group, a water-soluble pyrazolon-4-ylazo group, a water-soluble 2-acylaminophenylazo group or a water-soluble 2-sulfonamidophenylazo group are preferably employed in the present invention.

Specifically, yellow colored cyan couplers which are preferably used in the present invention are represented by formulae (CI) to (CIV):

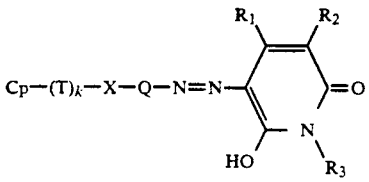

(CI)

-continued

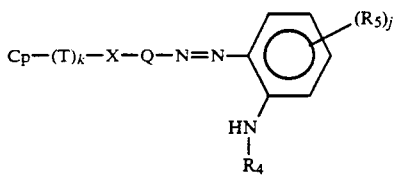

(CII)

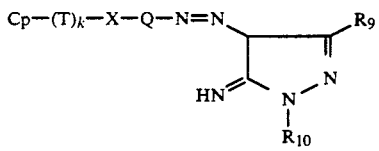

(CIII)

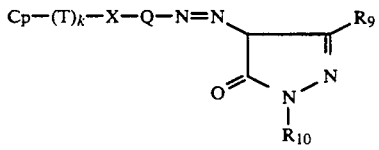

(CIV)

In formulae (CI) to (CIV), Cp represents a cyan coupler residue having T bonded to its coupling position; T represents a timing group; k represents an integer of 0 or 1; X represents a divalent linking group which contains N, O or S and which is bonded to via N, O or S to link (T)k and Q; and Q represents an arylene group or a divalent heterocyclic group.

In formula (CI), $R_1$ and $R_2$ independently represent a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group or an alkylsulfonyl group. $R_3$ represents a hydrogen atom, an alkyl group, a cycloalkyl group, an aryl group or a heterocyclic group. At least one of T, X, Q, $R_1$, $R_2$ and $R_3$ contains a water-soluble group (for example, hydroxyl, carboxyl, sulfo, amino, ammoniumyl, phosphono, phosphino, hydroxysulfonyloxy).

It is well known that the moiety

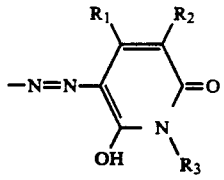

in compound (CI) may have the following tautomeric structures which are within the scope of the structure of formula (CI) as defined in the present invention.

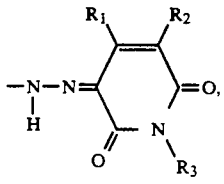

-continued

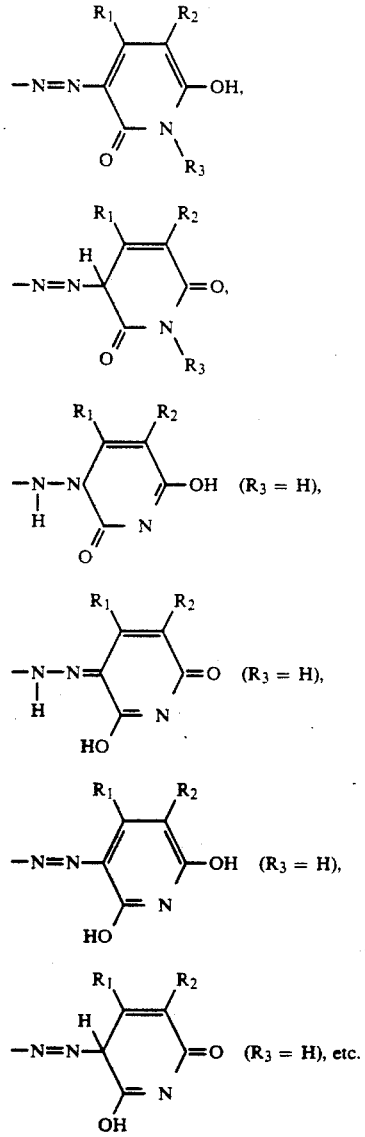

In formula (CII), $R_4$ represents an acyl group or a sulfonyl group; $R_5$ represents a substitutable group; and j represents an integer of from 0 to 4. When j is an integer of 2 or more, plural $R_4$'s may be the same or different. In formula (CII), at least one of T, X, Q, $R_4$ and $R_5$ contains a water-soluble group (for example, hydroxyl, carboxyl, sulfo, phosphono, phosphino, hydroxysulfonyloxy, amino, ammoniumyl).

In formulae (CIII) and (CIV), $R_9$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamido group, a sulfonamido group, or an alkylsulfonyl group. $R_{10}$ represents a hydrogen atom, an alkyl group, a cycloalkyl group, an aryl group, or a heterocyclic group. At least one of T, X, Q, $R_9$ and $R_{10}$ contains a water-soluble group (for example, hydroxyl, carboxyl, sulfo, phosphono, phosphino, hydroxysulfonyloxy, amino, ammoniumyl).

In formula (CIII), the moiety

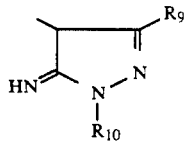

and the moiety

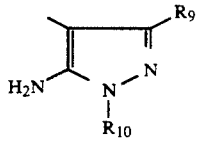

are tautomers, and these formulae indicate the same compound.

In formulae (CI) to (CIV), the coupler residue, represented by Cp, may be any known cyan coupler residue (for example, phenol cyan coupler residue or naphthol cyan coupler residue).

Preferred examples of Cp include coupler residues with the following formulae (Cp-6), (Cp-7) and (Cp-8) below:

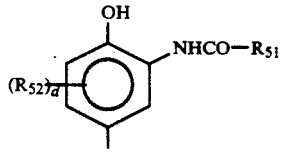

(Cp-6)

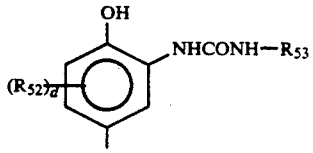

(Cp-7)

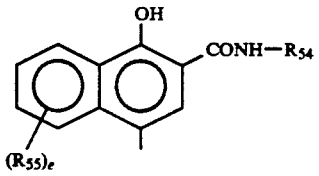

(Cp-8)

In the above formulae, the free bond derived from the coupling position is the site where the coupling releasing group is bonded.

In compounds where $R_{51}$, $R_{52}$, $R_{53}$, $R_{54}$ or $R_{55}$ contains a nondiffusible group, each group has a total carbon number of from 8 to 40, preferably 10 to 30. In other cases, the total carbon number of the group is preferably 15 or less. Where the couplers of the above mentioned compounds are of the bis type, telomer type or polymer type, any of $R_{51}$, $R_{52}$, $R_{53}$, $R_{54}$ and $R_{55}$ may be a divalent group which is bonded to a repeating unit, or the like. In such a case, the above defined limitation on the total carbon number of the substituent does not apply.

Next, $R_{51}$, $R_{52}$, $R_{53}$, $R_{54}$, $R_{55}$, d and e will be described in greater detail. In the following explanation, $R_{41}$ represents an aliphatic group, an aromatic group or a heterocyclic group; $R_{42}$ represents an aromatic group or a heterocyclic group; and $R_{43}$, $R_{44}$ and $R_{45}$ each represents a hydrogen atom, an aliphatic group, an aromatic group or a heterocyclic group.

$R_{51}$ has the same meaning is $R_{42}$. $R_{52}$ has the same meaning as $R_{41}$, or represents $$R_{41}\underset{\underset{R_{43}}{|}}{CON}-,\ R_{41}\underset{\underset{R_{43}}{|}}{OCON}-,\ R_{41}SO_2\underset{\underset{R_{43}}{|}}{N}-,\ R_{43}\underset{\underset{R_{44}}{|}}{N}-CO-\underset{\underset{R_{45}}{|}}{N}-,$$

$$R_{41}\underset{\underset{R_{43}}{|}}{N}-;$$

d represents from 0 to 3; e represents from 0 to 3. When d is a plural number, multiple $R_{52}$'s may be the same or different substituents. $R_{52}$'s may be bonded to each other as divalent groups to form a cyclic structure. As examples of divalent groups for forming a cyclic structure,

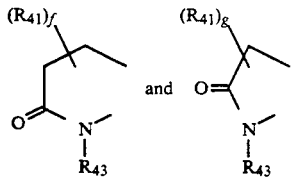

are typical, where f represents an integer of from 0 to 4; and g represents an integer of from 0 to 2. $R_{53}$ and $R_{54}$ have the same meaning as $R_{41}$. $R_{55}$ has the same meaning as $R_{41}$ or represents $R_{41}OCONH$—, $R_{41}SO_2NH$—, $$R_{43}\underset{\underset{R_{44}}{|}}{N}-CO-\underset{\underset{R_{45}}{|}}{N}-,\ R_{43}\underset{\underset{R_{44}}{|}}{N}-SO_2-\underset{\underset{R_{45}}{|}}{N}-,$$

$R_{43}O$—, $R_{41}$ S—, a halogen atom or $$R_{41}\underset{\underset{R_{43}}{|}}{N}-.$$

Where the compound (Cp-8) has multiple $R_{55}$'s, they may be the same or different.

In the above mentioned compounds, the aliphatic group is a saturated or unsaturated, chain or cyclic, or straight chain or branched, substituted or unsubstituted aliphatic hydrocarbon group having from 1 to 32 carbon atoms, preferably from 1 to 22 carbon atoms. Specific examples of the group include methyl, ethyl, propyl, isopropyl, butyl, (t)-butyl, (i)-butyl, (t)-amyl, hexyl, cyclohexyl, 2-ethylhexyl, octyl, 1,1,3,3-tetramethylbutyl, decyl, dodecyl, hexadecyl and octadecyl group.

The aromatic groups include a substituted or unsubstituted phenyl group or a substituted or unsubstituted naphthyl group, having from 6 to 20 carbon atoms.

The heterocyclic group may be a 3-membered to 8-membered substituted or unsubstituted, having from 1 to carbon atoms, preferably from 1 to 7 carbon atoms and having one or more hetero atoms selected from nitrogen, oxygen and sulfur atoms. Specific examples of the heterocyclic group are 2-pyridyl, 2-thienyl, 2-furyl, 1,3,4-thiadiazol-2-yl, 2,4-dioxo-1,3-imidazolidin-5-yl, 1,2,4-triazol-2-yl and 1-pyraozlyl groups.

The above mentioned aliphatic hydrocarbon groups, aromatic group and heterocyclic group may be substituted. Specific examples of substituents include a halogen atom, $R_{47}O$—, $R_{46}S$—, $$R_{47}\underset{\underset{R_{48}}{|}}{CON}-,\ R_{47}\underset{\underset{R_{48}}{|}}{NCO}-,\ R_{46}\underset{\underset{R_{47}}{|}}{OCON}-,\ R_{46}SO_2\underset{\underset{R_{47}}{|}}{N}-,\ R_{47}\underset{\underset{R_{48}}{|}}{NSO_2}-,$$

$$R_{46}SO_2-,\ R_{47}OCO-,\ R_{47}\underset{\underset{R_{48}}{|}}{N}-CO-\underset{\underset{R_{49}}{|}}{N}-,\ R_{46}-,$$

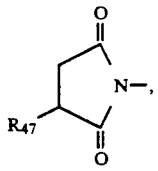

$R_{46}COO$—, $R_{47}OSO_2$—, a cyano group and a nitro group. R46 represents an aliphatic group, an aromatic group or a heterocyclic group; and $R_{47}$, $R_{48}$ and $R_{49}$ each represents an aliphatic group, an aromatic group, a heterocyclic group, or a hydrogen atom. The aliphatic group, aromatic group and heterocyclic group are the same as those defined above.

In formula (Cp-6), $R_{51}$ is preferably an aliphatic group or an aromatic group, $R_{52}$ is preferably a chlorine atom, an aliphatic group or $R_{41}CONH$—; and d is preferably 1 or 2. $R_{53}$ is preferably an aromatic group. In formula (Cp-7), $R_{52}$ is preferably $R_{41}CONH$—, d is preferably 1 (one), and $R_{53}$ is preferably an aliphatic group or an aromatic group. In formula (Cp-8), e is preferably 0 or 1, and $R_{55}$ is preferably $R_{41}OCONH$—, $R_{41}CONH$—or $R_{41}SO_2NH$—, which are preferably bonded to the 5-position of the naphthol ring.

The timing group, represented by T, is cleaved from X, after the bond between Cp and T has been cleaved by the coupling reaction between the coupler Cp and the oxidation product of an aromatic primary amine developing agent. The group T adjusts the coupling reactivity, stabilizes the coupler moiety, and adjusts the timing for release of the moiety X and the group bonding to X. As examples of the timing group, the following known groups are referred to, where (*) indicates the position which bonds to Cp and (**) indicates the position which bonds to X, or (*) indicates the position which bonds to Cp and (**) indicates the position which bonds to Q.

(T-1)

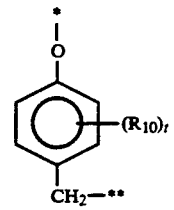

(T-2)

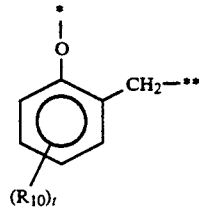

-continued (T-3)

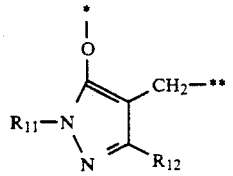

(T-4)

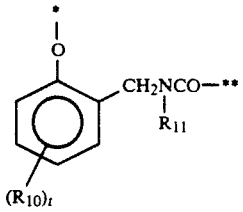

(T-5)

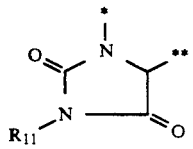

(T-6) $*-OCH_2-*$ (T-7) $*-\overset{O}{\overset{\|}{C}}-**$

In the formulae, $R_{10}$ represents a group substitutable on the benzene ring; $R_{11}$ has the same meaning as $R_{41}$; $R_{12}$ represents a hydrogen atom or a substituent; and t represents an integer of from 0 to 4.

Examples of substituents to be represented b $R_{10}$ and $R_{12}$ include $R_{41}$—, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—, $R_{41}COO$—, $R_{41}SO$—, a nitro group, $R_{43}(R_{44})NCON(R_{45})$—, a cyano group, $R_{41}OCON(R_{43})$—, $R_{43}OSO_2$—, $R_{43}(R_{44})N$—, $R_{43}(R_{44})NSO_2N(R_{45})$—, or

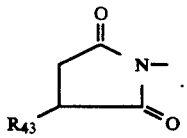

k represents an integer of 0 or 1. In general, k is preferably 0; Cp and X are preferably bonded to each other directly.

X represents a divalent linking group, which is bonded to $(T)_k$ and Cp via N, O or S. It is preferably —O—, —S—, $$-\overset{O}{\overset{\|}{C}}-,\ -\overset{O}{\overset{\|}{C}}O-,\ -\overset{O}{\overset{\|}{C}}S-,\ -\overset{O}{\overset{\|}{C}}NH-,$$

$—OSO_2—$or $—OSO_2NH—$, or a heterocyclic group which is bonded to and Cp via N (for example, a residue derived from pyrrolidine, piperidine, morpholine, piperazine, pyrrole, pyrazole, imidazole, 1,2,4-triazole, benzotriazole, succinimide, phthalimide, oxazolidine-2,4-dione, imidazolidine-2,4-dione, or 1,2,4-triazolidine-3,5-dione), or a composite linking group which is composed of any one of the above mentioned groups and an alkylene group (for example, mehtylene, ethylene, propylene), a cycloalkylene group (for example, 1,4-cyclohexylene), an arylene group (for example, o-phenylene, p-phenylene), a divalent heterocyclic group (for example, a residue to be derived from pyridine or thiophene), —CO—, $—SO_2—$, —COO—, —CONH—, $—SO_2NH—$, $—SO_2O—$, —NHCO—, $—NHSO_2—$, —NHCONH—, $—NHSO_2NH—$, or —NHCOO—.

X is more preferably a group represented by formula (II'):

$$*-X_1-(L-X_2)_m-** \qquad (II')$$

In formula (II'), (*) indicates the position at which the substituent is bonded to $(T)_k$ and the preceding group; (**) indicates the position at which the substituent is bonded to Q and the following group; $X_1$ represents —O—or —S—; L represents an alkylene group; and $X_2$ represents a single bond, —O—, —S—, —CO—, $—SO_2—$, $$-\overset{O}{\overset{\|}{C}}-,\ -\overset{O}{\overset{\|}{C}}-,\ -NH\overset{O}{\overset{\|}{C}}-,\ -CN\overset{O}{\overset{\|}{H}}-,\ -SO_2NH-,$$

$$-NHSO_2-,\ -SO_2O-,\ -OSO_2-,\ -O\overset{O}{\overset{\|}{C}}O-,$$

$$-O\overset{O}{\overset{\|}{C}}NH-,\ -NH\overset{O}{\overset{\|}{C}}O-,\ -NH\overset{O}{\overset{\|}{C}}NH-,$$

$$-NHSO_2NH-,\ -O\overset{S}{\overset{\|}{C}}-,\ -S\overset{O}{\overset{\|}{C}}-,$$

$—OSO_2NH—$or $—NHSO_2O—$; and m represents an integer of from 0 to 3. Preferably, X has a total carbon number (hereinafter referred to as a "C-number") of from 0 ta 12, more preferably from 0 to 8. X is most preferably $—OCH_2CH_2O—$.

Q represents an arylene group or a divalent heterocyclic group. Where Q is an arylene group, the arylene group may be in the form of a condensed ring or may have substituent(s) (for example, a halogen atom, a hydroxyl group, a carboxyl group, a sulfo group, a nitro group, a cyano group, an amino group, an ammonium group, a phosphono group, a phosphino group, an alkyl group, a cycloalkyl group, an aryl group, a carbonamido group, a sulfonamido group, an alkoxy group, an aryloxy group, an acyl group, a sulfonyl group, a carboxyl group, a carbamoyl group and a sulfamoyl group). The group preferably has a C-number of from 6 to 15, more preferably from 6 to 10.

Where Q is a divalent heterocyclic group, the group is a 3-membered to 8-membered, preferably 5-membered to 7-membered, monocyclic or condensed cyclic heterocyclic group having at least one hetero atom selected from the group consisting of N, O, S, P, Se and Te in the ring. For example, the heterocyclic group may be derived from pyridine, thipphene, furan, pyrrole, pyrazole, imidazole, thiazole, oxazole, benzothiazole, benzoxazole, benzofuran, benzothiophene, 1,3,4-thiadiazole, indole or quinoline. It may have substituent(s), such as those for the above mentioned arylene group. Preferably, the heterocyclic group has a C-number of from 2 to 15, more preferably from 2 to 10. Most preferably, Q is

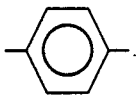

Accordingly, —(T)$_k$—X—Q is most preferably

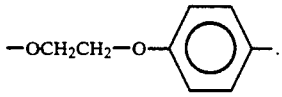

In compound CI, where $R_1$, $R_2$ or $R_3$ is an alkyl group, the group may be linear or branched, may contain unsaturated bond(s) or substituent(s). Examples of substituents include a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamide group, a sulfonamidc group, a carbamoyl group, a sulfamoyl group and a sulfonyl group.

Where $R_1$, $R_2$ or $R_3$ is a cycloalkyl group, the group is a 3-membered to 8-membered cycloalkyl group and may contain crosslinked group(s) and/or unsaturated bond(s). It may also have substituent(s). Examples of substituents include those for the above mentioned alkyl group.

Where $R_1$, $R_2$ or $R_3$ is an aryl group, the group may be in the form of a condensed ring or it may have substituent(s). Examples of substituents include alkyl groups and cycloalkyl groups, in addition to the substituents for the above mentioned alkyl group.

Where $R_1$, $R_2$ or $R_3$ is a heterocyclic group, the group is a 3-membered to 8-membered (preferably, 5- 0 membered to 7-membered) monocyclic or condensed heterocyclic group having at least one hetero atom selected from the group consisting of N, S, O, P, Se and Te in the ring, for example, an imidazolyl, thienyl, pyrazolyl, thiazolyl, pyridyl or quinolyl group. It may have substituent(s) such as those for the above mentioned aryl group.

The carboxyl group includes a carboxylato group; the sulfo group includes a sulfonato group; the phosphino group includes a phosphinato group; and the phosphono group includes a phosphonato group; along with a pair ion of $Li^+$, $Na^+$, $K^+$or ammonium.

$R_1$ is preferably a hydrogen atom, a carboxyl group, an alkyl group having from 1 to 10 carbon atoms (e.g., methyl, t-butyl, sulfomethyl, carboxymethyl, hydroxymethyl, benzyl, ethyl, isopropyl), or an aryl group having from 6 to 12 carbon atoms (e.g., phenyl, 4-methoxyphenyl, 4-sulfophenyl). Especially preferably, it is a hydrogen atom, a methyl group, or a carboxyl group.

$R_2$ is preferably a cyano group, a carboxyl group, a carbamoyl group having from 1 to 10 carbon atoms, a sulfamoyl group having from 0 to 10 carbon atoms, a sulfo group, an alkyl group having from 1 to 10 carbon atoms (e.g., methyl, sulfomethyl), a sulfonyl group having from 1 to 10 carbon atoms (e.g., methylsulfonyl, phenylsulfonyl), a carbonamido group having from 1 to 10 carbon atoms (e.g., acetamide, benzamide), or a sulfonamidc group having from 1 to 10 carbon atoms (e.g., methanesulfonamido, toluenesulfonamide). Especially preferably, $R_2$ is a cyano group, a carbamoyl group or a carboxyl group.

$R_3$ is preferably a hydrogen atom, an alkyl group having from 1 to 12 carbon atoms (e.g., methyl, sulfomethyl, carboxymethyl, ethyl, n-butyl, benzyl, 4-sulfobenzyl), or an aryl group having from 6 to 15 carbon atoms (e.g., phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, 2,5-disulfophenyl). More preferably, it is an alkyl group having from 1 to 7 carbon atoms, or an aryl group having from 6 to 10 carbon atoms.

In compound CII, $R_4$ is specifically an acyl group having the following formula (III'), or a sulfonyl group having the following formula (IV').

$$R_{11}-\underset{\underset{O}{\|}}{C}- \qquad \text{(III')}$$

$$R_{11}SO_2- \qquad \text{(IV')}$$

Where $R_{11}$ is an alkyl group, the group may be either linear or branched, or it may contain unsaturated bond(s), or it may have substituent(s). Examples of substituents include a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamide group, a sulfonamide group, a carbamoyl group, a sulfamoyl group and a sulfonyl group.

Where $R_{11}$ is a cycloalkyl group, the group is a 3-membered to 8-membered cycloalkyl group which may contain crosslinked group(s) and/or unsaturated bond(s). It may also have substituent(s), such as those for the above mentioned alkyl group.

Where $R_{11}$ is an aryl group, the group may be a condensed ring or it may have substituent(s). Examples of substituents include an alkyl group and a cycloalkyl group, in addition to the substituents for the above mentioned alkyl group of $R_{11}$.

Where $R_{11}$ is a heterocyclic group, the group is a 3-membered to 8-membered (preferably, 5-membered to 7-membered) monocyclic or condensed heterocyclic group having at least one hetero atom selected from the group consisting of N, S, 0, P, Se and Te in the ring, for example, an imidazolyl, thienyl, pyrazolyl, thiazolyl, pyridyl or quinolyl group. It may have substituent(s), such as those for the above mentioned aryl group.

The carboxyl group includes a carboxylato group; the sulfo group includes a sulfonato group; the phosphino group includes a phosphinato group; and the phosphono group includes a phosphonato group; along with a pair ion of $Li^+$, $Na^+$, $K^+$or ammonium.

$R_{11}$ is preferably an alkyl group having from 1 to 10 carbon atoms (e.g., methyl, carboxymethyl, sulfoethyl, cyanoethyl), a cycloalkyl group having from 5 to 8 carbon atoms (e.g., cyclohexyl, 2-carboxycyclohexyl), or an aryl group having from 6 to 10 carbon atoms (e.g., phenyl, 1-naphthyl, 4-sulfophenyl). Especially preferably, it is an alkyl group having from 1 to 3 carbon atoms, or an aryl group having 6 carbon atoms.

In compound CII, $R_5$ is a substitutable group, preferably an electron-donating group, especially preferably —$NR_{12}R_{13}$ or —$OR_{14}$. $R_5$ is preferably at the 4-position in the formula. $R_{12}$, $R_{13}$ and $R_{14}$ may each represent a hydrogen atom, an alkyl group, a cycloalkyl group, an aryl group or a heterocyclic group. $R_{12}$ and $R_{13}$ may form a nitrogen-containing hetero ring, which is preferably alicyclic.

In compound CII, j represents an integer of from 0 to 4, and it is preferably 1 or 2, especially preferably 1.

In compounds CIII and CIV, where $R_9$ or $R_{10}$ is an alkyl group, the group may be linear or branched, and it may contain unsaturated bond(s), and it may have substituent(s). Examples of substituents include a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamide group, a sulfonamide group, a carbamoyl group, a sulfamoyl group, and a sulfonyl group.

Where $R_9$ or $R_{10}$ is a cycloalkyl group, the group is a 3-membered to 8-membered cycloalkyl group which may contain crosslinked group(s) and/or unsaturated bond(s). It may also have substituent(s), such as those for the above mentioned alkyl group.

Where $R_9$ or $R_{10}$ is an aryl group, the group may be a condensed ring or it may have substituent(s). Examples of substituents include an alkyl group or a cycloalkyl group, in addition to the substituents for the above mentioned alkyl groups $R_9$ or $R_{10}$.

Where $R_9$ or $R_{10}$ is a heterocyclic group, the group is a 3-membered to 8-membered (preferably 5-membered to 7-membered) monocyclic or condensed heterocyclic group having at least one hetero atom selected from the group consisting of N, S, O, P, Se and Te in the ring, for example, an imidazolyl, thienyl, pyrazolyl, thiazolyl, pyridyl or quinolyl group. It may have substituent(s), such as those for the above mentioned aryl group.

The carboxyl group includes a carboxylato group; the sulfo group includes a sulfonato group; the phosphino group includes a phosphinato group; and the phosphono group includes a phosphonato group; along with a pair ion of $Li^+$, $Na^+$, $K^+$or ammonium $R_9$ is preferably a cyano group, a carboyl group, a carbamoyl group having from 1 to 10 carbon atoms, an alkoxycarbonyl group having from 2 to 10 carbon atoms, an aryloxycarbonyl group having from 7 to 11 carbon atoms, a sulfamoyl group having from 0 to 10 carbon atoms, a sulfo group, an alkyl group having form 1 to 10 carbon atoms (e.g., methyl, carboxymethyl, sulfomethyl), a sulfonyl group having from 1 to 10 carbon atoms (e.g., methylsulfonyl, phenylsulfonyl), a carbonamide group having from 1 to 10 carbon atoms (e.g acetamide, benzamide), a sulfonamide group having from 1 to 10 carbon atoms (e.g., methanesulfonamide, toluenesulfonamide), an alkyloxy group (e.g., methoxy, ethoxy), or an aryloxy group (e.g., phenoxy). Especially preferably, it is a cyano group, a carbamoyl group, an alkoxycarbonyl group, or a carboxyl group.

$R_{10}$ is preferably a hydrogen atom, an alkyl group having from 1 to 12 carbon atoms (e.g., methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, 4-sulfobenzyl) or an aryl group having from 6 to 15 carbon atoms (e.g., phenyl, 4-carboxyphenyl, 3-carboxyphenyl, 2,4-dicarboxyphenyl, 4-sulfophenyl, 3-sulfophenyl, 2,5-disulfophenyl, 2,4-disulfophenyl). More preferably, it is an alkyl group having from 1 to 7 carbon atoms, or an aryl group having from 6 to 10 carbon atoms.

Next, specific examples of Cp, X, Q,

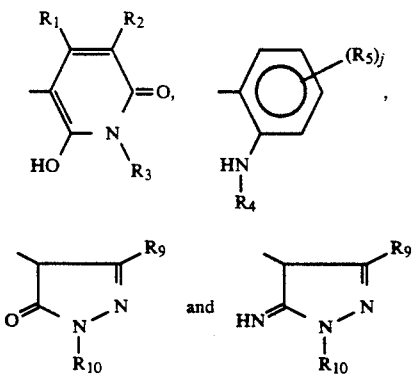

are listed below.

Examples of Cp:

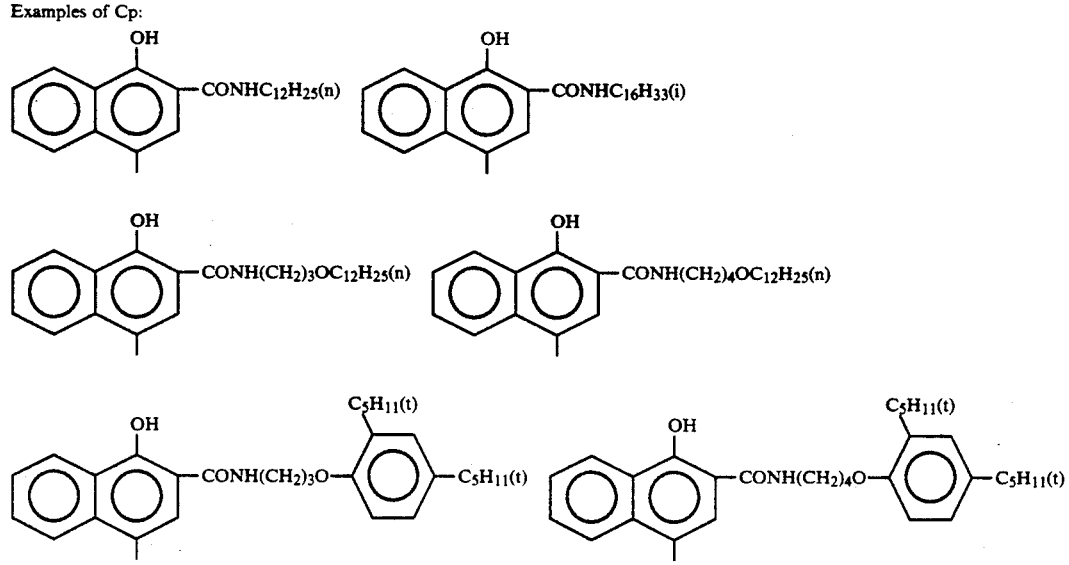

-continued
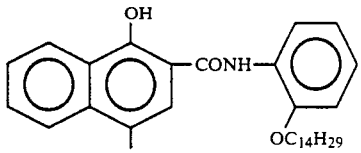
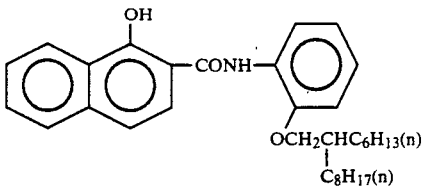
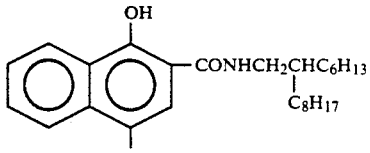
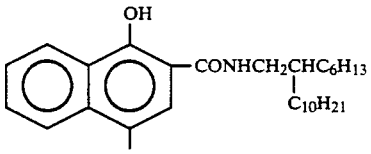
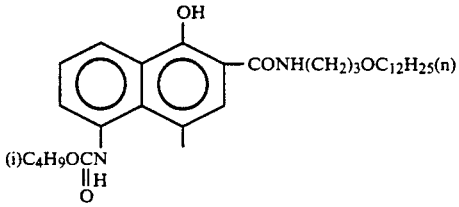
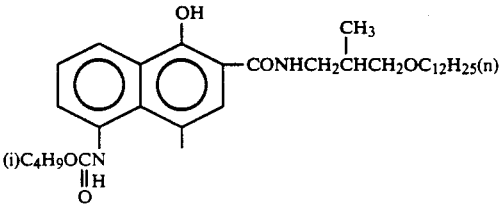
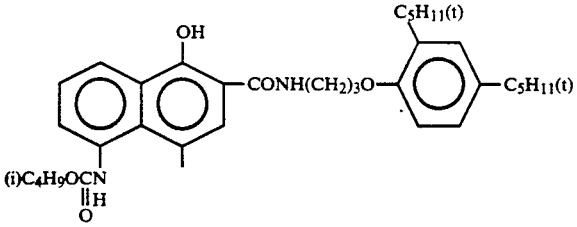
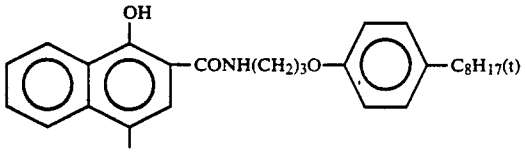
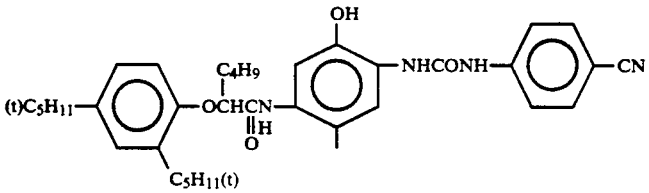
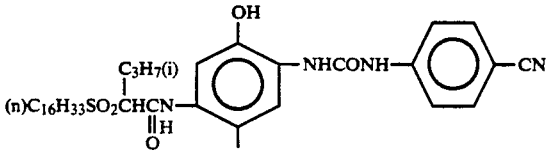
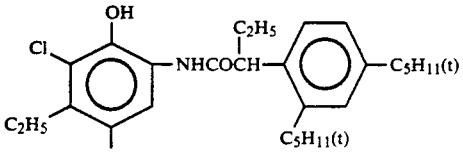
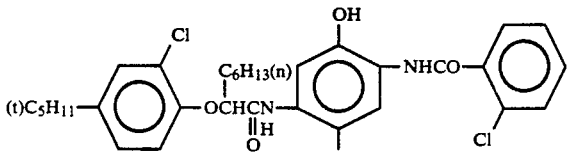

-continued
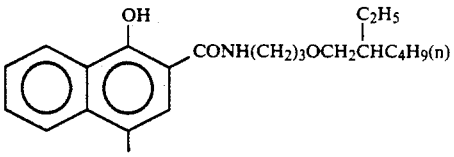
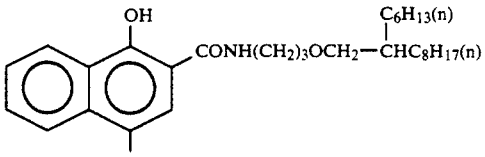
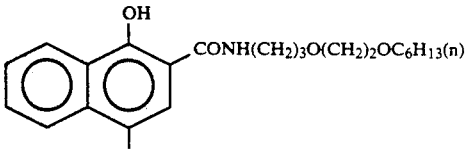
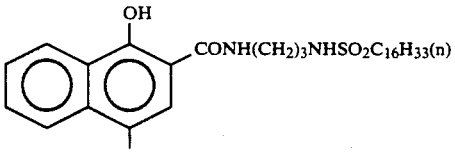
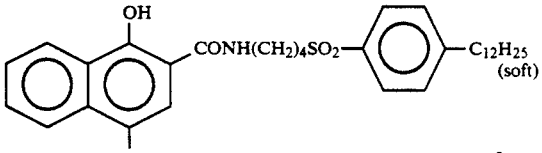
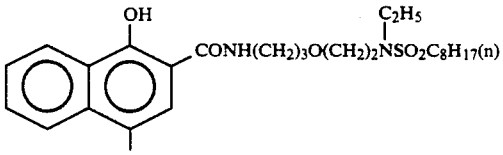
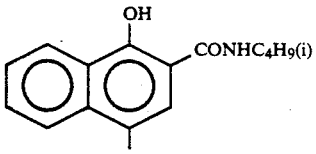
Examples of X:
$-O-$, $-S-$, $-OCH_2-$, $-OCH_2CH_2-$, $-OCH_2CH_2O-$, $-OCH_2CH_2CH_2O-$, $-(CH_2CH_2O)_2-$,
$-OCH_2CH_2S-$, $-OCH_2CH_2NHCO-$, $-OCH_2CH_2NHSO_2-$, $-OCH_2CH_2SO_2-$, $-OCH_2CH_2OCO-$,
$-OCH_2CH_2CO-$, $-SCH_2CONH-$, $-SCH_2COO-$ $-OCH(CH_3)CONH-$, $-OCH_2CH_2OSO_2-$, $-OCO-$,
$-OCH_2CH(CO_2H)-$, $-OCH_2CH(CO_2H)CH_2-$, $-OCH_2CH(CO_2H)O-$, $-OCH(CO_2H)CH_2O-$, $-OCH_2CH(CO_2H)S-$, $-OCH_2CH(SO_3Na)O-$,
Examples of Q:
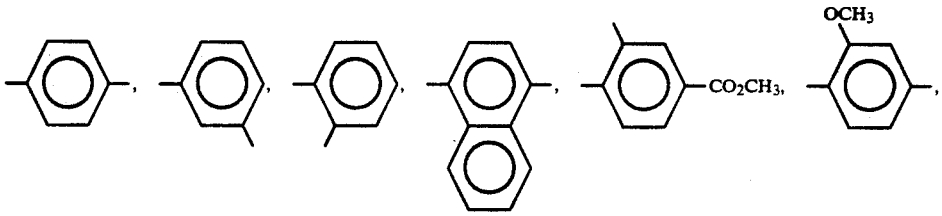
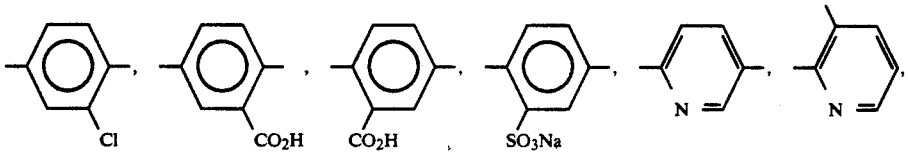
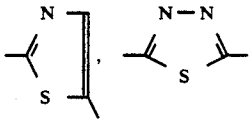

-continued
Examples of 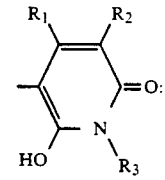 :
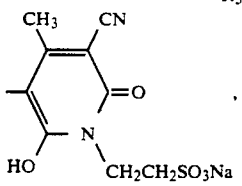
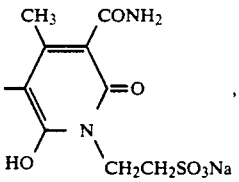
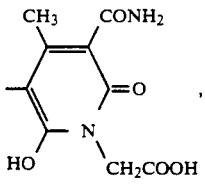
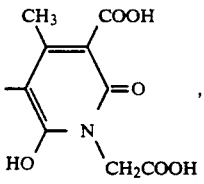
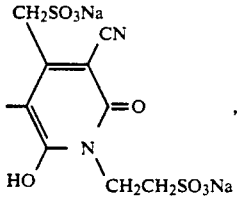
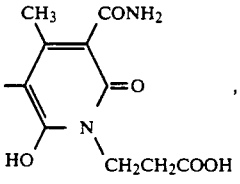
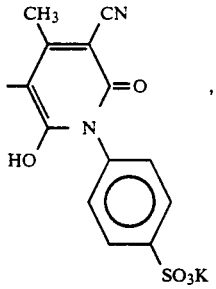
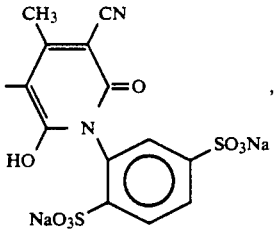
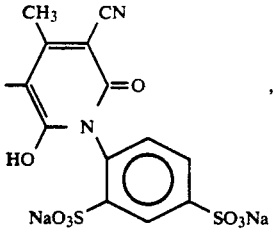
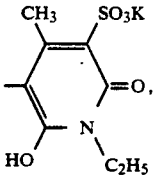
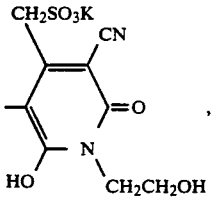
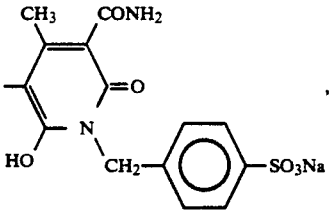
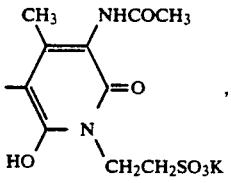
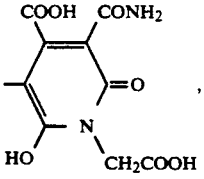
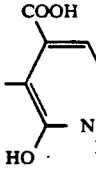
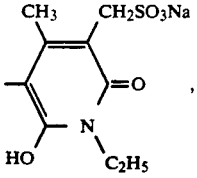
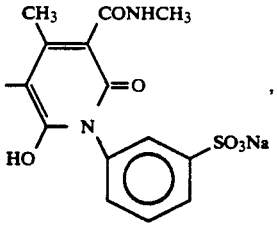
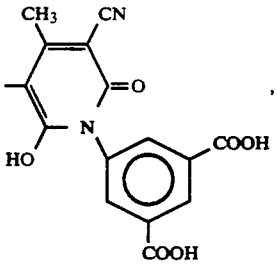
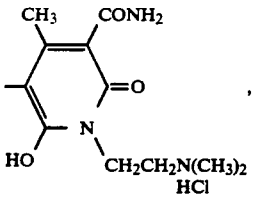
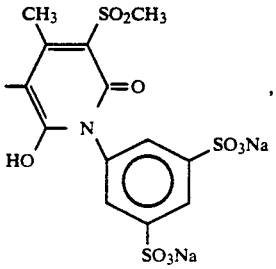
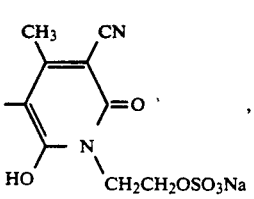
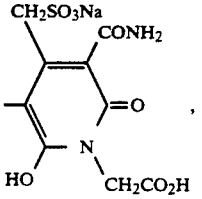
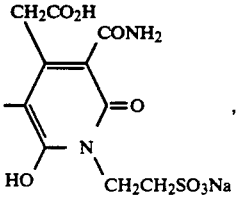

-continued
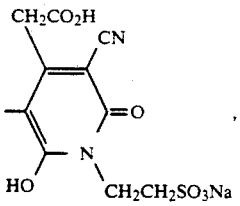
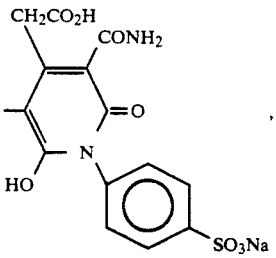
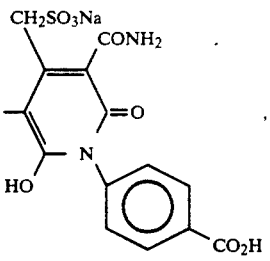
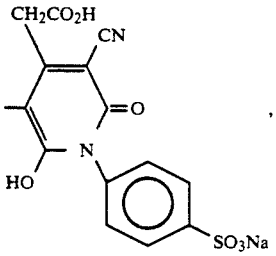
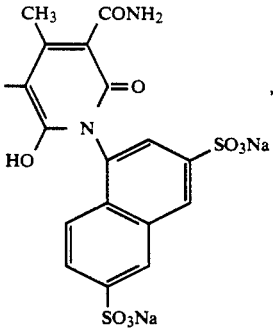
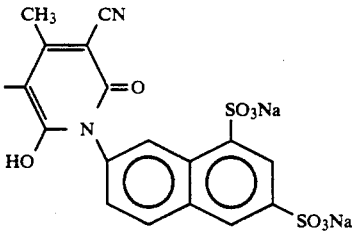
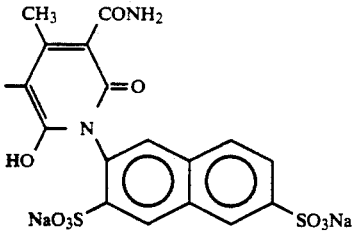
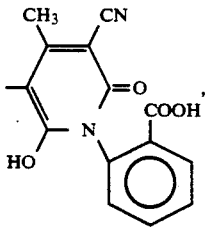
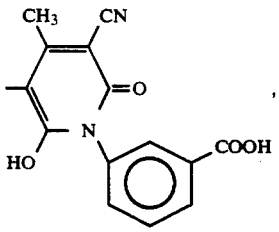
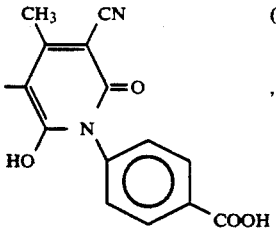
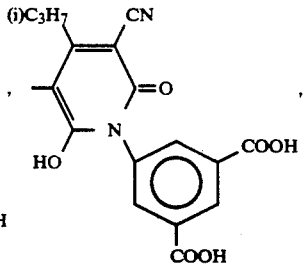
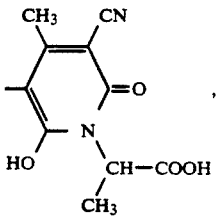
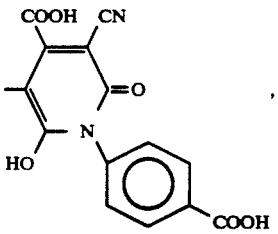
Examples of 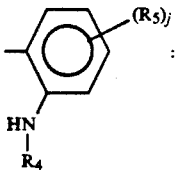 :
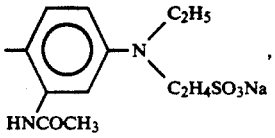
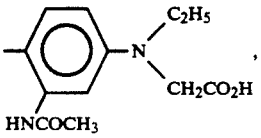
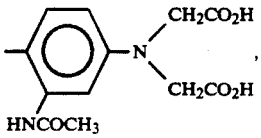
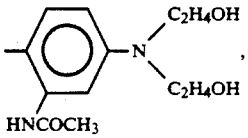
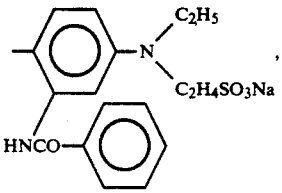
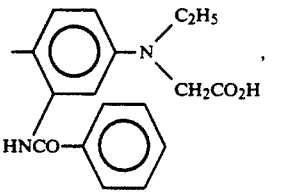

-continued
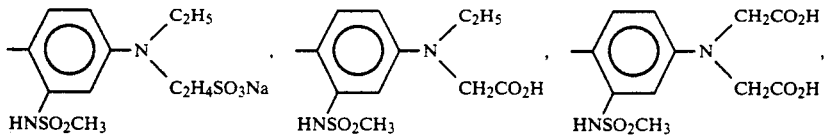
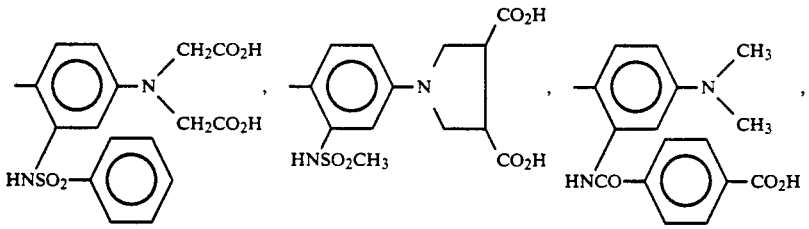
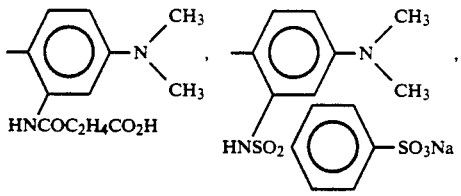
Examples of 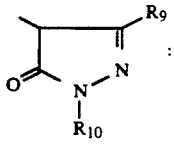 :
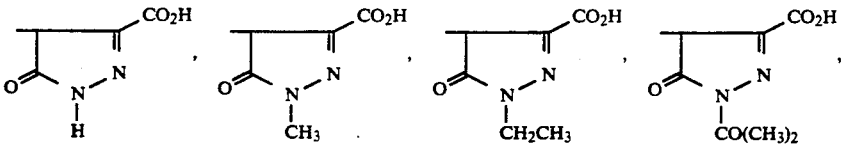
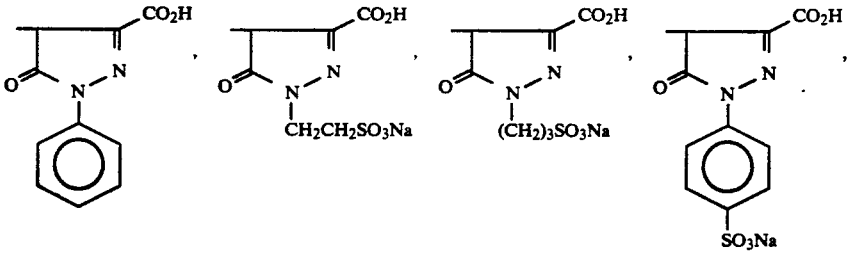
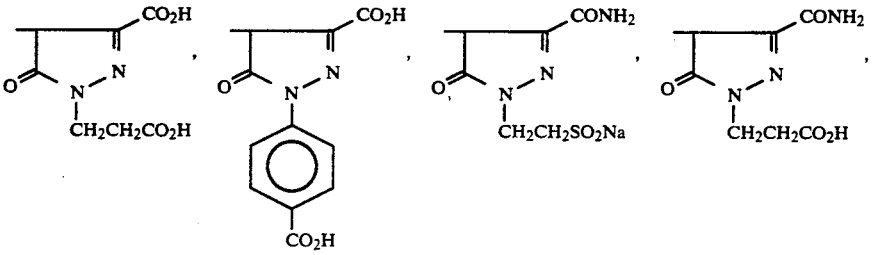

-continued
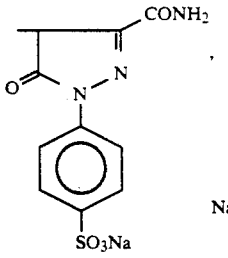
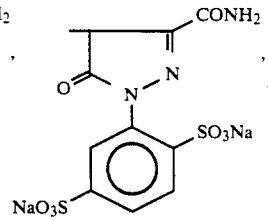
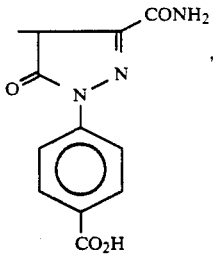
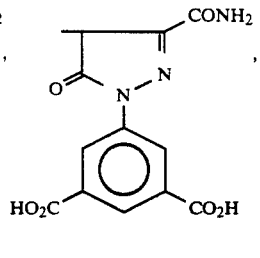
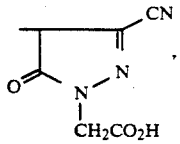
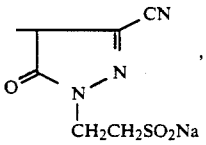
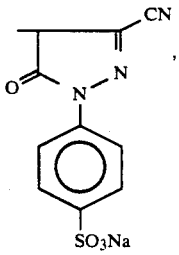
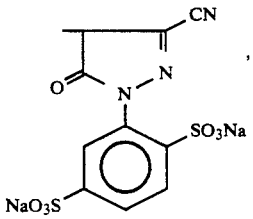
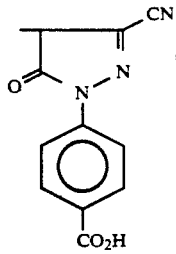
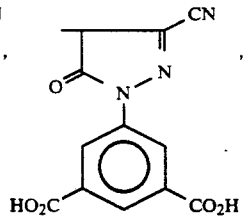
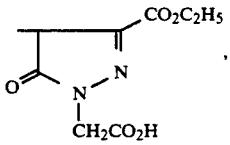
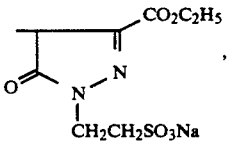
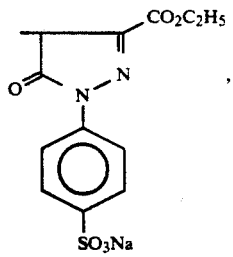
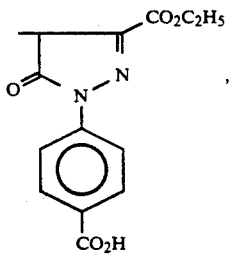
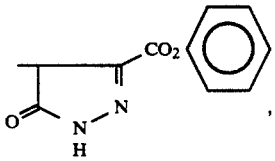
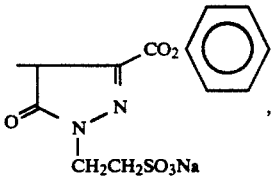
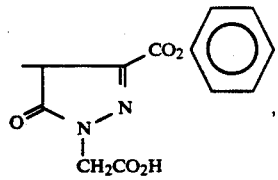
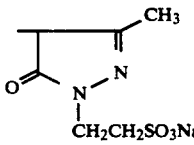
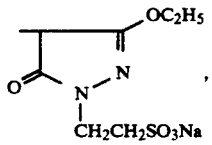
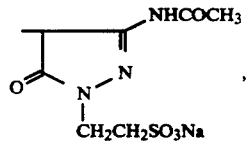
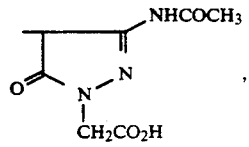
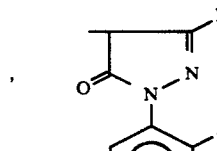
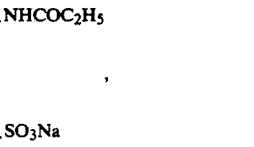
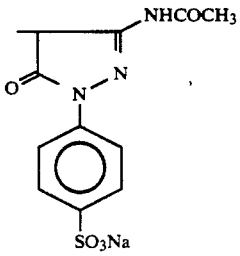
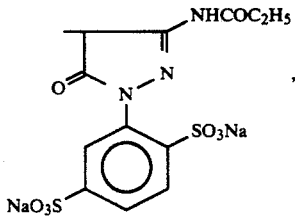

-continued
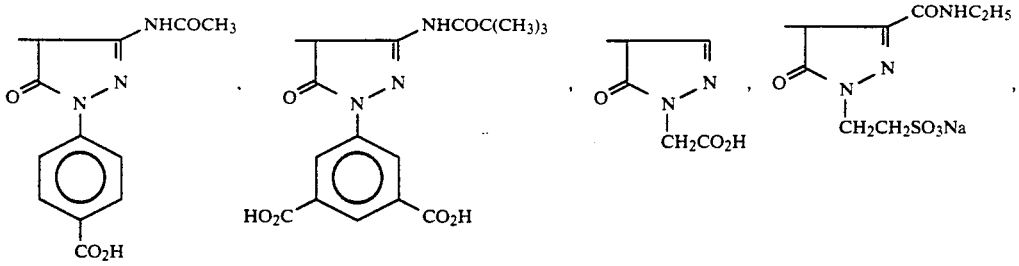
Examples of 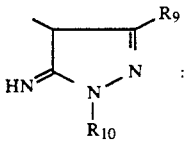 :
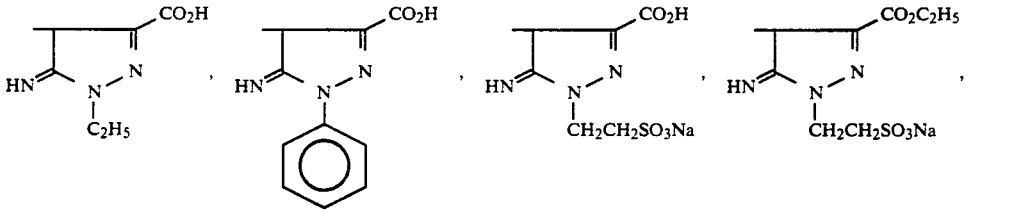
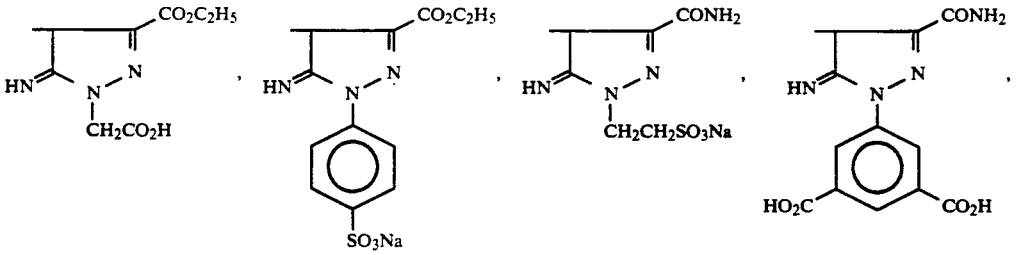
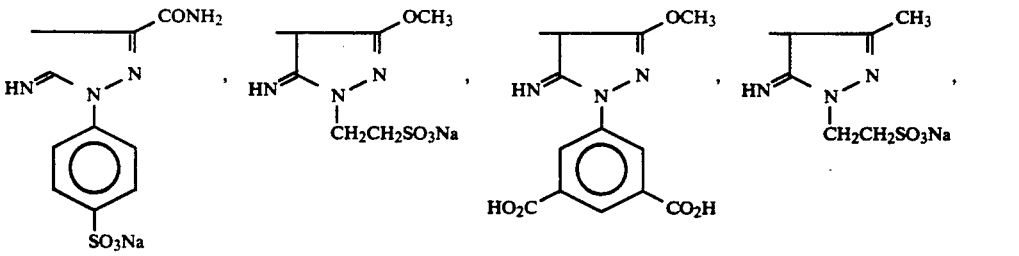
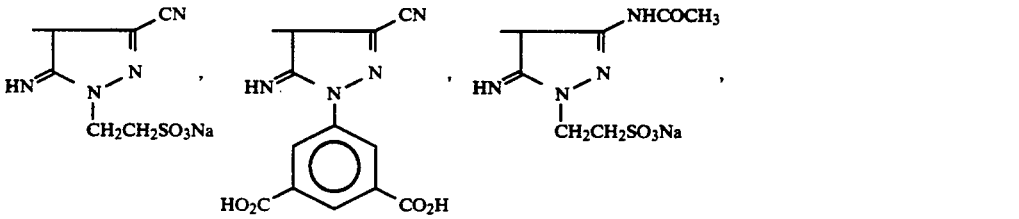
Specific examples of yellow colored couplers which are used in the present invention are mentioned below. However, this list is not intended to be limiting.

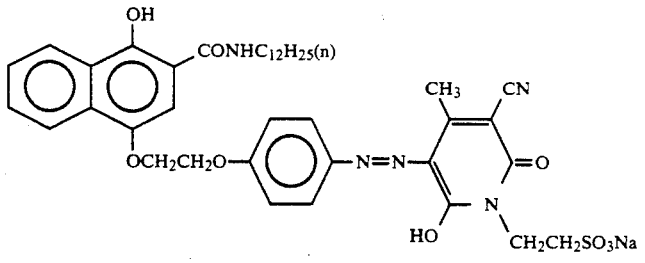
(YC-1)
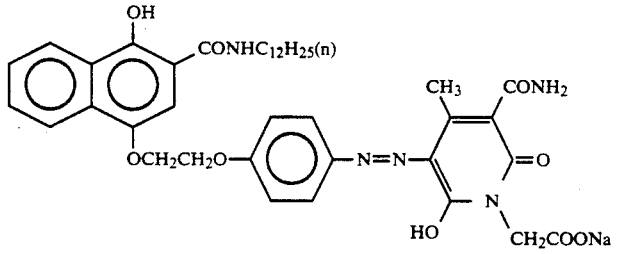
(YC-2)
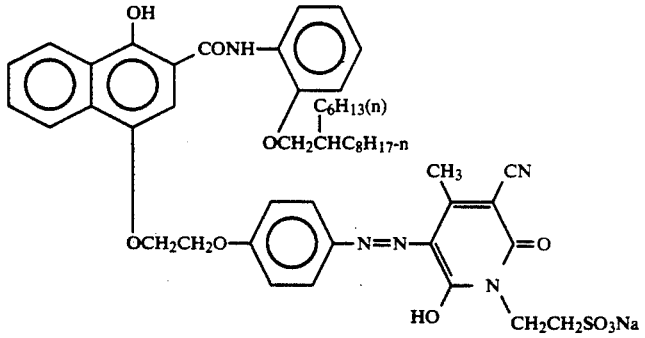
(YC-3)
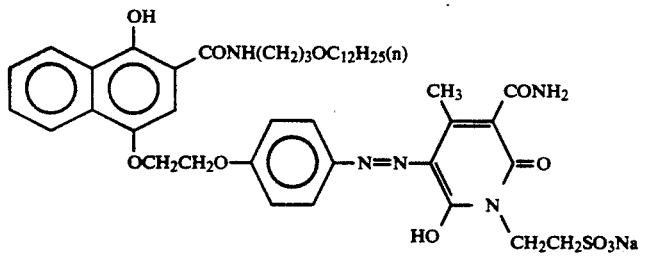
(YC-4)
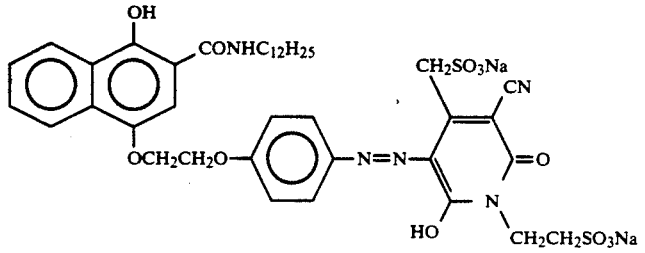
(YC-5)

-continued
(YC-6)
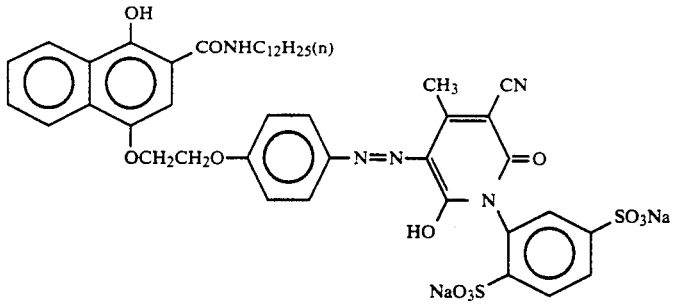
(YC-7)
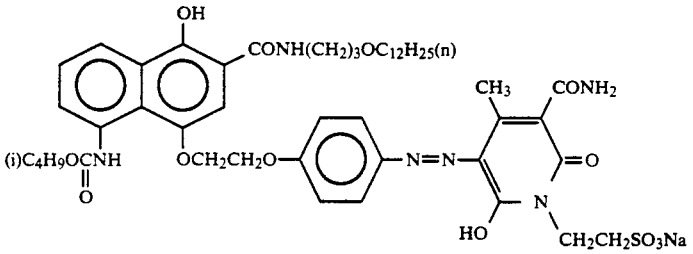
(YC-8)
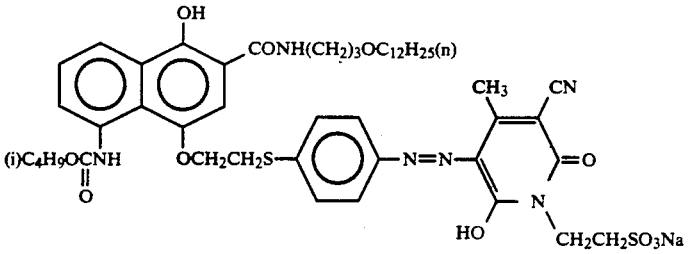
(YC-9)
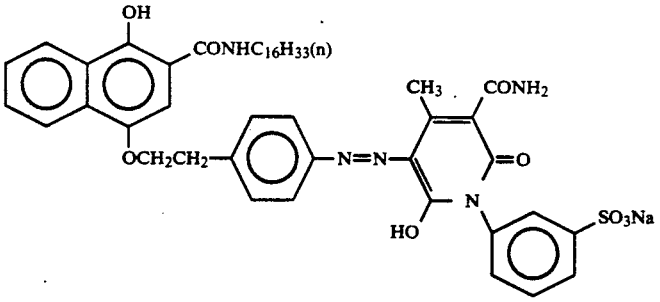
(YC-10)
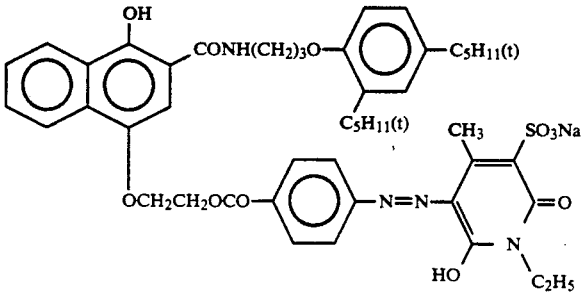

-continued
(YC-11)
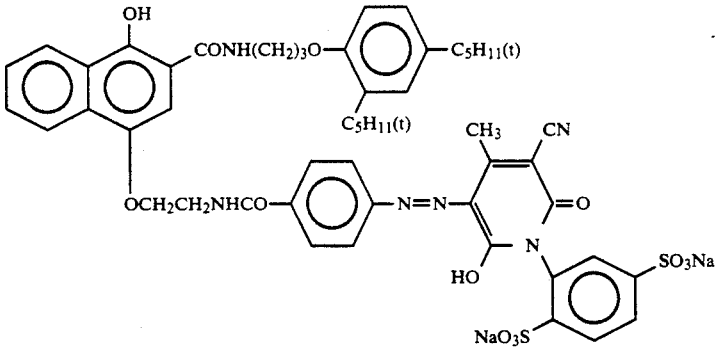
(YC-12)
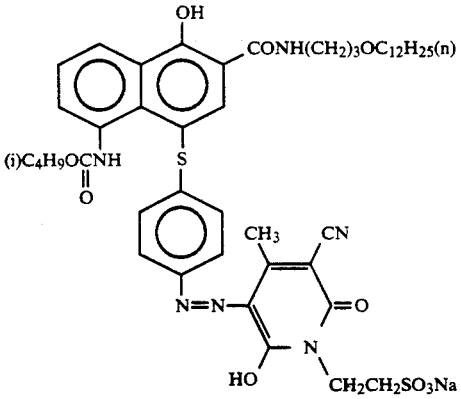
(YC-13)
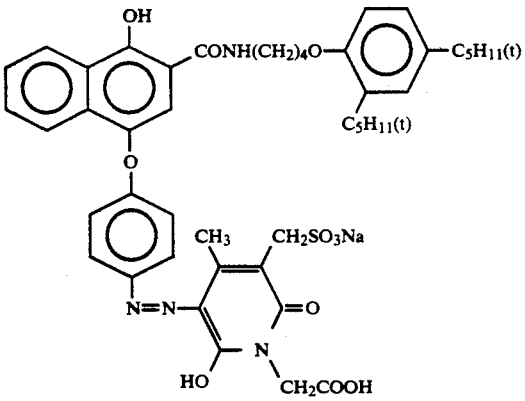
(YC-14)
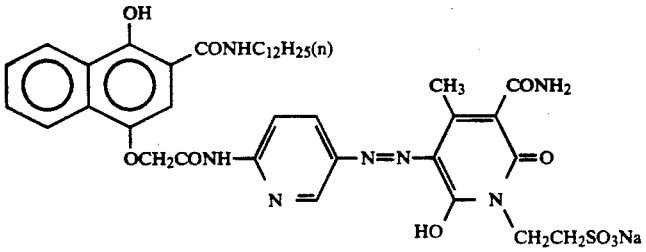
(YC-15)
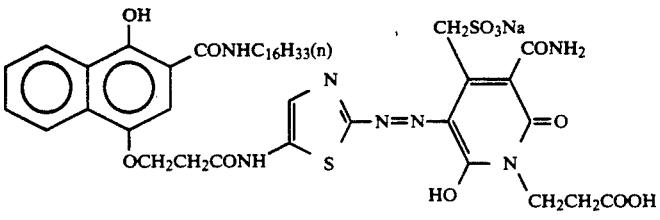

-continued
(YC-16)
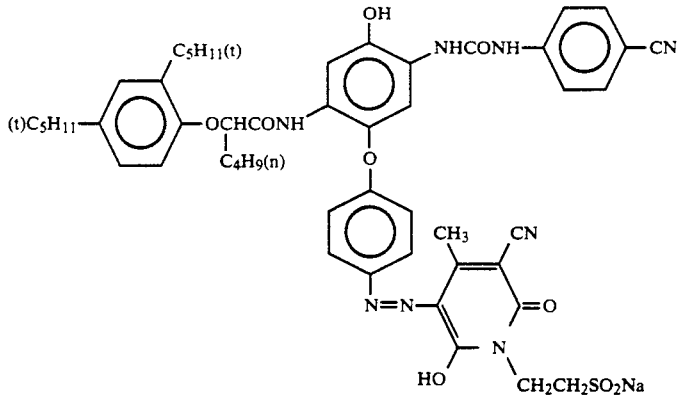
(YC-17)
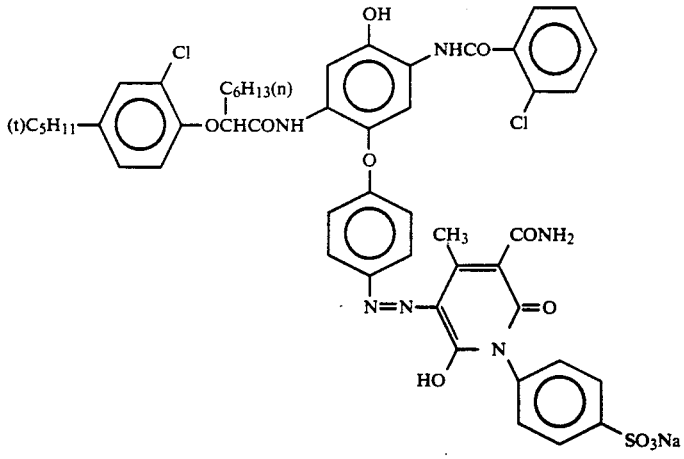
(YC-18)
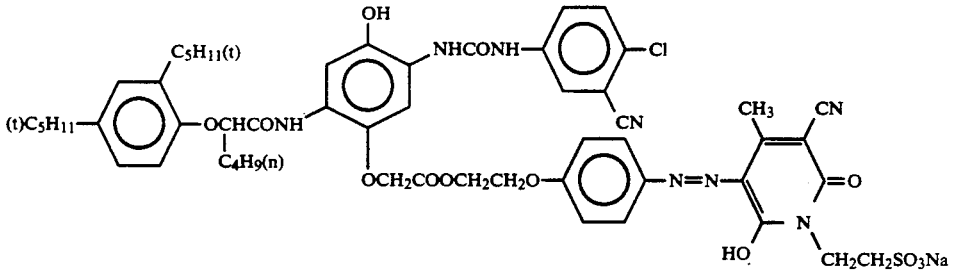
(YC-19)
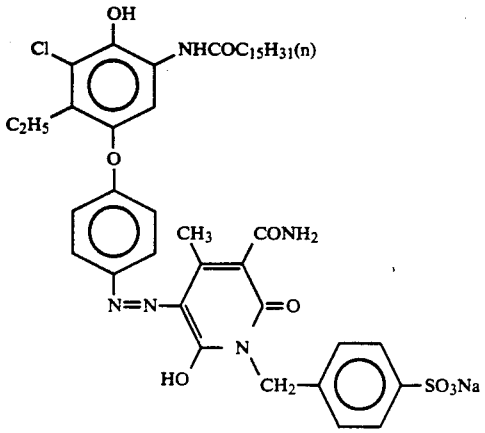

-continued
(YC-20)
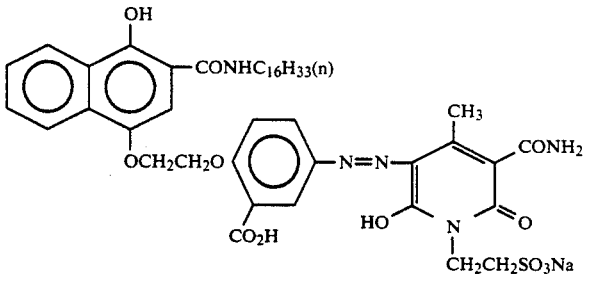
(YC-21)
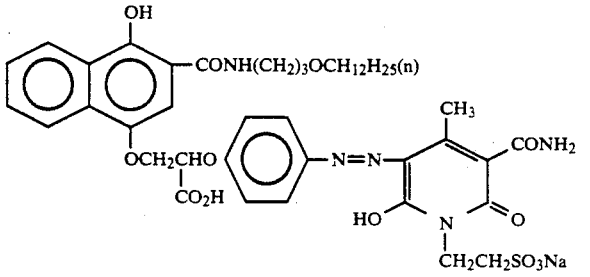
(YC-22)
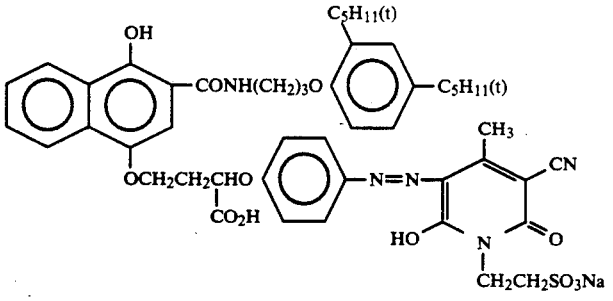
(YC-23)
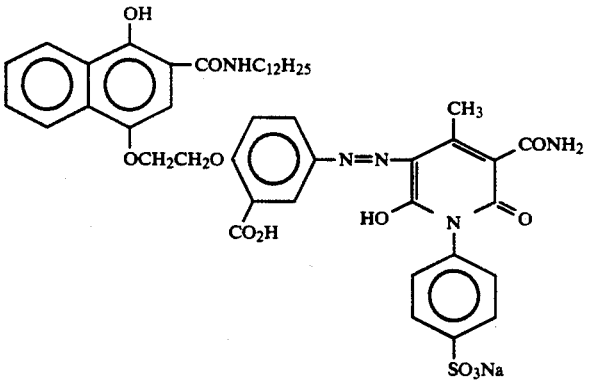
(YC-24)
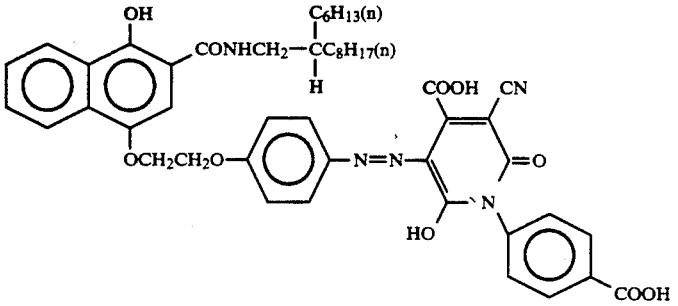

-continued
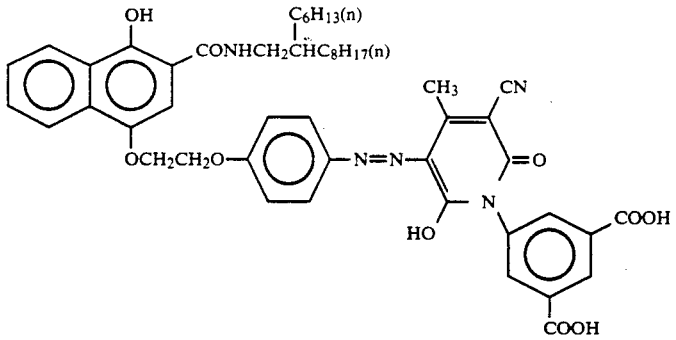
(YC-25)
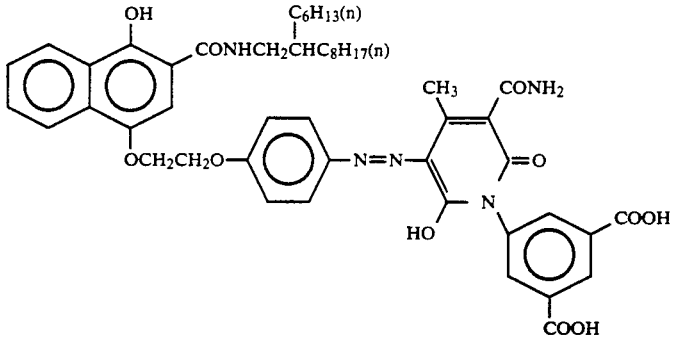
(YC-26)
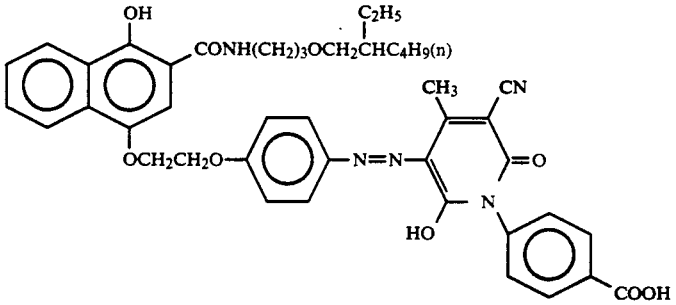
(YC-27)
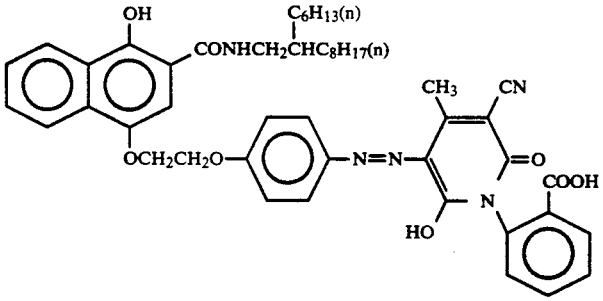
(YC-28)
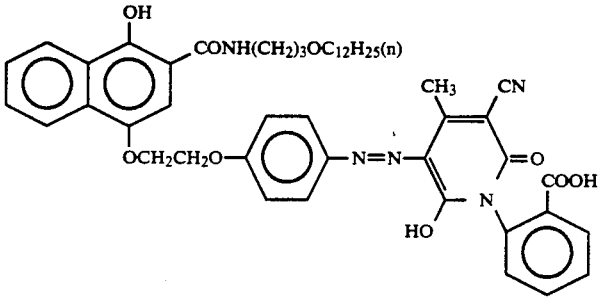
(YC-29)

-continued
(YC-30)
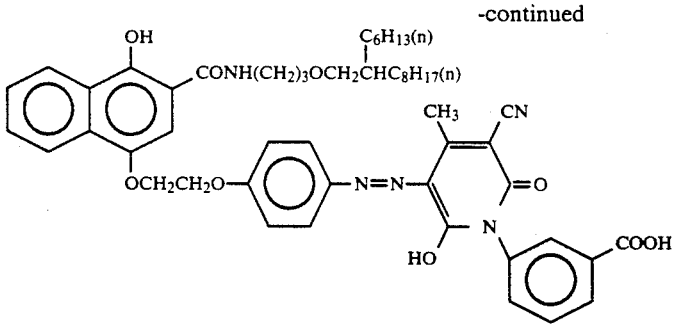
(YC-31)
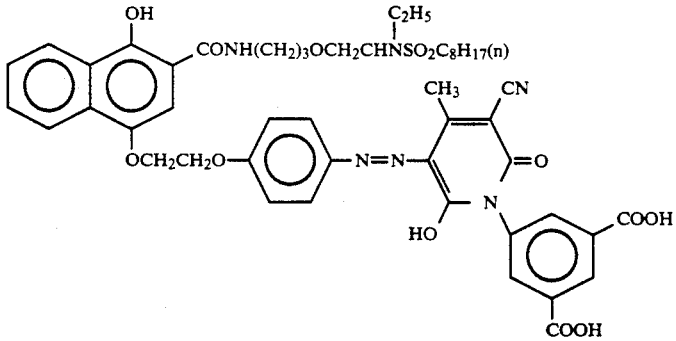
(YC-32)
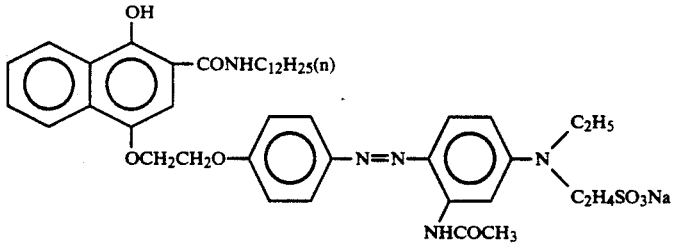
(YC-33)
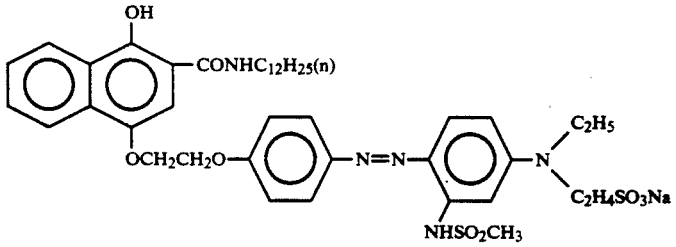
(YC-34)
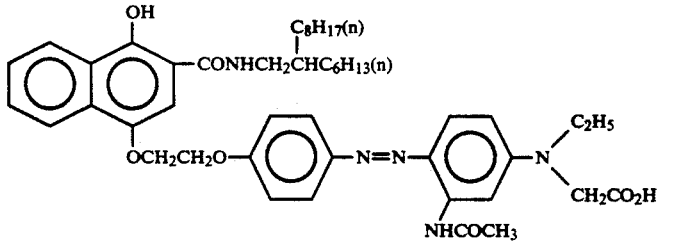
(YC-35)
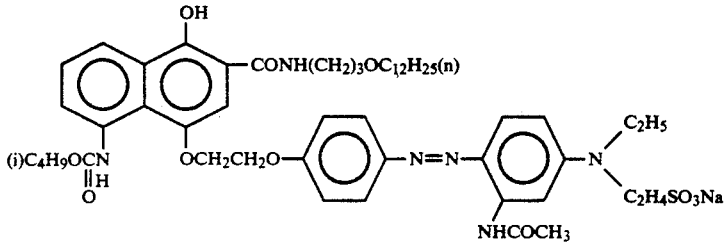

-continued
(YC-36)
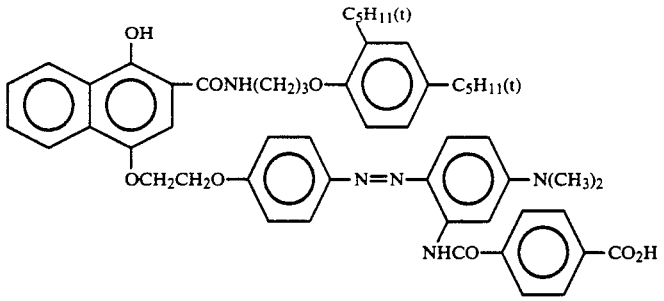
(YC-37)
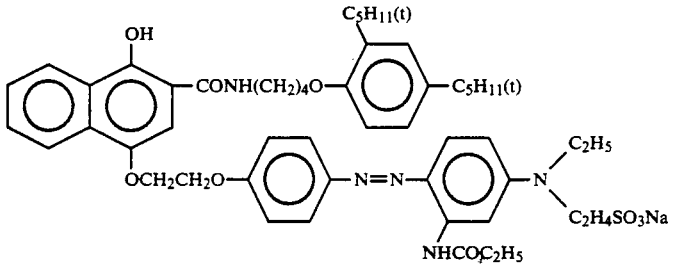
(YC-38)
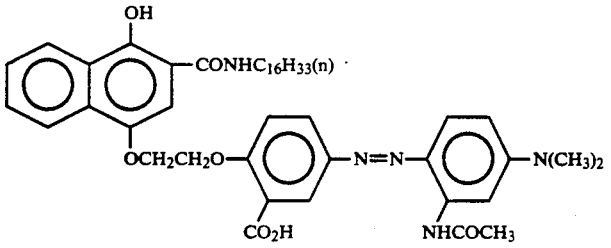
(YC-39)
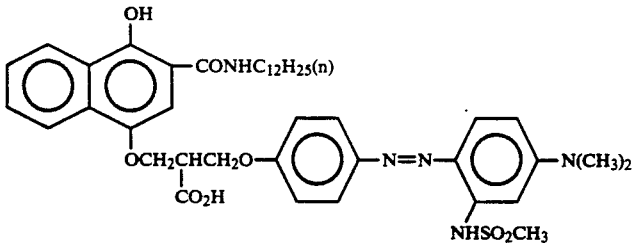
(YC-40)
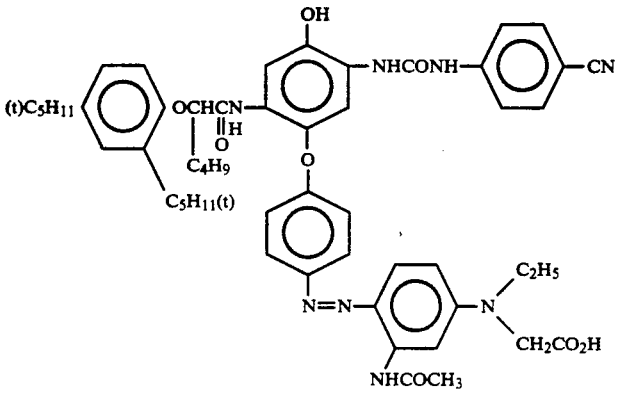

-continued
(YC-41)
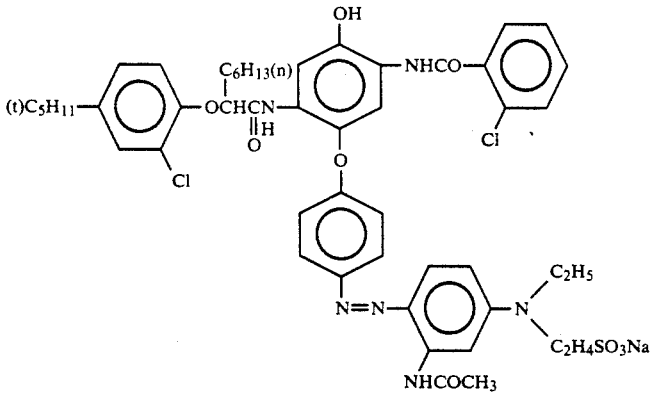
(YC-42)
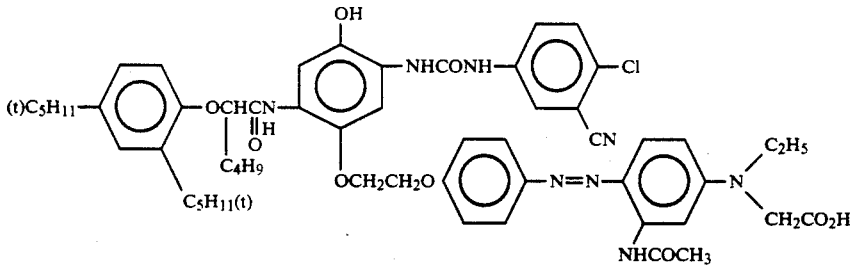
(YC-43)
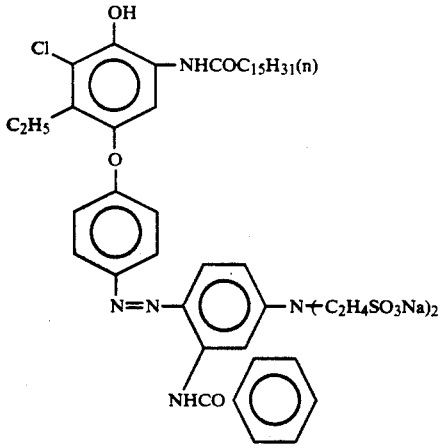
(YC-44)
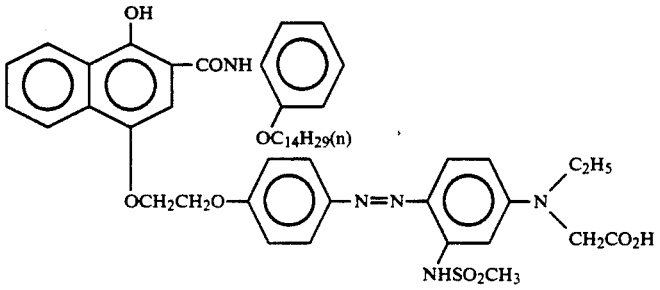

-continued
(YC-45)
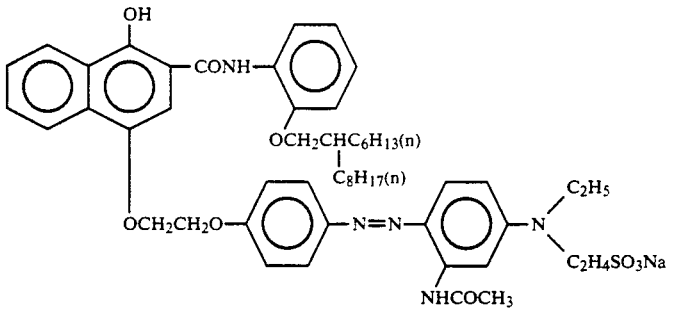
(YC-46)
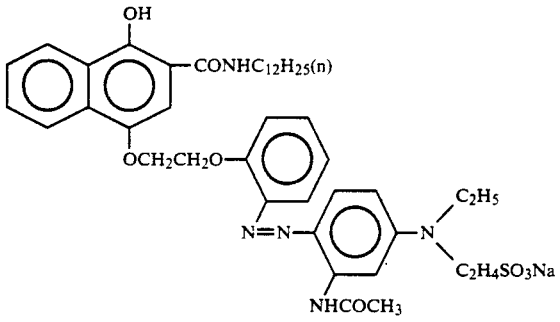
(YC-47)
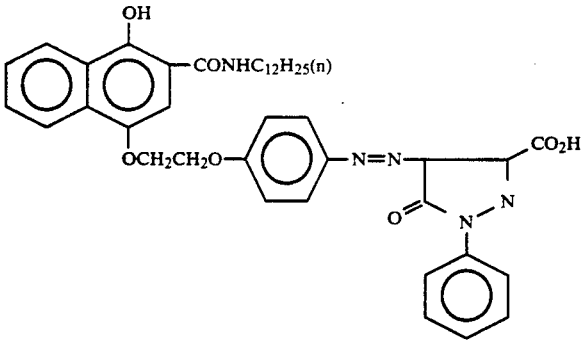
(YC-48)
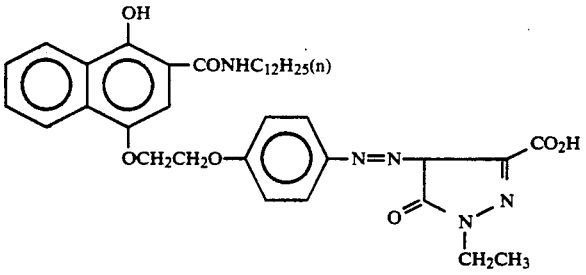
(YC-49)
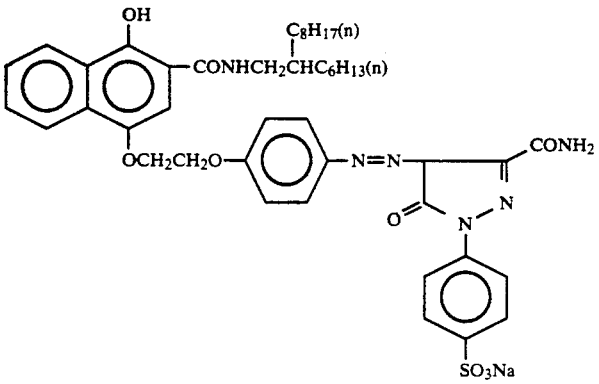

-continued
(YC-50)
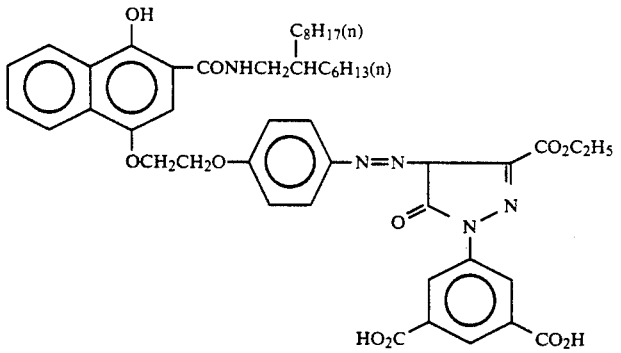
(YC-51)
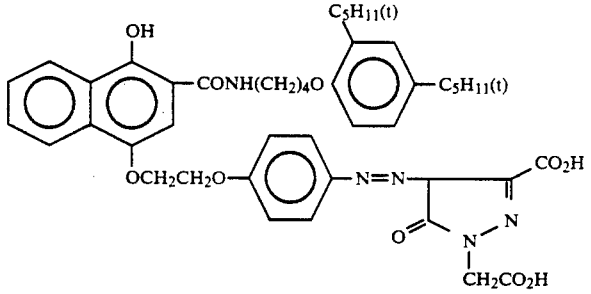
(YC-52)
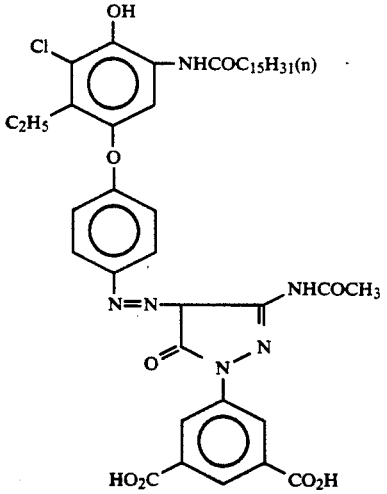
(YC-53)
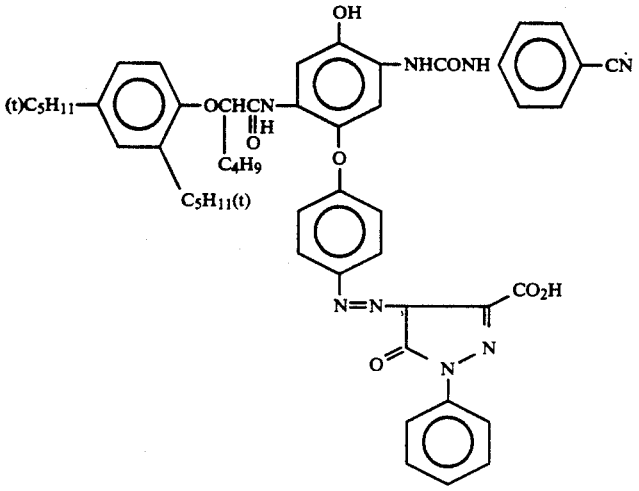

-continued (YC-54)

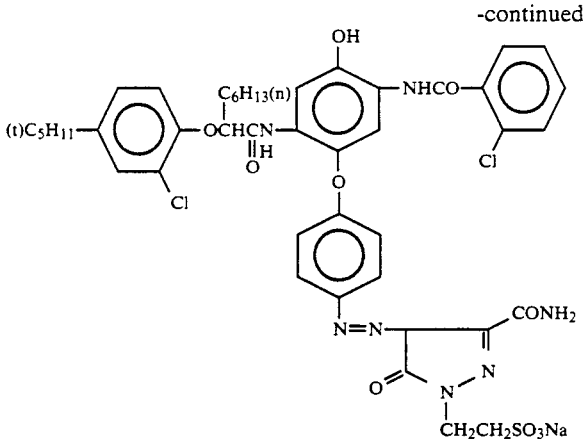

Yellow colored cyan couplers of the above mentioned formula (CI) which are used in the present invention are generally produced by a diazo-coupling reaction between a 6-hydroxy-2-pyridone compound and a coupler structure-containing aromatic or heterocyclic diazonium salt.

The 6-hydroxy-2-pyridones are produced by various known methods, for example, as described in Klingsberg, *Heterocyclic Compounds*—Pyridines and Derivatives—Part III (published by Interscience, 1962); *Journal of American Chemical Society*, 1943, Vol. 65, page 449; *Journal of the Chemical Technology & Biotechnology*, 1986, Vol. 36, page 410; Tetrahedron, 1966, Vol. 22, page 455; and JP-B-61-52827, West German Patents 2,162,612, 2,349,709 and 2,902,486, and U.S. Pat. No. 3,763,170. The diazonium salts are also produced by various known methods, for example, as described in U.S. Pat. Nos. 4,004,929 and 4,138,258 and JP-A-61-72244 and JP-A-61-273543. Diazo-coupling reactions between a 6-hydroxy-2-pyridone compound and a diazonium salt can be conducted in a solvent such as methanol, ethanol, methyl cellosolve, acetic acid, N,N-dimethylformamide, N,N-dimethylacetamide, tetrahydrofuran, dioxane or water, or a mixed solvent containing these compounds. In the reaction, a base is preferably used; for example, sodium acetate, potassium acetate, sodium carbonate, potassium carbonate, sodium hydrogencarbonate, sodium hydroxide, potassium hydroxide, pyridine, triethylamine, tetramethylurea or tetramethylguanidine.

The reaction temperature is generally −78° C. to 60° C., preferably −20° C. to 30° C.

Examples outlining the production of yellow colored cyan couplers which are used in the present invention include the following.

SYNTHESIS EXAMPLE 1

Synthesis of Yellow Colored Cyan Coupler (YC-1)

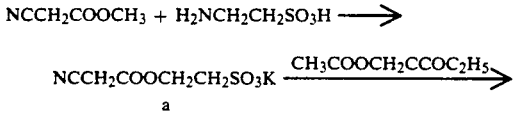

-continued

Synthesis of Yellow Colored Cyan Coupler (YC-1)

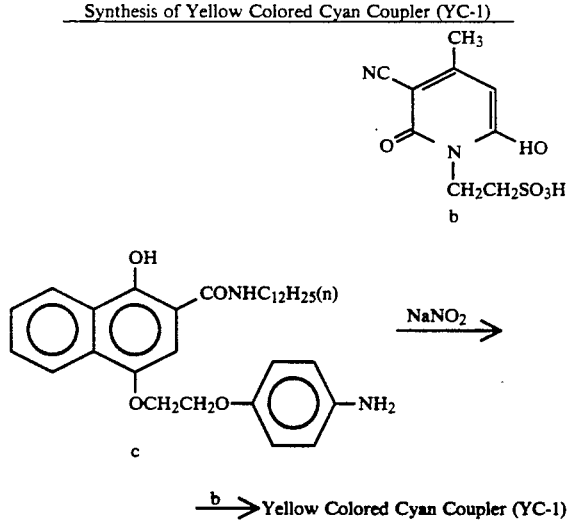

Synthesis of Compound (a):

125.2 g of taurine and 66 g of potassium hydroxide were added to 500 ml of methanol and stirred under heat, and 110 g of methyl cyanoacetate were added dropwise thereto over a period of about 1 hour. After the mixture was heated under reflux for 5 hours, it was allowed to stand overnight, whereupon the crystal which precipitated out was removed by filtration. It was washed with ethanol and dried to obtain 202.6 g of a crystal of Compound (a).

Synthesis of Compound (b):

11.5 g of Compound (a) and 3.5 g of potassium carbonate were added to 11.5 ml of water and stirred with heating on a steam bath, while 7.8 g of ethyl acetoacetate was dropwise added thereto. After addition, the mixture was stirred for further 7 hours. After cooling, 9.2 ml of concentrated hydrochloric acid were added to the reaction mixture, which was then stirred to give a crystal. The crystal thus formed was removed by filtration, washed with methanol and dried, to obtain 10.4 g of a crystal of Compound (b).

Synthesis of Yellow Colored Cyan Coupler (YC-1):

10.1 g of Compound (c) as synthesized by the method described in U.S. Pat. No. 4,138,258 was dissolved in 60 ml of N,N-dimethylformamide and 60 ml of methyl cellosolve, and 4.3 ml of concentrated hydrochloric acid was added thereto while cooling with ice. Then, 5 ml of an aqueous solution containing 1.84 g of sodium sulfite was added dropwise to the reaction mixture to form a diazonium solution. Next, 60 ml of methyl cellosolve and 20 ml of water were added to 7.8 g of Compound (b) and 8.2 g of sodium acetate, and the diazonium solution was dropwise added thereto while stirring and cooling with ice. After addition, the mixture was stirred for one more hour under the same condition and then for 2 hours at room temperature, whereupon the crystal which precipitated out was removed by filtration. This material was washed with water and dried, dispersed in 500 ml of water, heated under reflux for 1 hour, and then cooled. The crystal was then removed by filtration, washed with water and dried, to obtain 13.6 g of a red crystal of the intended yellow colored cyan coupler (YC-1). The compound had a melting point of 269° to 272° C. (decomposition), and the structure thereof was identified by 1HNMR spectrum, mass spectrum and elementary analysis. The compound had a maximum absorption wavelength in methanol of 457.7 nm and a molecular extinction coefficient of 41,300, and displayed a good spectral absorption characteristics as a yellow colored cyan coupler.

SYNTHESIS EXAMPLE 2

Synthesis of Yellow Colored Cyan Coupler (YC-3):

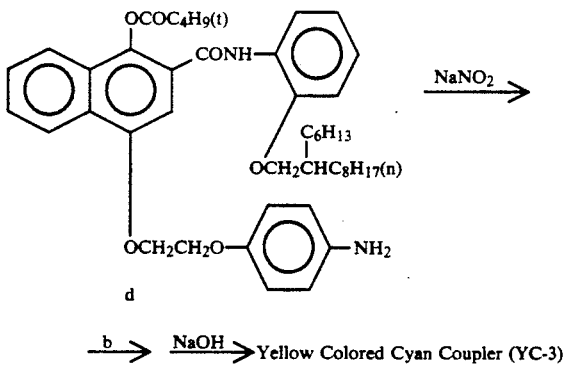

75 ml of N,N-dimethylformamide and 75 ml of methyl cellosolve were added to 19.2 g of Compound (d) as synthesized by the method described in JP-A-62-85242 and dissolved, and 5.6 ml of concentrated hydrochloric acid was added thereto while stirring and cooling with ice. Next, 5 ml of an aqueous solution containing 2.5 g of sodium sulfite was added dropwise thereto. 1 hour after addition, the mixture was stirred for further 1 hour at room temperature to prepare a diazonium solution.

75 ml of methyl cellosolve and 26 ml of water were added to 10.1 g of Compound (b) and 10.7 g of sodium acetate, and the diazonium solution was added dropwise thereto while stirring and cooling with ice. 1 hour after addition, the mixture was stirred for 2 additional hours at room temperature, whereupon the crystal which precipitated out was removed by filtration. Then, the crystal was dispersed in 200 ml of methanol, and 10 ml of an aqueous solution of 2.2 g of sodium hydroxide was added dropwise thereto and the mixture was then stirred for 3 hours. This solution was neutralized with concentrated hydrochloric acid, whereupon the crystal which precipitated out was removed by filtration, washed with water and then with methanol, and thereafter dried. The crude crystal thus obtained was purified with hot methanol in the same manner as in Synthesis Example 1, to obtain 14.8 g of the intended yellow colored cyan coupler (YC-3). The compound had a melting point of 246° to 251° C. (decomposition), and the structure thereof was identified by 1HNMR spectrum, mass spectrum and elementary analysis. The compound had a maximum absorption wavelength in methanol of 457.6 nm and a molecular extinction coefficient of 42,700. It displayed good spectral absorption characteristics as a yellow colored cyan coupler.

SYNTHESIS EXAMPLE 3

Synthesis of Yellow Colored Cyan Coupler (YC-28)

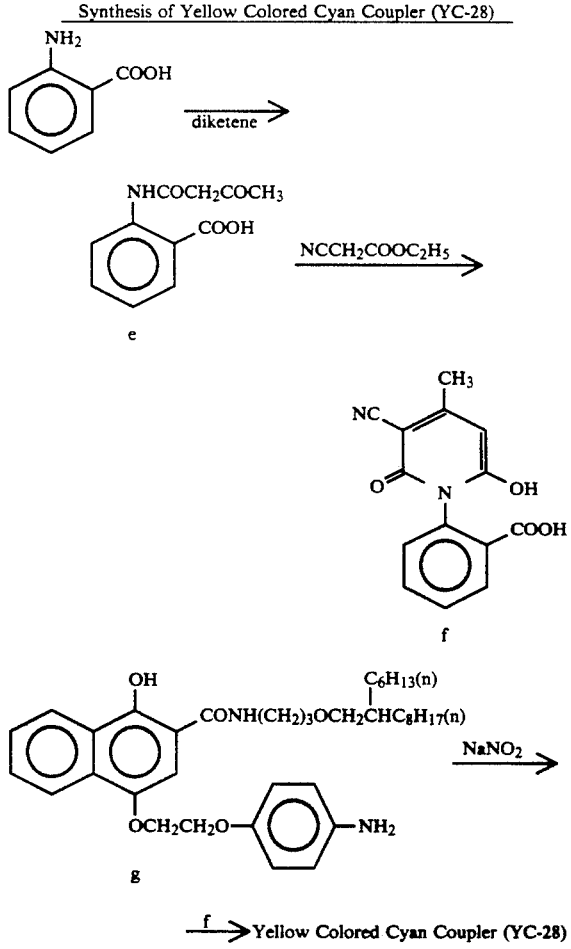

Synthesis of Compound (e):

137.1 g of anthranilic acid was added to 600 ml of acetonitrile and stirred under heat, and 92.5 g of diketene were added dropwise thereto over a period of about 1 hour. After the mixture was heated under reflux for 1 hour, it was cooled to room temperature, whereupon the crystal which precipitated out was removed by filtration. This crystal was washed with acetonitrile and dried ot obtain 200.5 g of a crystal of Compound (e).

Synthesis of Compound (f):

199.1 g of Compound (e), 89.2 g of ethyl cyanoacetate and 344 g of 28% sodium methoxide were added to 0.9 liter of methanol and reacted for 8 hours at 120° C. in an autoclave. After the reaction mixture was allowed to stand overnight, it was concentrated under reduced pressure. 700 ml of water was added to the resulting mixture, which was then acidified with 230 ml of concentrated hydrochloric acid. The crystal thus precipitated out was removed by filtration, and the crude crystal obtained was washed with a hot mixed solvent of ethyl acetate and acetonitrle, to obtain 152 g of Compound (f). Synthesis of Yellow Colored Cyan Coupler (YC-28):

13.0 g of Compound (g) as synthesized in accordance with the method described in U.S. Pat. No. 4,138,258 was dissolved in 40 ml of N,N-dimethylformamide, and 4.5 ml of concentrated hydrochloric acid was added thereto while cooling with ice. Next, 5 ml of an aqueous solution of 1.48 g of sodium sulfite was added dropwise to prepare a diazonium solution. Next, 20 ml of N,N-dimethylformamide and 15 ml of water were added to 6.0 g of Compound (f) and 8 g of sodium acetate, and the diazonium solution was added dropwise thereto while stirring and cooling with ice. After addition, the solution was stirred for an additional 30 minutes at room temperature. This solution was acidified with hydrochloric acid and then a solid was extracted with ethyl acetate. The resulting extract was washed with water and concentrated under reduced pressure. The resulting concentrate was recrystallized with a mixed solvent of ethyl acetate and methanol, to obtain 13 g of a yellow crystal of the intended yellow colored cyan coupler (YC-28). This had a melting point of 154° to 156° C. The structure of the compound was identified by 1HNMR spectrum, mass spectrum and elementary analysis. The compound had a maximum absorption wavelength in methaol of 458.2 nm and a molecular extinction coefficient of 42,800. It displayed good spectral absorption characteristics as a yellow colored cyan coupler.

Yellow colored cyan couplers of the above mentioned formulae (CII) to (CIV) for use in the present invention can be synthesized by various other known methods, for example, as described in JP-B-58-6939 and JP-B-1-197563, or in accordance with the methods outlined above for synthesis of couplers of formula (CI).

In the present invention, yellow colored cyan couplers of formulae (CI) and (CII) are preferably employed; and those of formula (CI) are especially preferably employed.

In accordance with the present invention, the above mentioned yellow colored cyan coupler is preferably added to the light-sensitive silver halide emulsion layer or the adjacent layer in the photographic material to be processed. Especially preferably, the coupler is added to a red-sensitive emulsion layer in the material. The total amount of the coupler to be added to the photographic material is from 0.005 to 0.30 g/m$^2$, preferably from 0.02 to 0.20 g/m$^2$, more preferably from 0.03 to 0.15 g/m$^2$.

The yellow colored cyan coupler may be added to the photographic material of the present invention in the same manner as that used for other couplers. This process will be discussed below in detail.

The photographic material of the present invention preferably contains compound(s) represented by formulae (I) and/or (II) or salt(s) thereof, to improve a shelf life (i.e., storage stability).

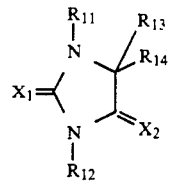
(I)

In compound (I): $X_1$ and $X_2$ each represent an oxygen atom or =NH; $R_{11}$ and $R_{12}$ each represents a hydrogen atom, an acyl group or an optionally substituted hydrocarbon residue; $R_{13}$ and $R_{14}$ each represent a hydrogen atom, a hydroxyl group, an optionally substituted amino group, an optionally substituted hydrocarbon residue, or —OR (in which R represents an optionally substituted hydrocarbon residue); and $R_{13}$ and $R_{14}$ may be bonded to each other to form a 5-membered or 6-membered saturated carbon ring nucleus. $R_{11}$ and $R_{12}$ must not be a hydroxylated methyl group. When both $X_1$ and $X_2$ are oxygen atoms and both $R_{13}$ and $R_{14}$ are groups other than an optionally substituted amino group, or $R_{13}$ and $R_{14}$ are bonded to each other to form a 5-membered or 6-membered saturated carbon ring nucleus, at least one of $R_{11}$ and $R_{12}$ is a hydrogen atom.

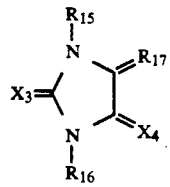
(II)

In compound (II): $X_3$ and $X_4$ each represent an oxygen atom acyl group or an optionally substituted hydrocarbon residue; and $R_{17}$ represents an optionally substituted imino group, or an optionally substituted hydrocarbon resdiue. $R_{15}$ and $R_{16}$ must not be hydroxylated methyl groups, and when both $X_3$ and $X_4$ are oxygen atoms and $R_{17}$ is an optionally substituted hydrocarbon residue, at least one of $R_{15}$ and $R_{16}$ is a hydrogen atom.

Specific examples of compounds of formulae (I) and (II) are listed below.

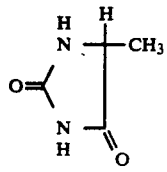
(S-1)

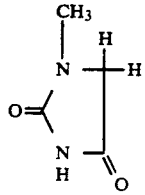
(S-2)

-continued
(S-3)
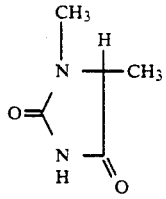
(S-4)
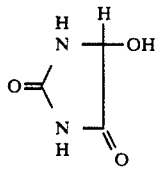
(S-5)
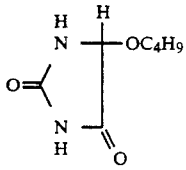
(S-6)
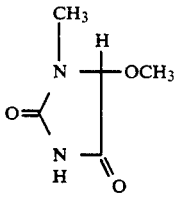
(S-7)
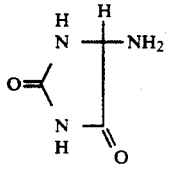
(S-8)
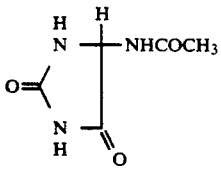
(S-9)
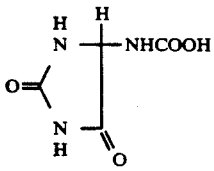
(S-10)
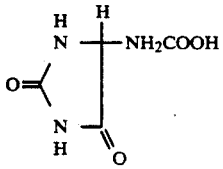
(S-11)
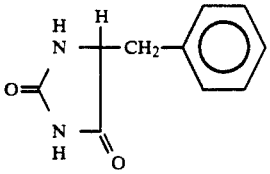
-continued
(S-12)
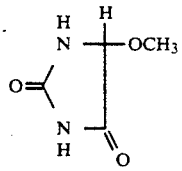
(S-13)
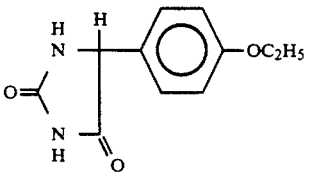
(S-14)
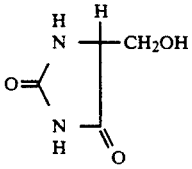
(S-15)
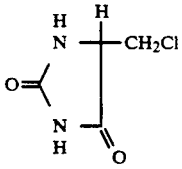
(S-16)
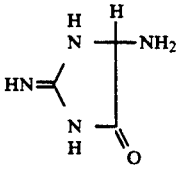
(S-17)
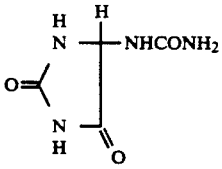
(S-18)
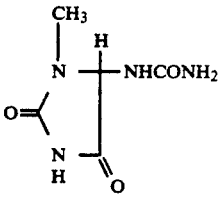
(S-19)
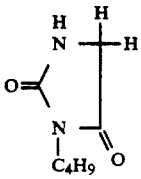
(S-20)
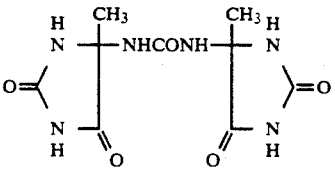

-continued
(S-21)
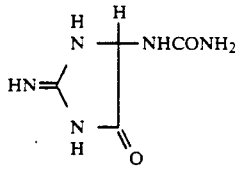
(S-22)
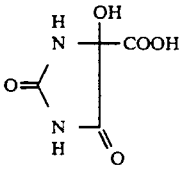
(S-23)
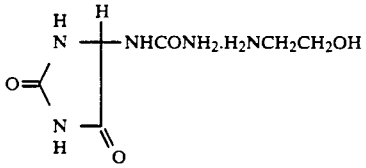
(S-24)
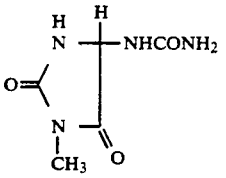
(S-25)
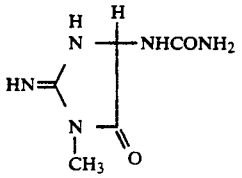
(S-26)
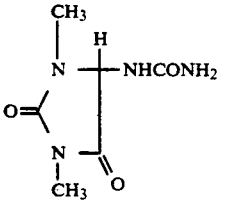
(S-27)
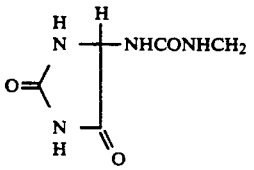
(S-28)
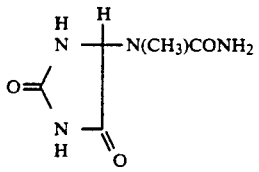
-continued
(S-29)
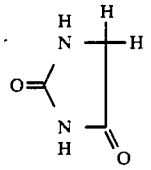
(S-30)
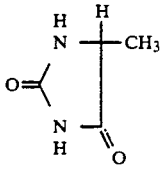
(S-31)
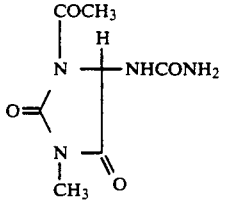
(S-32)
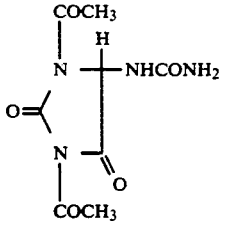
(S-33)
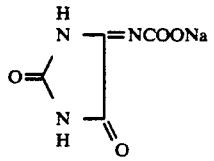
(S-34)
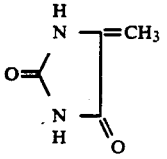
(S-35)
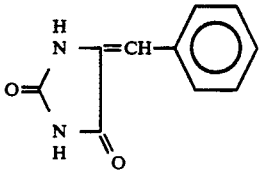
(S-36)
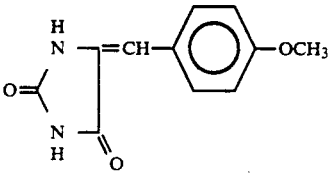

-continued (S-37)

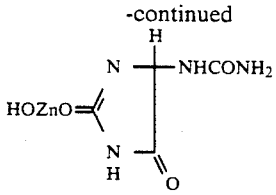

(S-38)

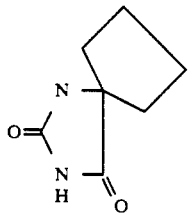

(S-39)

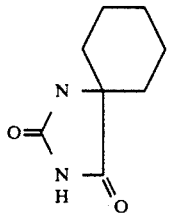

(S-40)

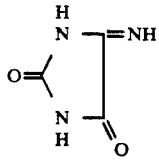

(S-41)

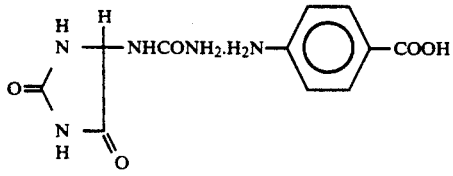

(S-42)

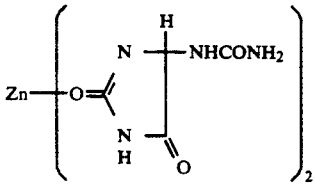

(S-43)

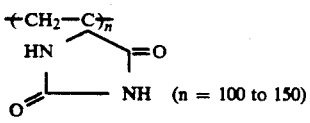

The above compound represented by formula (I) and/or (II) or a salt thereof is added to the photographic material in a total amount of preferably from 0.01 to 1.0 g/m$^2$ and more preferably from 0.1 to 0.5 g/m$^2$.

These antifading compounds can be produced in accordance with known methods, for example, as described in *Bulletin of the Chemical Society of Japan,* Vol. 39, pages 1559 to 1567 and pages 1734 to 1738 (1966); and *Chemische Berichte,* Vol. 54B, pages 1802 to 1833 and pages 2441 to 2479 (1921).

One or more of these compounds can be added to any layer of the photographic material to be processed using the present invention. Preferably, it is added to auxiliary layers other than light-sensitive emulsion layers, such as the interlayer, filter layer, protective layer or antihalation layer.

The method of the present invention for rapid processing of photographic materials will be set forth below.

When a photographic material containing a yellow colored cyan coupler is processed by conventional photographic processing methods utilizing a total processing time of 8 minutes or less, it has been found that a sufficient masking effect cannot be obtained; and the cyan colored area has an unnecessary yellow absorption which to worsens the color reproducibility of the material.

The phenomenon is to be even more remarkable when the processing time is shortened. Therefore, it is assumed that the phenomenon occurs because the releasing group of the yellow colored cyan coupler is not washed off, and remains in the processed photographic material; or, the group could not be released satisfactorily because of some other reason. However, the details have not been clarified at the present time.

In accordance with the present invention, the total processing time is recited as 8 minutes or less; and, the photographic material is processed with a bleaching solution containing an oxidizing agent having a redox potential of 150 mV or more. When processed according to the above method (i.e., use of the processing time and the bleaching solution of the present invention) of the present invention, the resistance to light fading of the photographic material is satisfactorily improved, especially the light fading resistance of the yellow density. This improvement in light fading resistance exhibited by the yellow density is remarkable, especially in nonexposed areas.

In the processing method of the present invention, the total processing time is 8 minutes or less, especially preferably 6 minutes or less, more preferably 4 minutes or less. In the last case, the effect of the present invention is especially remarkable. The total processing time as referred to herein indicates the period of from the time at which the photographic material to be processed is first brought into contact with the first processing solution to the time when the processed photographic material has left the last processing tank.

In accordance with the method of the present invention for processing a silver halide color photographic material (hereinafter referred to as a "photographic material"), a photographic material is imagewise exposed, then color developed, and thereafter desilvered.

In the last desilvering step, a bleaching solution, a fixing solution and/or a combined bleach-fixing solution may be used. Typical examples of the desilvering step to be effected by the use of such processing solutions are as follows:

(1) Bleaching→Fixing
(2) Bleaching→Bleach-Fixing
(3) Bleaching→Water Washing→Fixing
(4) Rinsing→Bleaching→Fixing
(5) Bleaching→Bleach-Fixing→Fixing
(6) Water-washing→Bleach-Fixing
(7) Bleach-Fixing
(8) Fixing→Bleach-Fixing Of the above mentioned processes, (1), (2) and (5) are especially preferred. The process (2) is illustrated, for example, in JP-A-61-75352.

In the arrangement of the tanks of the processing baths, such as the bleaching bath and fixing bath, to be used in the above mentioned processes, one bath may be composed of one or more tanks (for example, 2 to 4 tanks). In the latter case, having plural tanks for one processing bath, a countercurrent system is preferably employed.

In the method of the present invention, the processing solution having a bleaching ability contains an oxidizing agent having a redox potential of 150 mV or more (hereinafter referred to as a "high potential oxidizing agent"); this processing solution may be a bleaching solution or a bleach-fixing solution.

In the method of the present invention, it is preferable that the color-developed photographic material be directly desilvered using the processing solution with a bleaching ability. In the preferred case, the processing solution with bleaching ability contains a high potential oxidizing agent and the solution is preferably a bleaching solution. In such a case, the effect of the present invention is remarkable.

The oxidizing agent to be incorporated into the processing solution with bleaching ability of the present invention has a redox potential of 150 mV or more, preferably 180 mV or more, more preferably 200 mV or more.

The redox potential of the oxidizing agent is measured by the method described in *Transactions of the Faraday Society,* Vol. 55 (1959), pages 1312 to 1313.

The redox potential of the oxidizing agent which is used in the present invention is measured by the above method at a pH of 6.0. The reason why the potential as obtained under the condition of pH of being 6.0 is employed for defining the oxidizing agent to be used in the present invention is as follows. After the photographic material to be processed by the method of the present invention has been color-developed and then introduced into the processing solution with bleaching ability, the pH value of the film of the photographic material is lowered. In such cases, when the pH of the film is rapidly lowered, the bleaching fog of the material is minimal. On the other hand, if the pH value is lowered slowly or the pH of the processing solution with bleaching ability is high, the bleaching fog of the material is increased. Therefore, a pH of about 6.0 is the standard for generating the bleaching fog.

As mentioned above, an oxidizing agent having a redox potential of 150 mV or more is incorporated into the processing solution with bleaching ability in the method of the present invention. The processing solution will have sufficient oxidizing power because of the presence of such an oxidizing agent; therefore, the photographic material being processed may be bleached rapidly.

Examples of such an oxidizing agent include inorganic compounds such as red prussiate of potash, ferric chloride, bichromates, persulfates and bromates, as well as some organic compounds such as aminopolycarboxylato/iron(III) complexes (i.e., aminopolycarboxylic acid-ferric complexes).

In the present invention, aminopolycarboxylato/iron(III) complexes are preferably used. These compounds do not pollute the environment, are safe to handle, and do not corrode metals.

Specific examples of aminopolycarboxylato/iron(III) complexes usable in the present invention will be listed below; this list, however, is not intended to be limiting. The redox potential of each compound below is defined as above.

| Compound No. | Redox Potential (mV vs. NHE, pH = 6) |
|---|---|
| 1. N-(2-Acetamido)iminodiacetato/Fe(III) | 180 |
| 2. Methyliminodiacetato/Fe(III) | 200 |
| 3. Iminodiacetato/Fe(III) | 210 |
| 4. 1,4-Butylenediaminetetraacetato/Fe(III) | 230 |
| 5. Diethylene Thioether Diaminetetraacetato/Fe(III) | 230 |
| 6. Glycol Ether Diaminetetraacetato/Fe(III) | 240 |
| 7. 1,3-Propylenediaminetetraacetato/Fe(III) | 250 |

Of the above mentioned compounds, especially preferred is 1,3-propylenediaminetetraacetato/Fe(III) (Compound No. 7) (hereinafter referred to as "1,3-PDTA. Fe(III)"). This is the same compound as 1,3-diaminopropanetetraacetato/Fe(III) illustrated in JP-A-62-222252 and JP-A-64-24253.

The sodium, potassium or ammonium salts of aminopolycarboxylato/iron(III) complexes may be used. Ammonium salts of such complexes are preferred, since they have the highest bleaching ability.

Ethylenediaminetetraacetato/Fe(III) (EDTA.-Fe(III)), which is widely used in this technical field, has a redox potential of 110 mV; and diethylenetriaminepentaacetato/Fe(III) and trans-1,2-cyclohexanediaminetetraacetato/Fe(III), which are also widely used in this technical field, have a redox potential of 80 mV. Therefore, these are outside the scope of the oxidizing agent of the present invention.

In carrying out the method of the present invention, the amount of the oxidizing agent used in the processing solution with bleaching ability is preferably 0.17 mol or more per liter of the processing solution. It is more preferably 0.25 mol or more, especially preferably 0.30 mol or more, per liter of the processing solution, to ensure sufficient acceleration of processing and to prevent bleaching fog and stain. However, use of a processing solution containing too high a concentration of oxidizing agent would interfere with promotion of the bleaching reaction. Therefore, the uppermost limit of the oxidizing agent concentration in the processing solution should be about 0.7 mol per liter of the solution.

In the present invention, the oxidizing agent can be employed singly or in combination with two or more different oxidizing agents.

In the latter case of incorporating two or more different oxidizing agents into the processing solution, the above mentioned limitation applies only to the total concentration of all the oxidizing agents in the solution.

The processing solution with bleaching ability in the present invention may contain one or more oxidizing agents having a redox potential of less than 150 mV together with one or more oxidizing agents having a redox potential of 150 mV or more. However, the additional oxidizing agents having a redox potential of less than 150 mV are preferably present in a ratio of about 0.5 mol or less to 1 mol of the oxidizing agents having a redox potential of 150 mV or more.

Additional examples of the oxidizing agents include ferric complexes of ethylenediaminetetraacetate, diethylenetriaminepentaacetate and cyclohexanediaminetetraacetate, which may be employed together with oxidizing agents having a redox potential of 150 mV or more, especially with aminopolycarboxylato/Fe(III) complexes.

Where the processing solution with bleaching ability which is used in the present invention contains an aminopolycarboxylato/Fe(III) compound as an oxidizing agent, it may be added to the processing solution in the form of a complex. Alternatively, an aminopolycarboxylic acid of a complex-forming compound may be added to the processing solution together with a ferric salt (for example, ferric sulfate, ferric chloride, ferric nitrate, ammonium ferric sulfate or ferric phosphate), whereupon the intended complex is formed in situ in the processing solution.

In the latter case, where the complex is formed in situ in the processing solution, the amount of the aminopolycarboxylic acid added to the solution may be somewhat larger than the amount necessary for forming the intended ferric complex. Preferably, excess 0.01 to 10% aminopolycarboxylic acid is added.

The above processing solution with bleaching ability is used at a pH value of from 2 to 8. In order to accelerate rapid processing in the present invention, the pH value of the processing solution may be from 2.5 to 4.2, preferably from 2.5 to 4.0, especially preferably from 2.5 to 3.5. The preferred pH of the replenisher to the processing solution is generally from 1.0 to 4.0.

In carrying out the method of the present invention, various known acids may be added to the processing solution to reduce the pH of the solution to the above defined range.

Acids those having a pKa value of from 2 to 5.5 are preferred. The pKa referred to herein is the logarithmic value of the reciprocal of the acid dissociation constant, and it is obtained at an ion strength of 0.1 mol/liter at 25° C.

In the present invention, addition of an acid having a pKa value of from 2.0 to 5.5 to the processing solution with bleaching ability (used in the desilvering step), in an amount of 1.2 mol/liter or more is preferred. Using the processing solution prevents bleaching fog and stains in the non-colored area of the processed photographic material.

Aacids having a pKa value of from 2.0 to 5.5 useful for the above mentioned purpose include inorganic acids, such as phosphoric acid, as well as organic acids, such as acetic acid, malonic acid or citric acid. Organic acids having a pKa value of from 2.0 to 5.5 are more preferably used to attain the above mentioned effects. Organic acids, those having carboxyl group(s) are especially preferred.

Organic acids with a pKa value of from 2.0 to 5.5, preferably used in the present invention, may be either monobasic or polybasic. Polybasic acids may be in the form of their metal salts (for example, sodium or potassium salt) or ammonium salts, provided that the salts have a pKa value which falls within the above defined pKa range of from 2.0 to 5.5. Two or more organic acids having a pKa value of from 2.0 to 5.5 may be used in combination. The acids do not include aminopolycarboxylic acids and Fe complex salts thereof.

Preferred examples of organic acids with a pKa value of from 2.0 to 5.5, which are used in the present invention, include aliphatic monobasic acids, such as formic acid, acetic acid, monochloroacetic acid, monobromoacetic acid, glycolic acid, propionic acid, monochloropropionic acid, lactic acid, pyruvic acid, acrylic acid, butyric acid, isobutyric acid, pivalic acid, aminobutyric acid, valeric acid and isovaleric acid; amino acid compounds such as asparagine, alanine, arginine, ethionine, glycine, glutamine, cysteine, serine, methionine and leucine; aromatic monobasic acids such as benzoic acid, mono-substituted benzoic acids (e.g., chloro- or hydroxy-substituted benzoic acid) and nicotinic acid; aliphatic dibasic acids such as oxalic acid, malonic acid, succinic acid, tartaric acid, malic acid, maleic acid, fumaric acid, oxaloacetic acid, glutaric acid and adipic acid; dibasic amino acids such as aspartic acid, glutamic acid, glutaric acid, cystine and ascorbic acid; aromatic dibasic acids such as phthalic acid and terephthalic acid; and polybasic acids such as citric acid.

Of the above mentioned organic acids, preferred are monobasic acids having a carboxyl group. Acetic acid and glycolic acid are especially preferred.

The total amount of acid used in the present invention is 0.5 mol or more per liter of the processing solution with bleaching ability. Preferably, the amount of acid is from 1.2 to 2.5 mol/liter, more preferably from 1.5 to 2.0 mol/liter.

In adjusting the pH value of the processing solution with bleaching ability to fall within the above defined range, alkali agents (for example, aqueous ammonia, KOH, NaOH, imidazole, monoethanolamine, diethanolamine) may be used along with the above mentioned acids. Above all, use of aqueous ammonia is preferred. As an alkali agent which is used as a bleaching starter in preparing a mother liquor of the processing solution having bleaching ability from the replenisher thereto, imidaazole, monoethanolamine or diethanolamine is preferred.

In carrying out the method of the present invention, addition of various bleaching accelerators to the processing solution with bleaching ability or the prebath is preferred. Examples of usable bleaching accelerators include compounds with mercapto group- or disulfido groups described in U.S. Pat. No. 3,893,858, German Patent 1,290,821, British Patent 1,138,842, JP-A-53-95630 and Research Disclosure, No. 17129 (July, 1978); thiazolidine derivatives described in JP-A-50-140129; thiourea derivatives described in U.S. Pat. No. 3,706,561; iodides described in JP-A-58-16235; polyethyelen oxides described in German Patent 2,748,430; and polyamine compounds described in JP-B-45-8836. Esepcially preferred are mercapto compounds described in British Patent 1,138,842.

The processing solution with bleaching ability to be used in carrying out the method of the present invention may contain a rehalogenating agent, for example, bromides such as potassium bromide, sodium bromide or ammonium bromide, or chlorides such as potassium chloride, sodium chloride or ammonium chloride, in addition to the oxidizing agent (bleaching agent) and the above mentioned various compounds. The amount of rehalogenating agent in the processing solution may be from 0.1 to 5 mols, preferably from 0.5 to 3 mols, per liter of the processing solution.

In addition, the processing solution preferably should contain ammonium nitrate as a metal corrosion inhibitor.

The method of the present invention also preferably employs a replenishment system. For instance, the amount of the replenisher in the bleaching solution may be 200 ml or less, preferably from 140 to 10 ml, per $m^2$ of the photographic material being processed.

The bleaching time may be 120 seconds or less, preferably 50 seconds or less, more preferably 40 seconds or less. The present invention is especially effective to the case in such a shortened processing time.

In carrying out the method of the present invention, it is preferred that the processing solution with bleaching ability, which contains an aminopolycarboxylato/-Fe(III) complex, is aerated, so the aminopolycarboxylato/Fe(II) complex formed during the procedure is oxidized. The oxidizing agent is regenerated and the photographic property of the processed material remains extremely stable.

In the bleaching step of the method of the present invention, evaporation compensation may be used to supply water to the bleaching bath in an amount corresponding to the evaporated portion of the processing solution.

In the desilvering step of the method of the preferred embodiment of the present invention, the photographic material having been bleached with the processing solution with bleaching ability is then processed with a processing solution having a fixing ability. The bleaching is carried out with a bleach-fixing solution, the fixing step may be omitted.

The processing solution with fixing ability to be used in the fixing step must be either a fixing solution or a bleach-fixing solution. Accordingly, the bleached photographic material is then subjected to bleach-fixing and/or fixing.

The bleach-fixing solution used in the present invention has a bleaching ability and contains a high potential oxidizing agent. This solution differs from conventional bleach-fixing solutions which do not contain such a high potential oxidizing agent.

The fixing processing solution applied to the photographic material with the processing solution having an oxidizing agent and bleaching ability in accordance with the method of the present invention also contains a fixing agent. Compounds useful as a fixing agent include thiosulfates, such as sodium thiosulfate, ammonium thiosulfate, sodium ammonium thiosulfate or potassium thiosulfate, as well as thiocyanates (rhodanides) such as sodium thiocyanate or ammonium thiocyanate, and thioureas and thioethers. Above all, ammonium thiosulfate is preferred. The amount of fixing agent may be from 0.3 to 3 mols, preferably from 0.5 to 2 mols, per liter of the fixing solution or bleach-fixing solution.

For acceleration of fixing the above mentioned ammonium thiocyanate (ammonium rhodanide), thiourea and thioether (e.g., 3,6-dithia-1,8-octanediol) are combined in one fixing or bleach-fixing solution. The amount of these compounds used is generally from about 0.01 to 0.1 mol per liter of fixing or bleach-fixing solution. If necessary, the concentration may be increased to be from 1 to 3 mols per liter of the solution to greatly accelerate the fixing effect.

As the fixing agent in the fixing solution or bleach-fixing solution to be used in the present invention, a combination of a thiosulfate and a thiocyanate is preferred. In such a combination, the amount of thiosulfate should be within the above mentioned range of from 0.3 to 3 mol/liter; and, that of the thiocyanate from 1 to 3 mol/-liter, preferably from 1 to 2.5 mol/liter.

In particular, a combination of ammonium thiosulfate and ammonium thiocyanate is preferred.

Other compounds which may be combined with thiosulfates (especially, ammonium thiosulfate) include thiourea and thioethers (e.g., 3,6-dithia-1,8-octanediol). The amount employed along with thiosulfates is generally from about 0.01 to 0.1 mol per liter of fixing solution or bleach-fixing solution. If desired, the amount may be from 1 to 3 mols per liter of the solution.

The fixing solution or bleach-fixing solution for use in the present invention may contain, as a preservative, sulfites (e.g., sodium sulfite, potassium sulfite, ammonium sulfite), hydroxylamine, hydrazine, and aldehyde-bisulfite adducts (e.g., acetaldehyde-sodium bisulfite adduct). Further, it may also contain various brightening agents, defoaming agents, surfactants as well as organic solvents such as polyvinyl pyrrolidone or methanol. As preservatives, the sulfinic acid compounds described in European Patent No. 294769 are preferred.

The bleach-fixing solution, which is used for processing the photographic material after treatment with the processing solution having bleaching ability and a high potential oxidizing agent, may contain any known oxidizing agent (bleaching agent). Preferably, it contains an aminopolycarboxylato/ferric complex.

In processing the photographic material with the bleach-fixing solution, it is preferred to supply water to the processing bath to replace the evaporated portion, along with replenishment of the processing solution to the bath, like the above mentioned bleach-fixing step.

In the bleach-fixing solution for use in the present invention, the amount of bleaching agent is from 0.01 to 0.5 mol, preferably from 0.015 to 0.3 mol, especially preferably from 0.02 to 0.2 mol, per liter of the solution.

In carrying out the method of the present invention, the bleach-fixing solution used at the start time (mother liquor) is prepared by dissolving the above mentioned components in water. Alternatively, a bleaching solution and a fixing solution are prepared separately beforehand and blended just before the start time. The preferred pH of the fixing solution is from 5 to 9, more preferably from 7 to 8. The preferred pH of the bleach-fixing solution is from 6 to 8.5, more preferably from 6.5 to 8.0.

Where a replenishment system is employed in carrying out the method of the present invention, the amount of the replenisher to the fixing solution or bleach-fixing solution is preferably from 300 to 3,000 ml, more preferably from 300 to 1,000 ml, per $m^2$ of the photographic material being processed.

In addition, the fixing solution or bleach-fixing solution preferably contains various aminopolycarboxylic acids and organic phosphonic acids to stabilize the solution.

The total processing time for the photographic material with the fixing solution in the method of the present invention is preferably from 0.5 to 2 minutes, especially preferably from 1 to 1.5 minutes.

When the total processing time in the desilvering step in the method of the present invention is preferably shorter, the effect of the present invention is more pronounced. Especially preferably, therefore, the processing time in the desilvering step is from 1 to 4 minutes, more preferably from 1 minute to 30 seconds to 3 minutes. The processing temperature in the desilvering step is from 25° to 50° C., preferably from 35° to 45° C. Where the method of the present invention is carried out at this preferred processing temperature, the desilvering rate is improved and generation of stains in the processed photographic material may effectively be prevented.

In the method of the present invention, the color developed photographic material may be processed in a stopping bath or a rinsing bath, prior to the above mentioned desilvering step.

In the desilvering step for bleaching, bleach-fixing or fixing in the processing method of the present invention, it is preferred that the photographic material be vigorously stirred to more effectively utilize the present invention.

Examples of stirring means for forcedly stirring the photographic material during the desilvering step include a method of running a jet stream of the processing solution to the emulsion-coated surface of the material, as described in JP-A-62-183460 and JP-A-62-183461; and a method of promoting the stirring effect by the use of a rotating means, as described in JP-A-62-183461. In addition, a method of moving the photographic material being processed in the processing bath while the emulsion-coated surface of the material is brought into contact with a wiper blade in the processing bath to create turbulence, the processing solution applied to the emulsion-coated surface of the material and promote stirring may be used. Also, a method of increasing the total circulating amount of the processing solution may be utilized. Such stirring means are effective with any of the bleaching solutions, bleach-fixing solutions or fixing solutions. Vigorous stirring of the processing solution promotes penetration of the bleaching agent and fixing agent into the emulsion layer of the photographic material being processed; and, as a result, increases the desilvering rate.

The above mentioned reinforced stirring means are more effective when a bleaching accelerator is incorporated into the processing solution. The stirring means greatly enhance the bleaching effect and, in addition, the effect of the bleaching accelerator on fixing is limited.

In carrying out the method of the present invention, an automatic developing machine is generally employed. The method may be carried out continuously using such a machine. The automatic developing machine used in the present invention preferably should include a photographic material-conveying means such as that described in JP-A-60-191257, JP-A-60-191258 and JP-A-60-191259. As is noted from the related disclosures of JP-A-60-191257, the conveying means noticeably reduces carry-over from the previous bath to the subsequent bath; and, therefore, it is extremely effective for preventing deterioration of the processing solution being used. The conveying means is thus especially effective for shortening the processing time in each processing step and for reducing the amount of replenisher in each processing bath.

The color developer used for carrying out the method of the present invention may contain any known aromatic primary amine color developing agent. Preferred examples of color developing agents usable in the present invention are p-phenylenediamine derivatives, and specific examples of such derivatives are listed below. However, this list is not intended to be limiting.

D- 1: N,N-Diethyl-p-phenylenediamine
D -2: 2-Amino-5-diethylaminotoluene
D -3: 2-Amino-5-(N-ethyl-N-laurylamino)toluene
D -4: 4-[N-Ethyl-N-(β-hydroxyethyl)amino]aniline
D -5: 2-Methyl-4-[N-ethyl-N-(β-hydroxyethyl-)amino]aniline
D -6: 4-Amino-3-methyl-N-ethyl-N-[β-(methanesulfonamido)ethyl]aniline
D -7: N-(2-Amino-5-diethylaminophenylethyl)methanesulfonamide
D -8: N,N-Dimethyl-p-phenylenediamin
D -9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Of the above mentioned p-phenylenediamine derivatives, Compound (D-5) is especially preferred.

These p-phenylenediamine derivatives may also be in the form of salts: such as sulfates, hydrochlorides, sulfites, and p-toluenesulfonates. The amount of the aromatic primary amine color developing agent in the color developer may be from about 0.1 g to about 20 g, preferably from about 0.5 g to about 10 g, per liter of developer.

The color developer may contain, if desired, a sulfite such as sodium sulfite, potassium sulfite, sodium bisulfite, potassium bisuflite, sodium metasulfite or potassium metasulfite, as well as a carbonyl-sulfite adduct, as a preservative.

The preferred amount of preservative in the color developer may be from 0.5 to 10 g, more preferably from 1 to 5 g, per liter of developer.

Compounds capable of preserving the above mentioned aromatic primary amine color developing agent include various hydroxylamines and hydroxamic acids described in JP-A-63-43138, hydrazines and hydrazides described in JP-A-63-146041, phenols described in JP-A-63-44657 and JP-A-63-58443, β-hydroxyketones and β-aminoketones described in JP-A-63-44656, and/or various saccharides described in JP-A-63-36244. Together with these preservative compounds, it is preferred that monoamines described in JP-A-63-4235, JP-A-63-24254, JP-A-63-21647, JP-A-63-146040, JP-A-63-27841 and JP-A-63-25654, diamines described in JP-A-63-30845, JP-A-63-14640 and JP-A-63-43139, polyamines described in JP-A-63-21647, JP-A-63-26655 and JP-A-63-44655, nitroxy radicals described in JP-A-63-53551, alcohols described in JP-A-63-43140 and JP-A-63-53540, oximes described in JP-A-63-56654, and tertiary amines described in JP-A-63-239447 be added to the color developer.

Other preservatives which may be added to the color developer for use in the present invention include various metal compounds described in-JP-A-57-44148 and JP-A-57-53749, salicylic acids described in JP-A-59-180588, alkanolamines described in JP-A-54-3582, polyethylene imines described in JP-A-56-94349, and aromatic polyhydroxy compounds described in U.S. Pat. No. 3,746,544. These may optionally be added to the color developer, if desired. Addition of aromatic polyhydroxy compounds is particularly preferred.

The color developer for use in the present invention preferably has a pH of from 9 to 12, more preferably from 9 to 11.0, and it may contain any other compounds which are known as components of a developer.

In order to maintain the above mentioned pH range, various buffers may be added to the developer.

Examples of buffers to be used for the purpose include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, this list is not intended to be limiting.

The amount of the buffer added to the color developer is preferably 0.1 mol/liter or more, most preferably from 0.1 to 0.4 mol/liter.

In addition, the color developer may contain various chelating agents to inhibit precipitation of calcium or magnesium in the developer, or for improving the stability of the developer.

Organic acid compounds such as aminopolycarboxylic acids, organic phosphonic acids and phosphonocarboxylic acids are preferred for use as chelating agents. Specific examples include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid. If desired, two or more of these chelating agents may be added to the color developer in combination. Sufficient chelating agent may be added to the color developer to sequester the metal ions in the color developer. Normally, approximately from 0.1 g/liter to 10 g/liter is required.

The color developer may optionally contain any development accelerator. However, it is preferred that the color developer for use in the present invention does not substantially contain benzyl alcohol from the viewpoints of prevention of environmental pollution, easiness of preparation of the developer and prevention of color stains in the processed photographic material. The wording "does not substantially contain benzyl alcohol" as referred to herein means that the content of benzyl alcohol, if any, in the color developer should be 2 ml or less per liter of developer. Most preferably, the color developer contains no benzyl alcohol.

Examples of other development accelerators which can be added to the color developer for use in the present invention include thioether compounds described in JP-B-37-16088, JP-B-37-5987, JP-B-38-7826, JP-B-44-12380, JP-B-45-9019, and U.S. Pat. No. 3,818,247; p-phenylenediamine compounds described in JP-A-52-49829 and JP-A-50-15554; quaternary ammonium salts described in JP-A-50-137726, JP-B-44-30074, and JP-A-56-156826 and JP-A-52-43429; amine compounds described in U.S. Pat. Nos. 2,494,903, 3,128,182, 4,230,796, 3,253,919, JP-B-41-11431, and U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883, and U.S. Pat. No. 3,532,501; as well as 1-phenyl-3-pyrazolidones and imidazoles.

The color developer for use in the present invention may further contain an antifoggant, if desired. For instance, alkali metal halides, such as sodium chloride, potassium bromide or potassium iodide; as well as organic antifoggants, can be added to the color developer. Examples of usable organic antifoggants include nitrogen-containing heterocyclic compounds, such as benzotriazole, 6-nitrobenzimidazole, 5-nitroisoindazole, 5-methylbenzotriazole, 5-nitrobenzotirazole, 5-chlorobenzotriazole, 2-thiazolylbenzimidazole, 2-thiazolylmethylbenzimidazole, indazole, hydroxyazaindolidine, and adenine.

The color developer for use in the present invention may also contain a brightening agent; preferred are 4,4'-diamino-2,2'-disulfostilbene compounds. The amount of the brightening agent to be in the color developer may be from 0 to 5 g/liter, preferably from 0:1 to 4 g/liter.

Additionally, the color developer may further contain various surfactants such as alkylsulfonyl acids, arylsulfonic acids, aliphatic carboxylic acids and aromatic carboxylic acids.

The processing temperature for the color developer may be 20° C. to 50° C., preferably 30° C. to 45° C. The processing time may be from 20 seconds to 5 minutes, preferably from 30 seconds to 3 minutes and 20 seconds. Where the replenishment system is employed in carrying out the method of the present invention, the amount of the replenisher is preferably smaller. For instance, the amount of the replenisher may be from 100 to 1,500 ml, preferably from 100 to 800 ml, more preferably from 100 to 400 ml, per $m^2$ of the photographic material being processed.

If desired, the color development bath may be composed of two or more tanks, a replenisher may be attached to the first color development tank or to the last color development tank to shorten development time or reduce the amount of the replenisher.

The processing method of the present invention can also be applied to color reversal processing. The black-and-white developer used in such a case, referred to as the first black-and-white developer, is generally used for reversal processing of conventional color photographic material. The developer may contain various well known additives which are added to conventional black-and-white developers, for use in development of conventional monochromatic silver halide photographic materials.

Examples of typical additives include a developing agent such as 1-phenyl-3-pyrazolidone, Metol or hydroquinone; preservatives such as sulfites; an alkali accelerator such as sodium hydroxide, sodium carbonate or potassium carbonate; an inorganic or organic inhibitor such as potassium bromide, 2-methylbenzimidazole or methylbenzothiazole; a water softener such as polyphosphoates; and a development inhibitor, such as a slight amount of an iodide or mercapto compound.

The photographic material as processed with the above mentioned processing solution with fixing ability is then generally rinsed in water or is stabilized. As a simplified process, the photographic material processed using the processing solution with fixing ability may be directly subjected to stabilization, without any substantial rinsing in water.

The rinsing water to be used in the rinsing step may contain, if desired, any known additives. Usable additives include, for example, a water softener such as inorganic phosphoric acid, aminpolycarboxylic acid or organic phosphoric acid; a bactericide or fungicide for inhibiting propagation of various bacteria and algae (for example, isothiazolone, organic chlorine-containing microbicides, benzotriazole), and a surfactant for preventing drying load and unevenness. Additionally, compounds described in L. E. West, *Water Quality Criteria, Phot. Sci. & Eng.*, Vol. 9, No. 6, pages 344 to 359 (1965) may also be added thereto.

The stabilizing solution in the stabilizing step may be used as a processing solution for stabilizing the color images formed. For instance, it may be a solution having a buffering ability in a pH range of from 3 to 6, or a solution containing an aldehyde (e.g., formalin). The stabilizing solution may contain, if desired, an ammonium compound, a metal compound containing metals such as Bi or Al, a brightening agent, a chelating agent (e.g., 1-hydroxyethylidene-1,1-diphosphonic acid), a bactericide, a fungicide, a hardening agent, a surfactant, or an alkanolamine.

The rinsing step or stabilizing step is preferably carried out in a multistage countercurrent system, preferably having from 2 to 4 stages. The amount of replenisher in the step may be from 1 to 50 times, preferably from 2 to 30 times, more preferably from 2 to 15 times, of the carry-over remaining from the previous bath, per the unit area of the photographic material being processed.

As the water to be used in the rinsing step or stabilizing step, city water may be employed. More preferably, deionized water, which is prepared by treating city water with an ion-exchange resin, and which has a calcium content of 5 mg/liter or less and a magnesium content of 5 mg/liter or less; or, a sterilized water prepared by applying a halogen or UV-sterilizing lamp to city water may be employed in the rinsing or stabilizing step.

Water to be added to the processing solution for the purpose of compensating and correcting the evaporated portion of the solution during the processing procedure may be city water. More preferably, the water used for the purpose should also be deionized water or sterilized water.

In carrying out the processing method of the present invention, it is preferred to supply an appropriate amount of water, compensating solution or replenisher of the processing solution to the necessary processing tanks, to compensate and correct the evaporated and concentrated portions of not only the bleaching solution containing the high potential oxidizing agent, bleach-fixing solution or fixing solution, but also any other processing solutions.

The overflow solution from the rinsing step or stabilizing step may be recirculated to the previous bath of any processing bath having fixing ability, whereby the amount of waste solution drained may be reduced.

The photographic material processed by the method of the present invention is not specifically defined, provided that it has at least one blue-sensitive silver halide emulsion layer, at least one green-sensitive silver halide emulsion layer and at least one red-sensitive silver halide emulsion layer on a support. In the material, the number of the silver halide emulsion layers and light-insensitive layers as well as the order of the layers on the support is not specifically defined. One typical example is a silver halide color photographic material having plural light-sensitive layer units, each composed of plural silver halide emulsion layers having substantially the same color sensitivity, but having a different light sensitivity. The respective light-sensitive layers are unit light-sensitive, each having a color sensitivity to blue light, green light or red light. In such a multilayer silver halide color photographic material, in general, the order of the light-sensitive layer units on the support comprises a red-sensitive layer unit, a green-sensitive layer unit and a blue-sensitive layer unit as formed on the support in this order. However, the order may be different, depending on the intended use of the photographic material. As still another embodiment, a different color-sensitive layer may be sandwiched between two other color-sensitive layers of the same variety.

Various light-insensitive layers, such as interlayers, may be provided between the above mentioned silver halide light-sensitive layers, or on or below the uppermost layer or lowermost layer.

Such an interlayer may contain various couplers or DIR compounds described in JP-A-61-43748, JP-A-59-113438, JP-A-59-113440, JP-A-61-20037 and JP-A-61-20038, and it may also contain a conventional agent to prevent color mixing, or an ultraviolet and stain inhibitor.

The preferred silver halide emulsions constituting the respective light-sensitive layer units are two-layered structures composed of a high speed emulsion layer and a low speed emulsion layer as described in West German Patent 1,121,470 and British Patent 923,045. In general, it is preferred that the plural light-sensitive layers are arranged on the support in such a way that the degree of sensitivity of the layer gradually decreases in the direction of the support. In this embodiment, a light-insensitive layer may be positioned between the multiple silver halide emulsion layers. In another embodiment, a low speed emulsion layer is formed remote from the support and a high speed emulsion layer is formed near to the support, as so described in JP-A-57-112751, JP-A-62-200350, JP-A-62-206541, and JP-A-62-206543.

Specific examples of the layer construction on the support include a low speed blue-sensitive layer (BL)/high speed blue-sensitive layer (BH)/high speed green-sensitive layer (GH)/low speed green-sensitive layer (GL)/high speed red-sensitive layer (RH)/low speed red-sensitive layer (RL) taken from the remotest side from the support; an order of BH/BL/GL/GH/RH/RL; and an order of BH/BL/GH/GL/RL/RH.

Other examples include a structure having a blue-sensitive layer/GH/RH/GL/RL on the remotest side from the support, as described in JP-B-55-34932; and an order of blue-sensitive layer/GL/RL/GH/RH from the remotest side from the support, as described in JP-A-56-25738 and JP-A-62-63936.

As a further example, a three-layer unit construction as described in JP-B-49-15495, where the uppermost layer is a silver halide emulsion layer having the highest sensitivity, the intermediate layer is a silver halide emulsion layer having a lower sensitivity than the uppermost layer, and the lowermost layer is a silver halide emulsion layer having an even lower sensitivity than the intermediate layer. That is, in this layer construction, the degree of sensitivity of each emulsion layer is gradually lowered in the direction of the support. Even in a three-layer constitution of this type, each of the same color sensitivity layers may be composed of three layers having a medium speed emulsion layer/high speed emulsion layer/slow speed emulsion layer, formed in this order from the remotest side from the support.

As mentioned above, various layer configurations may be selected in preparing the photographic materials to be processed by the method of the present invention, depending on the application.

The processing method of the present invention may apply to any and every layer configuration and arrangement mentioned above. More preferably, the color photographic material to be processed by the method of the present invention has layers having a total dry thickness of 20.0 μm or less, not including the support, the subbing layer, and the backing layer of the support, to effectively attain the object of the present invention. Especially preferably, the dry thickness of the color photographic material is 18.0 μm or less.

The permissible range of values for the dry thickness of the constituting layers depends upon the color developing agent taken up into the layers of the processed color photographic material. Precisely, the color developing agent remaining in the processed color photographic material has a great influence on the bleaching fog and the generation of color stains formed in the processed material during storage. In particular, the bleaching fog and color stains are caused by the action of the green-sensitive layer, as color sensitization of the magenta color is greater than that of either the cyan or yellow color.

The lowermost limit of the dry thickness of the constituting layers is defined within the range where the properties of the photographic material, particularly the amount of color developing agent taken up, are not affected. For instance, the lowermost limit of the dry thickness of the constituting layers, except the support and the subbing layer and backing layer to the support, may be 12.0 μm; and the lowermost limit of the dry thickness of the layer, which is provided between the light-sensitive layer nearest to the support and the 1 subbing layer of the support, is 1.0 μm. The thickness of the constituting layers may be reduced by narrowing the thickness of the light-sensitive layers or that of the light-insensitive layers.

The film thickness of the multilayer color photographic material of the present invention may be measured, for example, as follows. First, fresh photographic material to be measured is stored for 7 days under conditions of 25° C. and 50% RH. Then, the total thickness of the material is measured. Next, the layers coated on the support are removed, and their thickness is measured. The difference between the total thickness and the thickness of the support is obtained, which is the total thickness of all the coated layers. The thickness may be measured, for example, by the use of a contact type film thickness-measuring device equipped with a piezoelectric conversion element (Anritsu Electric Co., Ltd., K-402B Stand.). The coated layers may be removed from the support by an aqueous sodium hypochlorite solution to the photographic material.

Alternatively, a scanning electron microscope may be used to take a picture of the cross section of the photographic material, to measure the total thickness of the layers coated on the support. The electron microscope should have 3,000× magnification or more.

The photographic material to be processed by the method of the present invention should have a swelling degree of from 50 to 200%, more preferably from 70 to 150%. The swelling degree is calculated using the following formula:

$$\text{Swelling Degree} = \frac{(\text{Equilibrated swollen thickness at } 25^\circ \text{ C. in } H_2O) - (\text{Dry thickness at } 25^\circ \text{ C. and } 55\% \text{ RH})}{(\text{Dry thickness at } 25^\circ \text{ C. and } 55\% \text{ RH})} \times 100$$

If the material has a swelling degree falling outside the above defined range, the amount of color developing agent remaining in the processed photographic material would be too great; and, the remaining color developing agent would have a bad influences on the photographic properties, image qualities (which depend upon desilverability) and physical properties (film thickness) of the processed material.

In addition, the photographic material processed by the method of the present invention should have a film swelling rate ($T\frac{1}{2}$) of 15 seconds or less, more preferably 9 seconds or less. The film swelling rate ($T\frac{1}{2}$) is defined as follows. 90% of the maximum swollen thickness of the photographic material as processed in a color developer at 38° C. and 3 minutes and 15 seconds is referred to as a saturated swollen thickness. The time necessary to attain a half ($\frac{1}{2}$) of the saturated swollen thickness is defined as the film swelling rate ($T\frac{1}{2}$).

The silver halide in the photographic emulsion layers constituting the color photographic material to be processed by the method of the present invention may be silver iodobromide, silver iodochlorobromide, silver chlorobromide, silver bromide or silver chloride. Above all, silver iodobromide, silver iodochloride or silver iodochlorobromide containing silver iodide in an amount of approximately from 0.1 to 30 mol% are preferred. Silver iodobromide containing silver iodide in an amount of approximately from 2 to 25 mol% is especially preferred.

The silver halide grains in the photographic emulsions constituting the photographic material of the present invention may have a regular crystalline structure, with cubic, octahedral or tetradecahedral grains, or, an irregular crystalline structure with spherical or tabular grains. In addition, an irregular crystalline structure having a crystal defect such as twin plane, or composite crystalline, composed of the above mentioned regular and irregular crystalline forms is preferred.

The grains may be fine, having a small grain size of about 0.2 μm or less; or they may be large, having grain sizes up to about 10 μm as the projected diameter. The emulsion of the grains may be either polydispersed or monodispersed.

The silver halide photographic emulsions to be used in the present invention may be prepared by various methods, for example, those described in *Research Disclosure* (*RD*), No. 17643 (December, 1978), pages 22 to 23 (Emulsion Preparation and Types); RD, No. 18716 (November, 1979), page 648; P. Glafkides, *Chimie et Physique Photographique* (published by Paul Montel, 1967); G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions described in U.S. Pat. Nos. 3,574,628 and 3,655,394 and British Patent 1,413,748 also may be used in the present invention.

In addition, tabular grains with an aspect ratio of about 5 or more may also be used in the present invention. Such tabular grains may easily be prepared by various methods, for example, as described in Gutoff, *Photographic Science and Engineering*, Vol. 14, pages 248 to 257 (1970); and U.S. Pat. Nos. 4,434,226, 4,414,310, 4,430,048, 4,439,520 and British Patent 2,112,157.

In the crystal structure of the silver halide grains constituting the emulsions of the present invention, the grains may have the same halogen composition throughout the whole grain, or they may have different halogen compositions between the inside part and the outside part of one grain, or they may have a layered structure. Further, the grains may have different halogen compositions conjugated by epitaxial bonds. They may also have components other than silver halides, such as silver rhodanide or lead oxide, as conjugated with the silver halide matrix.

Additionally, a mixture of various grains with different crystalline forms may be used in the present invention.

The silver halide emulsion for use in the present invention is generally physically ripened, chemically ripened or color-sensitized, before use. Additives used in such a ripening or sensitizing step are described in *Research Disclosure,* Nos. 17643, 18716 and 307105, and the related descriptions in these references are outlined below.

Other known photographic additives which can be used in the present invention are also described in the above mentioned RD references, and the related descriptions therein are also discussed below.

| Additives | RD 17643 (December, 1978) | RD 18716 (November, 1979) | RD 307105 (November, 1989) |
|---|---|---|---|
| 1. Chemical Sensitizers | Page 23 | Page 648, right column | Page 866 |
| 2. Sensitivity Increasing Agents | — | " | — |
| 3. Spectral Sensitizers and Supersensitizers | Pages 23–24 | Page 648, right column to page 649, right column | Pages 866–868 |
| 4. Brightening Agents | Page 24 | Page 647, right column | Page 868 |
| 5. Antifoggants and Stabilizers | Pages 24–25 | Page 649, right column | Pages 868–870 |
| 6. Light Absorbers, Filter Dyes and Ultraviolet Absorbers | Pages 25–26 | Page 649, right column to page 650, left column | Page 873 |
| 7. Antistaining Agents | Page 25, right column | Page 650, left to right columns | Page 872 |
| 8. Dye Image Stabilizers | Page 25 | Page 650, left column | Page 872 |
| 9. Hardeners | Page 26 | Page 651, left column | Pages 874–875 |
| 10. Binders | Page 26 | " | Pages 873–874 |
| 11. Plasticizers and Lubricants | Page 27 | Page 650, right column | Page 876 |
| 12. Coating Aids and Surfactants | Pages 26–27 | " | Pages 875–876 |
| 13. Antistatic Agents | Page 27 | " | Pages 876–877 |
| 14. Matting Agents | — | — | Pages 878–879 |

Various color couplers may be used in the present invention; and examples of usable color couplers are described in the patent publications referred to in the above mentioned RD, No. 17643, VII-C to G.

As yellow couplers, for example, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A are preferred.

As magenta couplers, 5-pyrazolone compounds and pyrazoloazole compounds are preferred. For instance, those described in U.S. Pat. Nos. 4,310,619, 4,351,897, European Patent 73,636, U.S. Pat. Nos. 3,061,432, 3,725,064, RD, No. 24220 (June, 1984), JP-A-60-33552, RD, No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO (PCT) 8/04795 are preferred.

As cyan couplers, phenol couplers and naphthol couplers are preferred. For instance, those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent (OLS) No. 3,329,729, European Patents 121,365A, 249,453A, U.S. Pat. Nos. 3,446,622, 4,333,999, 4,753,871, 4,451,559, 4,427,767, 4,690,889, 4,254,212, 4,296,199, and JP-A-61-42658 are preferred.

As colored couplers for correcting the unnecessary absorption of colored dyes, those described in RD, No. 17643, VII-G, U.S. Pat. No. 4,163,670, JP-B-57-39413, U.S. Pat. Nos. 4,004,929, 4,138,258, British Patent 1,146,368 are preferred. Additionally couplers for correcting the unnecessary absorption of the colored dyes by the phosphor dye released during coupling, as described in U.S. Pat. No. 4,774,181, as well as couplers having a dye precursor group capable of reacting with a developing agent to form a dye as a releasing group, as described in U.S. Pat. No. 4,777,120, are also preferably used.

Couplers capable of forming a colored dye with diffusibility may also be used, and those described in U.S. Pat. No. 4,366,237, British Patent 2,125,570, European Patent 96,570 and West German Patent (OLS) No. 3,234,533 are preferred.

Polymerized dye-forming couplers may also be used, and typical examples of such couplers are described in U.S. Pat. Nos. 3,451,820, 4,080,211, 4,367,282, 4,409,320, 4,576,910 and British Patent 2,102,173.

Couplers capable of releasing a photographically useful residue at coupling may also be used in the present invention. For instance, as DIR couplers for releasing a development inhibitor, those described in patent publications referred to in the above mentioned RD, No. 17643, VII-F, as well as those described in JP-A-57-151944, JP-A-57-154234, JP-A-60-184248, JP-A-63-37346, U.S. Pat. Nos. 4,248,962 and 4,782,012 are preferred.

As couplers for imagewise releasing a nucleating agent or a development accelerator during development, those described in British Patents 2,097,140 and 2,131,188, and JP-A-59-157638 and JP-A-59-170840 are preferred.

In addition, as examples of couplers which may be incorporated into the photographic materials of the present invention include competing couplers described in U.S. Pat. No. 4,130,427; polyvalent couplers described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds as described in JP-A-60-185950 and JP-A-62-24252; couplers for releasing a dye, which recolors after being released from the coupler, as described in European Patent 173,302A; bleaching accelerator-releasing couplers as described in RD, Nos. 11449 and 24241, and JP-A-61-201247; ligand-releasing couplers described in U.S. Pat. No. 4,553,477; leuco dye-releasing couplers described in JP-A-63-75747; and couplers of releasing a phosphor dye as described in U.S. Pat. No. 4,774,181.

The above mentioned couplers may be incorporated into the photographic materials of the present invention by various known dispersion methods.

For instance, an oil-in-water dispersion method may be used. Examples of high boiling point solvents usable in the oil-in-water dispersion method are described in U.S. Pat. No. 2,322,027. Examples of high boiling point organic solvents having a boiling point of 175° C. or higher at normal pressure, which are used in an oil-in-water dispersion include phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphates or phosphonates (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl-p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenyl), aliphatic carboxylates (e.g., bis(2-ethylhexyl) sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately 30° C. or more, preferably from 50° C. to 160° C. can be uses. Examples of such auxiliary organic solvents include ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. Steps for carrying out the dispersion method, the effect of the method, and examples of latexes usable as impregnators in the method are described in U.S. Pat. No. 4,199,363, West German Patent (OLS) Nos. 2,541,274 and 2,541,230.

As still another embodiment for incorporating the above mentioned couplers into the photographic material of the present invention, the couplers may be impregnated into a loadable latex polymer (for example, described in U.S. Pat. No. 4,203,716) in the presence or absence of the above mentioned high boiling point organic solvent; or may be dissolved in a water-insoluble, organic solvent-soluble polymer, and thereafter emulsified, and dispersed in an aqueous hydrophilic colloid solution.

For carrying out the dispersion method, homopolymers or copolymers described in WO (PCT) 88/00723 (pages 12 to 30) are preferably used. In particular, use of acrylamide polymers is preferred to stabilize the color images formed.

The present invention may apply to various color photographic materials. In particular, it is especially preferred to employ the method of the present invention for processing general or movie color negative films, slide, or television color reversal films.

Supports usable in preparing the photographic materials of the present invention are described in, for example, the above mentioned RD, No. 17643, page 28 and RD, No. 18716, from page 647, right column to page 648, left column.

Next, the present invention will be explained in more detail by way of the following examples, which, however, are not intended to restrict the scope of the present invention.

EXAMPLE 1

Plural layers each having the composition mentioned below were formed on a subbing layer-coated cellulose triacetate film support, to prepare a multi-layer color photographic material (Sample No. 101).

Constitution of Photographic Layers:

The amount coated is represented by the unit of $g/m^2$ as silver, for silver halide and colloidal silver. For coupler, additive and gelatin, the amount coated is also represented by the unit of $g/m^2$. For sensitizing dye, the amount coated was represented by the unit of mols per mol of silver halide in the same layer.

| | |
|---|---|
| First Layer: Antihalation Layer | |
| Black Colloidal Silver | 0.15 |
| Gelatin | 1.50 |
| ExM-8 | 0.02 |
| Second Layer: Interlayer | |
| Gelatin | 1.50 |
| UV-1 | 0.03 |
| UV-2 | 0.06 |
| UV-3 | 0.07 |
| ExF-1 | 0.004 |
| Solv-2 | 0.07 |
| Third Layer: Low Speed Red-Sensitive Emulsion Layer | |
| Silver Iodobromide Emulsion (AgI 2 mol %; AgI-rich core-having grains; sphere-corresponding diameter 0.3 μm; fluctuation coefficient of sphere-corresponding diameter 29%; normal crystal/twin crystal mixed grains; ratio of diameter/thickness 2.5) | 0.50 as Ag |
| Gelatin | 1.00 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.22 |
| ExC-4 | 0.035 |
| Solv-1 | 0.007 |
| Fourth Layer: Medium Speed Red-Sensitive Emulsion Layer | |
| Silver Iodobromide Emulsion (AgI 4 mol %; AgI-rich core-having grains; sphere-corresponding diameter 0.55 μm; fluctuation coefficient of sphere-corresponding diameter 20%; normal crystal/twin crystal mixed grains; ratio of diameter/thickness 1) | 0.85 as Ag |
| Gelatin | 1.26 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.33 |
| ExY-14 | 0.01 |
| ExY-13 | 0.02 |
| ExC-2 | 0.08 |
| Cpd-10 | $1.0 \times 10^{-4}$ |
| Solv-1 | 0.10 |
| Fifth Layer: High Speed Red-Sensitive Emulsion | |

-continued

| Layer | |
|---|---|
| Silver Iodobromide Emulsion (AgI 10 mol %; AgI-rich core-having grains; sphere-corresponding diameter 0.7 μm; fluctuation coefficient of sphere-corresponding diameter 30%; normal crystal/twin crystal mixed grains; ratio of diameter/thickness 2) | 0.70 as Ag |
| Gelatin | 1.00 |
| ExS-1 | $1.0 \times 10^{-4}$ |
| ExS-2 | $3.0 \times 10^{-4}$ |
| ExS-3 | $1.0 \times 10^{-5}$ |
| ExC-5 | 0.07 |
| ExC-6 | 0.08 |
| Solv-1 | 0.15 |
| Solv-2 | 0.08 |
| Sixth Layer: Interlayer | |
| Gelatin | 1.00 |
| P-2 | 0.17 |
| Cpd-1 | 0.10 |
| Cpd-4 | 0.17 |
| Solv-1 | 0.05 |
| Seventh Layer: Low Speed Green-Sensitive Emulsion Layer | |
| Silver Iodobromide Emulsion (AgI 2 mol %; AgI-rich core-having grains; sphere-corresponding diameter 0.3 μm; fluctuation coefficient of sphere-corresponding diameter 28%; normal crystal/twin crystal mixed grains; ratio of diameter/thickness 2.5) | 0.30 as Ag |
| Gelatin | 0.40 |
| ExS-4 | $5.0 \times 10^{-4}$ |
| ExS-6 | $0.3 \times 10^{-4}$ |
| ExS-5 | $2.0 \times 10^{-4}$ |
| ExM-9 | 0.2 |
| ExY-13 | 0.03 |
| ExM-8 | 0.03 |
| Solv-1 | 0.20 |
| Eighth Layer: Medium Speed Green-Sensitive Emulsion Layer | |
| Silver Iodobromide Emulsion (AgI 4 mol %; AgI-rich core-having grains; sphere-corresponding diameter 0.55 μm; fluctuation coefficient of sphere-corresponding diameter 20%; normal crystal/twin crystal mixed grains; ratio of diameter/thickness 4) | 0.70 as Ag |
| Gelatin | 1.00 |
| Ex5-4 | $5.0 \times 10^{-4}$ |
| ExS-5 | $2.0 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-13 | 0.04 |
| Solv-1 | 0.20 |
| Ninth Layer: High Speed Green-Sensitive Emulsion Layer | |
| Silver Iodobromide Emulsion (AgI 10 mol %; AgI-rich core-having grains; sphere-corresponding diameter 0.7 μm; fluctuation coefficient of sphere-corresponding diameter 30%; normal crystal/twin crystal mixed grains; ratio of diameter/thickness 2.0) | 0.50 as Ag |
| Gelatin | 0.80 |
| ExS-4 | $2.0 \times 10^{-4}$ |
| ExS-5 | $2.0 \times 10^{-4}$ |

-continued

| | |
|---|---|
| ExS-6 | $0.2 \times 10^{-4}$ |
| ExS-7 | $3.0 \times 10^{-4}$ |
| ExM-11 | 0.06 |
| ExM-12 | 0.02 |
| ExM-8 | 0.02 |
| Cpd-2 | 0.01 |
| Cpd-9 | $2.0 \times 10^{-4}$ |
| Cpd-10 | $2.0 \times 10^{-4}$ |
| Solv-1 | 0.20 |
| Solv-2 | 0.05 |
| Tenth Layer: Yellow Filter Layer | |
| Gelatin | 0.60 |
| Yellow Colloidal Silver | 0.65 |
| Cpd-1 | 0.20 |
| Solv-1 | 0.15 |
| Eleventh Layer: Low Speed Blue-Sensitive Emulsion Layer | |
| Silver Iodobromide Emulsion (AgI 4 mol %; AgI-rich core-having grains; sphere-corresponding diameter 0.5 μm; fluctuation coefficient of sphere-corresponding diameter 15%; octahedral grains) | 0.40 as Ag |
| Gelatin | 1.00 |
| ExS-8 | $2.0 \times 10^{-4}$ |
| ExY-15 | 0.90 |
| ExY-13 | 0.09 |
| Cpd-2 | 0.01 |
| Solv-1 | 0.30 |
| Twelfth Layer: High Speed Blue-Sensitive Emulsion Layer | |
| Silver Iodobromide Emulsion (AgI 10 mol: AgI-rich core-having grains; sphere-corresponding diameter 1.3 μm; fluctuation coefficient of sphere-corresponding diameter 25%; normal crystal/twin crystal mixed grains; ratio of diameter/thickness 4.5) | 0.50 as Ag |
| Gelatin | 0.60 |
| ExS-8 | $1.0 \times 10^{-4}$ |
| ExY-15 | 0.12 |
| Cpd-2 | 0.001 |
| Cpd-5 | $2.0 \times 10^{-4}$ |
| Solv-1 | 0.04 |
| Thirteenth Layer: First Protective Layer | |
| Fine Silver Iodobromide Grains (mean grain size 0.07 μm; AgI 1 mol %) | 0.20 |
| Gelatin | 0.80 |
| UV-2 | 0.10 |
| UV-3 | 0.10 |
| UV-4 | 0.20 |
| Solv-3 | 0.04 |
| Solv-7 | 0.1 |
| Fourteenth Layer: Second Protective Layer | |
| Gelatin | 0.90 |
| Polymethyl Methacrylate Grains (diameter 1.5 μm) | 0.20 |
| H-1 | 0.40 |

In addition, Cpd-3, Cpd-5, Cpd-6, Cpd-7, Cpd-8, P-1, P-2, W-1, W-2 and W-3 mentioned below were added to each layer, to improve the storage stability, processability, pressure resistance, antifungal properties, antibacterial properties, antistatic properties and coatability.

Names and chemical structural formulae of compounds used in preparing the above mentioned sample are listed below.

UV-1

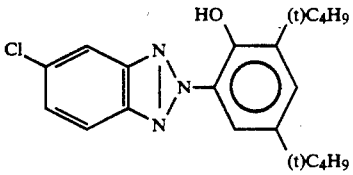

-continued
UV-2
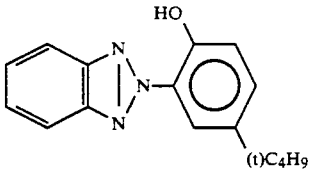
UV-3
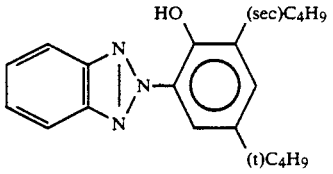
UV-4
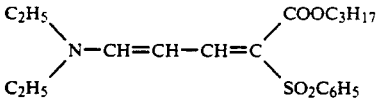
Solv-1: Tricresyl phosphate
Solv-2: Dibutyl phthalate
Solv-3: Tri(2-ethylhexyl) phosphate
ExF-1:
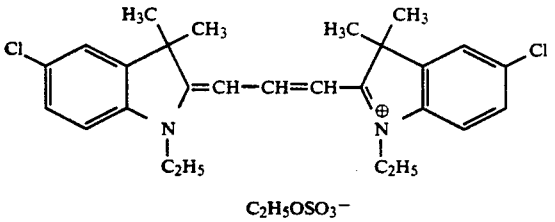
ExC-2:
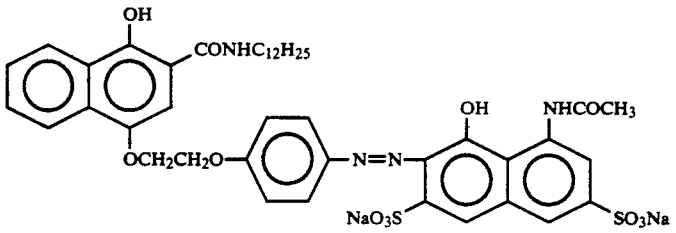
ExC-3:
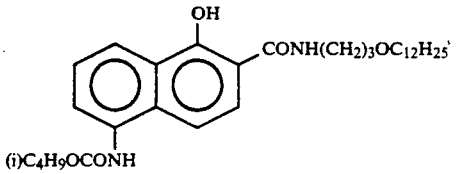
ExC-4:

-continued
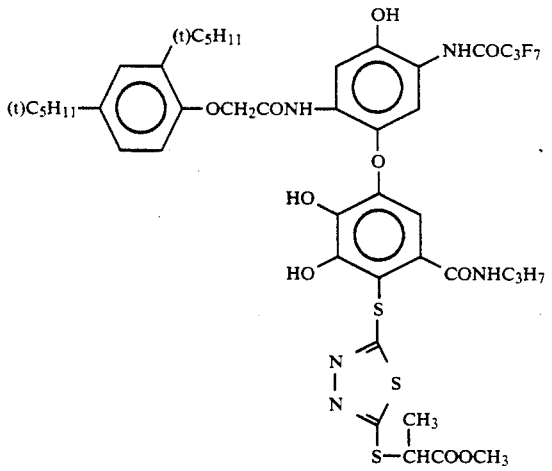
ExC-5:
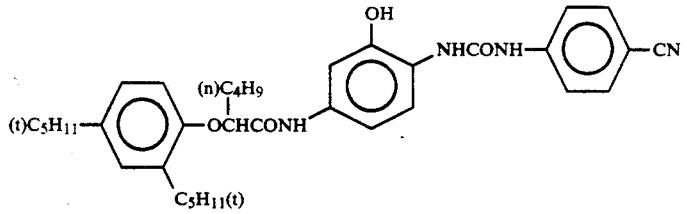
ExC-6:
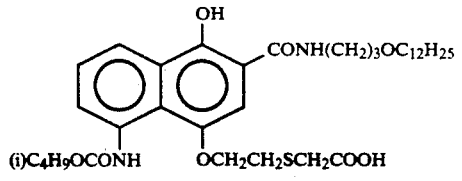
ExM-8:
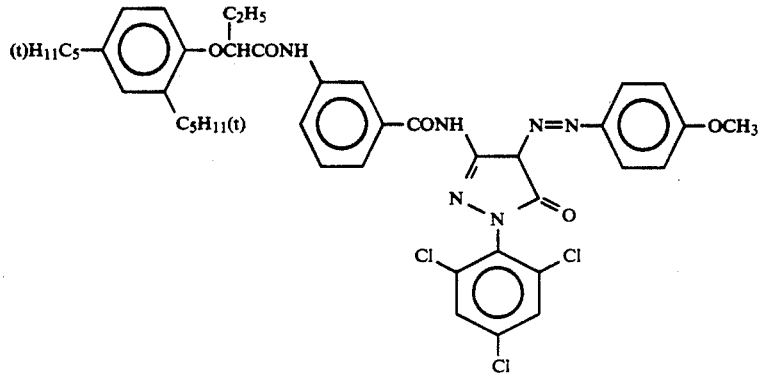
ExM-9:

-continued
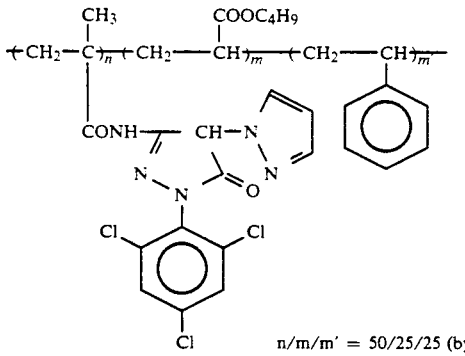
n/m/m' = 50/25/25 (by weight)
molecular weight: ca. 20,000
ExM-10:
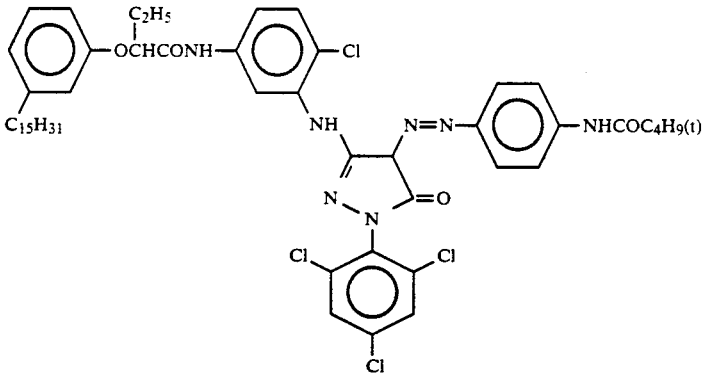
ExM-11:
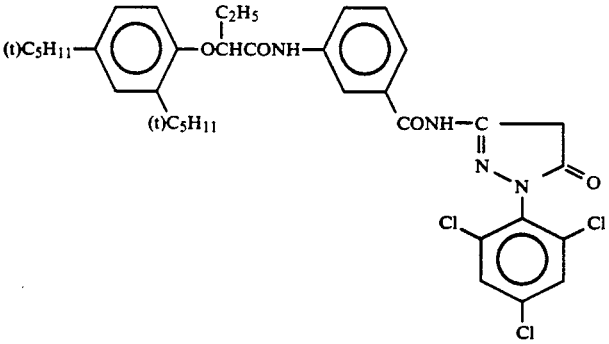
ExM-12:
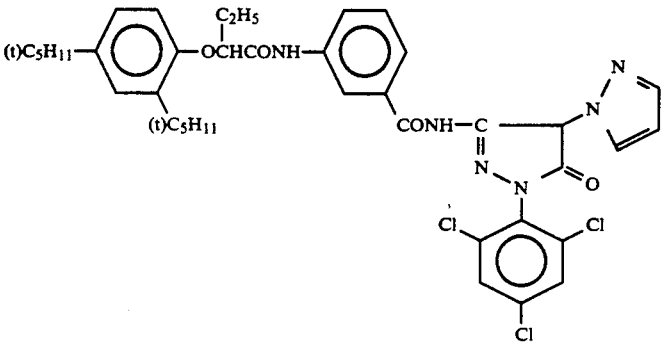
ExY-13:

-continued
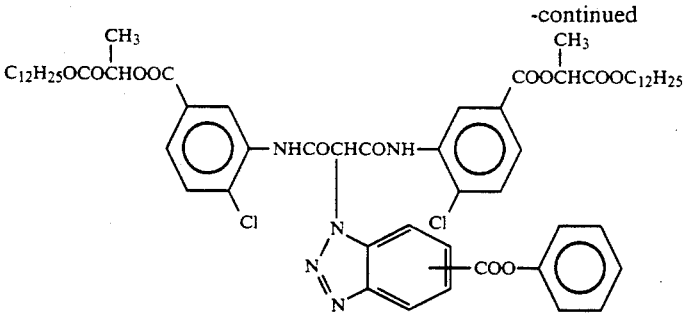
ExY-14:
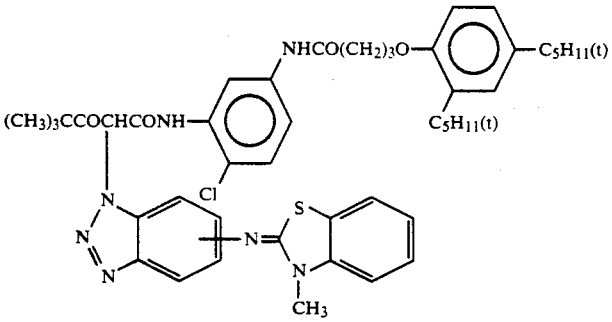
ExY-15:
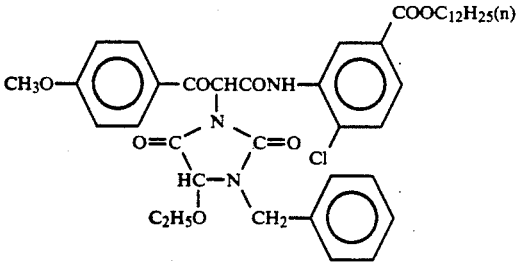
Cpd-1:
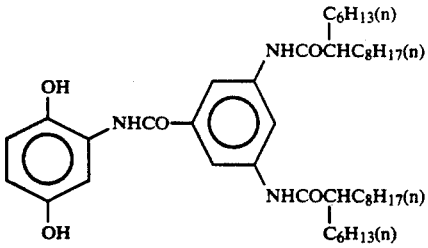
Cpd-2:
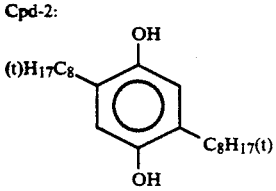
ExS-1:
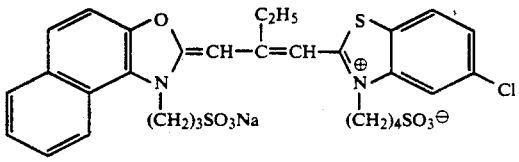
ExS-2:

-continued
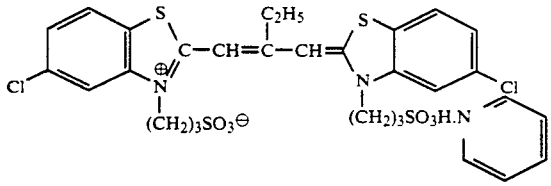
ExS-3:
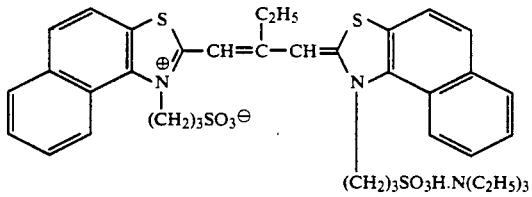
ExS-4:
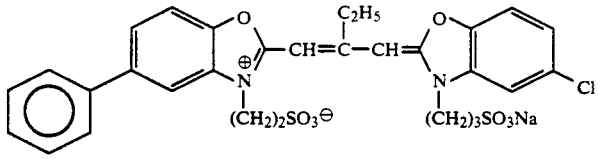
ExS-5:
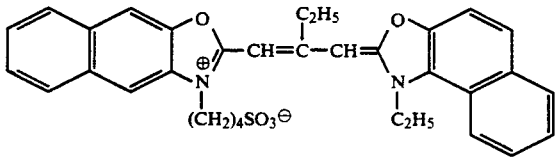
ExS-6:
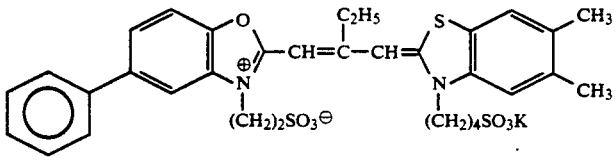
ExS-7:
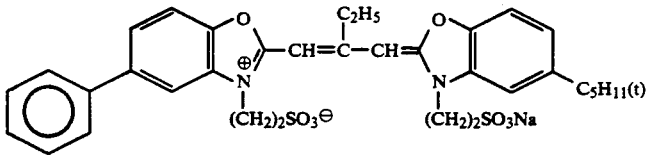
ExS-8:
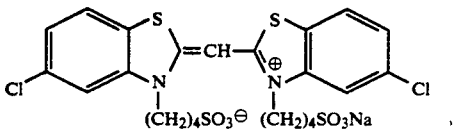
H-1:
$CH_2{=}CH{-}SO_2{-}CH_2{-}CONH{-}CH_2$
$CH_2{=}CH{-}SO_2{-}CH_2{-}CONH{-}CH_2$
Cpd-3:

-continued
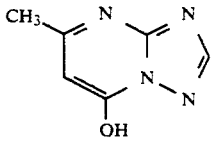
Cpd-4:
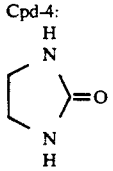
Cpd-5:
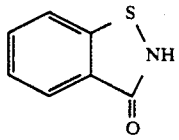
Cpd-6:
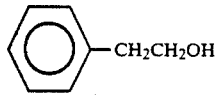
Cpd-7:
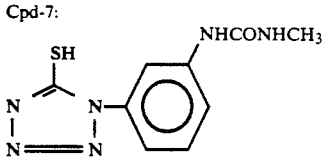
Cpd-8:
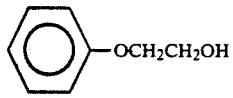
Cpd-9:
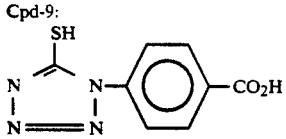
Cpd-10:
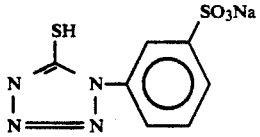
W-1
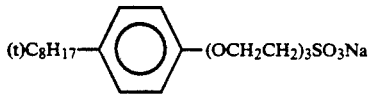
W-2
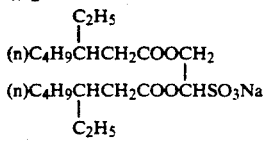
W-3
$C_8F_{17}SO_2N(C_3H_7)CH_2COOK$ -continued P-1
Vinyl pyrrolidone/Vinyl alcohol copolymer (70/30, by weight)

P-2
Polyethyl acrylate

Preparation of Sample No. 102:

Sample No. 102 was prepared in the same manner as in preparation of Sample No. 101, except that yellow colored cyan coupler (YC-30) was added to the 3rd, 4th and 5th layer in an amount of 0.050, 0.070 and 0.020 g/m$^2$, respectively.

Both the sample Nos. 101 and 102 had a dry film thickness of 16.7 μm.

These samples were cut into a size of 35 mm width, imagewise exposed and then processed in accordance with the processing procedure mentioned below, using an automatic developing machine having processing tanks.

| Step | Time | Temperature (°C.) | Amount of Replenisher* (ml) | Tank Capacity (liter) |
|---|---|---|---|---|
| Color Development | 2 min 30 sec | 38 | 20 | 10 |
| Bleaching | 25 sec | 38 | 4.5 | 4 |
| Bleach-Fixing | 40 sec | 38 | — | 4 |
| Fixing | 40 sec | 38 | 14 | 4 |
| Rinsing (1) | 30 sec | 38 | — | 2 |
| Rinsing (2) | 20 sec | 38 | 30 | 2 |
| Stabilization | 20 sec | 38 | 20 | 2 |
| Drying | 1 min | 55 | — | — |

*Amount of replenisher is per meter of 35 mm wide photographic material being processed.

The total processing time was 5 minutes and 25 seconds. Rinsing was effected by countercurrent system from the rinsing tank (2) to the rinsing tank (1). The overflows from the bleaching bath and the fixing bath were all recirculated to the bleach-fixing bath. The overflow from the rinsing tank (1) was all recirculated to the fixing bath.

The bleaching tank, bleach-fixing tank and fixing tank each had an open area value of 0.02.

The carry-over amount of the color developer into the bleaching bath along with the photographic material being processed was 2.5 ml per meter of the 35 mm wide material; and the carry-over amount of the bleaching solution was 2.4 ml.

These samples Nos. 101 and 102 were continuously processed for one month in an amount of 20 m (0.7 m$^2$) a day.

In the bleaching tank, the bleaching solution was aerated only while the photographic material was being processed with the solution.

Next, compositions of the processing solutions used above are shown below.

| | Tank Solution (g) | Replenisher (g) |
|---|---|---|
| Color Developer: | (Mother Liquor) | |
| Diethylenetriaminepentaacetic Acid | 1.0 | 1.0 |
| 1-Hydroxyethylidene-1,1-diphosphonic Acid | 3.0 | 3.2 |
| Sodium Sulfite | 4.0 | 4.9 |
| Potassium Carbonate | 30.0 | 30.0 |
| Potassium Bromide | 1.4 | — |
| Potassium Iodide | 1.5 mg | — |
| Hydroxylamine Sulfate | 2.4 | 3.6 |
| 2-Methyl-4-[N-ethyl-N-(β-hydroxyethyl)amino]aniline Sulfate | 4.5 | 6.0 |
| Water to make | 1.0 liter | 1.0 liter |
| pH | 10.05 | 10.15 |
| Bleaching Solution: | | |
| Ammonium 1,3-Propylenediaminetetraacetato/Fe(III) Monohydrate | 138.0 | 207.0 |
| Aqueous Ammonia (28 wt %) | 3.4 | 5.1 |
| Ammonium Bromide | 80.0 | 120.0 |
| Ammonium Nitrate | 20.0 | 30.0 |
| Hydroxyacetic Acid | 50.0 | 75.0 |
| Acetic Acid (98 wt %) | 50.0 | 75.0 |
| Water to make | 1.0 liter | 1.0 liter |
| pH (adjusted with diethanolamine) | 3.3 | 2.8 |
| Fixing Solution: | | |
| Diammonium Ethylenediamine tetraacetate | 12.0 | 36 |
| Ammonium Sulfite | 20.0 | 60 |
| Imidazole | 30 | 90 |
| Aqueous Ammonium Thiosulfate Solution (700 g/liter) | 280.0 ml | 840 ml |
| Water to make | 1.0 liter | 1.0 liter |
| pH | 7.4 | 7.45 |

Bleach-fixing Solution:

Bleaching solution and fixing solution were blended in a proportion of ⅛ by volume, to prepare a tank solution having pH of 6.8.

Rinsing Water:

Tank solution and replenisher were the same. City water was passed through a mixed bed column filled with an H type strong acidic cation exchange resin (Amberlite IR-120B, a product of Rhom & Haas Co.) and an OH type strong basic anion exchange resin (Amberlite IRA-400, a product of Rhom & Haas Co.) to lower the calcium ion concentration to 3 mg/liter or less and the magnesium ion concentration to 3 mg/liter or less; and, subsequently, 20 mg/liter of sodium dichloroisocyanurate and 150 mg/liter of sodium sulfate were added to the resulting water. The thus treated water had a pH within the range of from 6.5 to 7.5.

Stabilizing Solution:

Tank solution and replenisher were the same.

| | |
|---|---|
| Formalin (37 wt %) | 2.0 ml |
| Polyoxyethylene-p-monononylphenyl Ether (mean polymerization degree 10) | 0.3 g |
| Disodium Ethylenediaminetetraacetate | 0.05 g |
| Water to make | 1.0 liter |
| pH | 5.8 to 8.0 |

The above mentioned process is called Process (1A).

On the other hand, the samples Nos. 101 and 102 were processed by Process (1B) which is different from Process (1A), only in that a bleaching solution having the composition mentioned below was used in Process (1B) and the amount of the replenisher to the bleaching solution in Process (1B) was 15 ml.

Composition of Bleaching Solution for Process (1B):

| | Tank Solution (g) | Replenisher (g) |
|---|---|---|
| Ammonium Ethylenediaminetetra-acetato/Fe(III) | 140.0 | 220.0 |
| Ammonium Bromide | 160.0 | 250.0 |
| Ammonium Nitrate | 20.0 | 30.0 |
| Acetic Acid (98 wt %) | 10 | 15 |
| Water to make | 1.0 liter | 1.0 liter |
| pH (adjusted with diethanol-amine) | 5.5 | 4.5 |

Net, the following tests were carried out, using the running solutions of Process (1A) and Process (1B).

Masking Test:

Each of Sample Nos. 101 and 102 was exposed to a red light of 100 luxes for 0.1 second through a continuous wedge made of glass and then processed in accordance with the process as indicated in Table 1 below. The yellow density of the colored area having a cyan density of 1.5 was measured in each of the thus processed samples.

The yellow density of the nonexposed area was subtracted from the value as obtained by the above mentioned measurement to obtain a value (M), which indicates the masking ability of each sample tested.

Precisely, the masking ability is higher when the value of M is nearer to 0 (zero), and a sample having a higher masking ability has a better color reproducibility.

Light Fading Resistance Test:

A fluorescent light (20,000 luxes) was continuously applied to each of the processed samples for 50 hours, at the nonexposed area from the side of the support, whereupon the variation of the yellow density (ΔD) before and after the light irradiation test was checked.

The value of the variation indicates the light fading resistance of the sample tested. Precisely, the light fading or light decoloration resistance is higher when the value is nearer to 0 (zero).

The samples were tested under various conditions having a different processing time, by varying the length of the conveying rack of the automatic developing machine or varying the linear velocity of the material being conveyed on the rack.

The details of the processing time are shown below. The results obtained in the test are shown in Table 1 below.

Details of Processing Time:

| Step | Time | | | |
|---|---|---|---|---|
| Color Development | 2 min 30 sec | 2 min 30 sec | 2 min 30 sec | 2 min 30 sec |
| Bleaching | 25 sec | 25 sec | 25 sec | 25 sec |
| Bleach-Fixing | 3 min | 1 min | 40 sec | 15 sec |
| Fixing | 3 min 15 sec | 1 min 5 sec | 40 sec | 20 sec |
| Rinsing (1) | 2 min | 1 min | 15 sec | 10 sec |
| Rinsing (2) | 2 min | 1 min | 15 sec | 10 sec |
| Stabilization | 2 min | 1 min | 15 sec | 10 sec |
| Total Processing Time | 15 min | 8 min | 6 min | 4 min |

TABLE 1

| No. | Sample | Processing Solution | Total Processing Time (min) | Masking Ability (M) | Yellow Light Fading (ΔD) | Remarks |
|---|---|---|---|---|---|---|
| 1 | 101 (containing no yellow colored cyan coupler) | 1A (using 1,3-PDTA/Fe-containing bleaching solution) | 15 | 0.20 | 0.06 | Comparison |
| 2 | | | 8 | 0.20 | 0.08 | " |
| 3 | | | 6 | 0.20 | 0.09 | " |
| 4 | | | 4 | 0.20 | 0.11 | " |
| 5 | 101 | 1B (using EDTA/Fe-containing bleaching solution) | 15 | 0.20 | 0.06 | " |
| 6 | | | 8 | 0.20 | 0.08 | " |
| 7 | | | 6 | 0.20 | 0.09 | " |
| 8 | | | 4 | 0.20 | 0.11 | " |
| 9 | 102 (containing yellow colored cyan coupler) | 1A | 15 | 0.02 | 0.06 | " |
| 10 | | | 8 | 0.02 | 0.06 | Invention |
| 11 | | | 6 | 0.02 | 0.05 | " |
| 12 | | | 4 | 0.02 | 0.04 | " |
| 13 | 102 | 1B | 15 | 0.02 | 0.06 | Comparison |
| 14 | | | 8 | 0.09 | 0.09 | " |
| 15 | | | 6 | 0.12 | 0.10 | " |
| 16 | | | 4 | 0.16 | 0.12 | " |

As is apparent from the results in Table 1 above, the photographic material samples as processed in accordance with the rapid processing method of the present invention had a good masking ability and a good light fading resistance. In particular, it is noted that the light fading resistance of the materials processed by the method of the present invention is noticeably improved.

EXAMPLE 2

Sample Nos. 103 to 108 were prepared in the same manner as in Example 1 of preparing Sample No. 102, except that the yellow colored cyan coupler as indicated in Table 2 below was used in place of yellow colored cyan coupler (YC-30) in Sample No. 102. These were processed in the same manner as in Example 1, using the running solution of Process (1A), and the total processing time was 4 minutes. The results of the masking test and the light fading test are shown in Table 2.

TABLE 2

| No. | Sample No. | Yellow Colored Cyan Coupler | Processing Solution | Masking Ability (M) | Yellow Light Fading (ΔD) | Remarks |
|---|---|---|---|---|---|---|
| 1 | 103 | YC-1 | 1A | 0.02 | 0.04 | Invention |
| 2 | 104 | YC-28 | 1A | 0.02 | 0.04 | " |
| 3 | 105 | YC-32 | 1A | 0.04 | 0.04 | " |
| 4 | 106 | YC-46 | 1A | 0.04 | 0.04 | " |
| 5 | 107 | YC-47 | 1A | 0.05 | 0.06 | " |
| 6 | 108 | YC-48 | 1A | 0.05 | 0.06 | " |
| 7 | 102 | YC-30 | 1A | 0.02 | 0.04 | " |

From the results in Table 2 above, it should be noted that the photographic material samples containing yellow colored cyan couplers other than Coupler (YC-30) were favorably processed by the method of the present invention.

EXAMPLE 3

Sample No. 109 was prepared in the same manner as in Example 1 of preparing Sample No. 102, except that the same molar amount of Compound S-29 was added to the 6th layer in place of Compound (Cpd-4). This was subjected to the same tests as those applied to Sample No. 16 of Example 1. As a result, the yellow light fading value of the processed Sample No. 109 was lower than that of the processed Sample No. 16 by 0.01.

As will be well understood from the above mentioned explanation, the present invention provides an excellent method for processing a silver halide color photographic material. In particular, the processing method of the present invention is characterized by the excellent color reproducibility in the processed material and the excellent light fading resistance of the material processed.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising a support having thereon at least one red-sensitive silver halide emulsion layer containing a cyan coupler, at least one green-sensitive silver halide emulsion layer containing a magenta coupler and at least one blue-sensitive silver halide emulsion layer containing a yellow coupler, and wherein the photographic material contains a yellow colored cyan coupler selected from the group consisting of compounds represented by formulae (CI) and (CII):

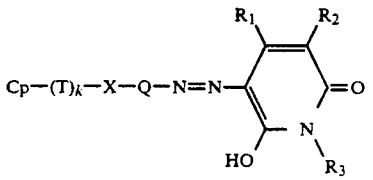

(CI)

-continued

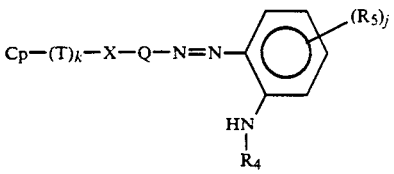

(CII)

wherein $C_p$ represents a cyan coupler residue having T bonded to its coupling position; T represents a timing group, k represents an integer of 0 or 1; X represents a divalent linking group which contains N, O, or S and which is bonded to $(T)_k$ via N, O, or S to link $(T)_k$ and Q; Q represents an arylene group or a divalent heterocyclic group; $R_1$ and $R_2$, which may be the same or different, represents a hydrogen atom, a carboxyl group, a sulfo group, a cyano group, an alkyl group, a cycloalkyl group, an aryl group, a heterocyclic group, a carbamoyl group, a sulfamoyl group, a carbonamide group, a sulfonamide group or an alkylsulfonyl group; $R_3$ represents a hydrogen atom, an alkyl group, a cycloalkyl group, an aryl group or a heterocyclic group; $R_4$ represents an acyl group or a sulfonyl group; $R_5$ represents a substitutable group; j represents an integer of from 0 to 4, and when j is an integer of 2 or more, $R_4$'s may be the same or different; provided that at least one of T, X, Q, $R_1$, $R_2$ and $R_3$ in formula (CI) contains a water-soluble group; and provided that at least one of T, X, Q, $R_4$ and $R_5$ in formula (CII) contains a water-soluble group; and wherein the total processing time for the photographic material is 8 minutes or less, and a processing solution having bleaching ability for the photographic material contains an oxidizing agent having a redox potential of 150 mV or more, said oxidizing agent being an organic compound.

2. The method for processing a silver halide color photographic material as in claim 1, wherein Cp in formulae (CI) and (CII) is a cyan coupler residue selected from the group consisting of formulae (Cp-6), (Cp-7) and (Cp-8):

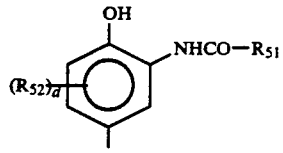

(Cp-6)

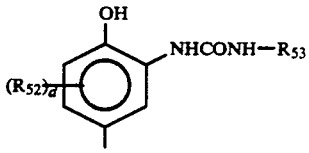

(Cp-7)

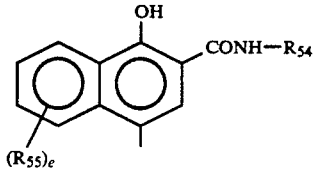

(Cp-8)

wherein $R_{51}$ represents an aromatic group or a heterocyclic group; $R_{52}$ represents an aliphatic group, an aromatic group, a heterocyclic group, $R_{41}-\underset{\underset{R_{43}}{|}}{CON}-$, $R_{41}O\underset{\underset{R_{43}}{|}}{CON}-$, $R_{41}SO_2\underset{\underset{R_{43}}{|}}{N}-$, $R_{43}\underset{\underset{R_{44}}{|}}{N}-CO-\underset{\underset{R_{45}}{|}}{N}-$, $R_{41}\underset{\underset{R_{43}}{|}}{N}-$;

$R_{41}$ represents an aromatic group, an aliphatic group or a heterocyclic group; $R_{43}$, $R_{44}$ and $R_{45}$ each represents a hydrogen atom, an aliphatic group, an aromatic group or a heterocyclic group; d represents an integer of from 0 to 3; and when d is 2 or more, multiple $R_{52}$'s may be the same or different, or they may be bonded to each other to form a cyclic structure; $R_{53}$ and $R_{54}$ each represents an aliphatic group, an aromatic group or a heterocyclic group; $R_{55}$ represents an aliphatic group, an aromatic group, a heterocyclic group, $R_{41}OCONH-$, $R_{41}SO_2NH-$, $R_{43}\underset{\underset{R_{44}}{|}}{N}-CO-\underset{\underset{R_{45}}{|}}{N}-$, $R_{43}N\underset{\underset{R_{44}}{|}}{SO_2}\underset{\underset{R_{45}}{|}}{N}-$, $R_{43}O-$, $R_{41}S-$, a halogen atom, or $R_{41}\underset{\underset{R_{43}}{|}}{N}-$;

and e is an integer of from 0 to 3.

3. The method for processing a silver halide color photographic material as in claim 1, wherein T in formulae (CI) and (CII) is a timing group selected from the group consisting of formulae (T-1) to (T-7):

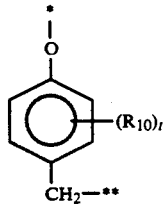
(T-1)

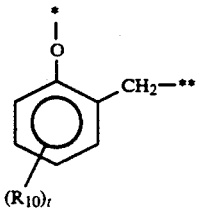
(T-2)

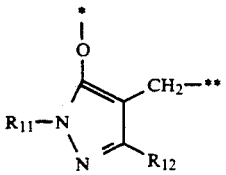
(T-3)

-continued

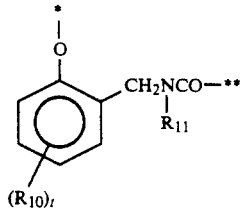
(T-4)

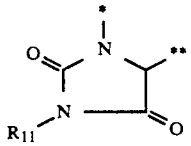
(T-5)

$*-OCH_2-*$ (T-6)

$*-\overset{O}{\overset{\|}{C}}-O-**$ (T-7)

wherein $R_{10}$ represents a group substitutable on the benzene ring; $R_{11}$ represents an aliphatic group, an aromatic group, or a heterocyclic group; $R_{12}$ represents a hydrogen atom or a substituent; and t represents an integer of from 0 to 4; and (*) indicates the position which bonds to Cp and (**) indicates the position which bonds to X, or (*) indicates the position which bonds to Cp and (**) indicates the position which bonds to Q.

4. The method for processing a silver halide color photographic material as in claim 1, wherein the yellow colored cyan coupler is a compound represented by formula (CI).

5. The method for processing a silver halide color photographic material as in claim 1, wherein the photographic material further contains at least one of compounds represented by formulae (I) and (II), and salts thereof:

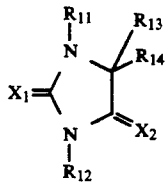
(I)

wherein $X_1$ and $X_2$ each represent an oxygen atom or =NH; $R_{11}$ and $R_{12}$ each represents a hydrogen atom, an acyl group or an optionally substituted hydrocarbon residue; $R_{13}$ and $R_{14}$ each represent a hydrogen atom, a hydroxyl group, an optionally substituted amino group, an optionally substituted hydrocarbon residue, or —OR (in which R represents an optionally substituted hydrocarbon residue); $R_{13}$ and $R_{14}$ may be bonded to each other to form a 5-membered or 6-membered saturated carbon ring nucleus; provided that $R_{11}$ and $R_{12}$ must not be a hydroxylated methyl group and that when both $X_1$ and $X_2$ are oxygen atoms and both $R_{13}$ and $R_{14}$ are groups other than an optionally substituted amino group, or $R_{13}$ and $R_{14}$ are bonded to each other to form a 5-membered or 6-membered saturated carbon ring nucleus, at least one of $R_{11}$ and $R_{12}$ is a hydrogen atom;

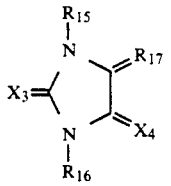

(II)

wherein $X_3$ and $X_4$ each represents an oxygen atom or =NH; $R_{15}$ and $R_{16}$ each represents a hydrogen atom, an acyl group or an optionally substituted hydrocarbon residue; $R_{17}$ represents an optionally substituted imino group, or an optionally substituted hydrocarbon residue; provided that $R_{15}$ and $R_{16}$ must not be hydroxylated methyl groups, and that when both $X_3$ and $X_4$ are oxygen atoms and $R_{17}$ is an optionally substituted hydrocarbon residue, at least one of $R_{15}$ and $R_{16}$ is a hydrogen atom.

6. The method for processing a silver halide color photographic material as in claim 1, wherein the total processing time is 6 minutes or less.

7. The method for processing a silver halide color photographic material as in claim 1, wherein the processing solution having a bleaching ability is a bleaching solution or a bleach-fixing solution.

8. The method for processing a silver halide color photographic material as in claim 1, wherein the yellow colored cyan coupler is added to a light-sensitive silver halide emulsion layer or the adjacent layer thereof.

9. The method for processing a silver halide color photographic material as in claim 1, wherein the yellow colored cyan coupler is added to the photographic material in a total amount of from 0.005 to 0.30 g/m$^2$.

10. The method for processing a silver halide color photographic material as in claim 5, wherein the compound represented by formula (I) or (II) or the salt thereof is added to the photographic material in a total amount of 0.01 to 1.0 g/m$^2$.

11. The method for processing a silver halide color photographic material as in claim 1, wherein the oxidizing agent is 1,3-propylenediaminetetraacetato/Fe(III).

12. The method for processing a silver halide color photographic material as in claim 1, wherein the oxidizing agent is added to the processing solution having a bleaching ability in an amount of from 0.17 to 0.7 mol/-liter.

13. The method for processing a silver halide color photographic material as in claim 1, wherein the processing solution having a bleaching ability has a pH value of from 2 to 8.

14. The method for processing a silver halide color photographic material as in claim 1, wherein the processing solution having a bleaching ability has a pH value of from 2.5 to 4.2.

15. The method for processing a silver halide color photographic material as in claim 1, wherein the total processing time is from 1 to 4 minutes.

16. The method for processing a silver halide color photographic material as in claim 1, wherein said oxidizing agent is selected from the group consisting of aminopolycarboxylato/iron (III) complexes.

17. The method for processing a silver halide color photographic material as in claim 1, wherein k in formulae (CI) and (CII) is 0.

* * * * *